US012168862B2

(12) United States Patent
Erickson et al.

(10) Patent No.: US 12,168,862 B2
(45) Date of Patent: Dec. 17, 2024

(54) SPRAY HEAD RETRACTION ASSEMBLY

(71) Applicant: Kohler Co., Kohler, WI (US)

(72) Inventors: Perry D. Erickson, Sheboygan, WI (US); Jacob Frye, Sheboygan Falls, WI (US); Ryan Leichty, Sheboygan, WI (US); Si He, Jiangxi (CN); Tonggang Pan, Shanghai (CN); Luke Tian, Jiangsu (CN)

(73) Assignee: Kohler Co., Kohler, WI (US)

( * ) Notice: Subject to any disclaimer, the term of this patent is extended or adjusted under 35 U.S.C. 154(b) by 167 days.

(21) Appl. No.: 17/722,214

(22) Filed: Apr. 15, 2022

(65) Prior Publication Data

US 2022/0349160 A1 Nov. 3, 2022

Related U.S. Application Data

(63) Continuation-in-part of application No. PCT/CN2022/076972, filed on Feb. 18, 2022, and a (Continued)

(51) Int. Cl.
*E03C 1/04* (2006.01)

(52) U.S. Cl.
CPC ..... *E03C 1/0404* (2013.01); *E03C 1/04* (2013.01); *E03C 2001/0415* (2013.01); *E03C 2001/0417* (2013.01); *Y10T 137/9464* (2015.04)

(58) Field of Classification Search
CPC .. E03C 1/0404; E03C 1/04; E03C 2001/0415; E03C 2001/0417; Y10T 137/9464
(Continued)

(56) References Cited

U.S. PATENT DOCUMENTS 1,210,893 A * 1/1917 Brenton ..... F16K 41/14 251/220
2,026,327 A 12/1935 Sparling
(Continued)

FOREIGN PATENT DOCUMENTS

AU 2016330364 A1 5/2018
BR 112018005774 10/2018
(Continued)

OTHER PUBLICATIONS

First Office Action CN Appl. Ser. No. 201710415057.1 dated Apr. 9, 2019 (10 pages).
(Continued)

*Primary Examiner* — John Bastianelli
(74) *Attorney, Agent, or Firm* — Husch Blackwell LLP

(57) ABSTRACT

A faucet mounting assembly for a faucet includes a conical nut and a receiving clip. The conical nut is coupled to a nozzle. The receiving clip is coupled to an inner surface of the faucet and is configured to receive the conical nut within. The receiving clip includes a substantially annular base, one or more tabs and a slot. The one or more tabs including fixed ends fixed to the substantially annular base and free ends opposite the fixed ends and bounded by the slot. The one or more tabs are configured to flex radially between a non-flexed position and a flexed position. The one or more tabs flex into the flexed position when the conical nut is repositioned in and out of engagement with the receiving clip and return to the non-flexed position when the conical nut is seated within the receiving clip.

7 Claims, 40 Drawing Sheets

Related U.S. Application Data continuation-in-part of application No. PCT/CN2021/090781, filed on Apr. 28, 2021.

(60) Provisional application No. 63/270,771, filed on Oct. 22, 2021, provisional application No. 63/183,322, filed on May 3, 2021.

(58) Field of Classification Search
USPC ..... 137/801
See application file for complete search history.

(56) References Cited

U.S. PATENT DOCUMENTS

| | | | | |
|---|---|---|---|---|
| 2,028,553 | A * | 1/1936 | Lubin | B67D 1/0425 285/334.3 |
| 2,095,241 | A | 10/1937 | Cox | |
| 2,423,655 | A * | 7/1947 | Mars | F16L 19/065 285/341 |
| 2,875,496 | A | 3/1959 | Fox | |
| 3,612,318 | A | 10/1971 | Ramsey | |
| 4,360,159 | A | 11/1982 | Haynes | |
| 4,446,884 | A | 5/1984 | Rader, Jr. | |
| 4,662,768 | A * | 5/1987 | Gottwald | E03C 1/0404 239/289 |
| 5,117,859 | A | 6/1992 | Carlson | |
| 5,775,354 | A | 7/1998 | Upton | |
| 5,934,325 | A | 8/1999 | Brattoli | |
| 6,234,192 | B1 | 5/2001 | Esche et al. | |
| 6,588,453 | B2 | 7/2003 | Marty et al. | |
| 6,738,996 | B1 | 5/2004 | Malek et al. | |
| 6,810,539 | B2 | 11/2004 | Bosio | |
| 6,845,526 | B2 | 1/2005 | Malek et al. | |
| 6,877,172 | B2 | 4/2005 | Malek et al. | |
| 6,915,816 | B2 | 7/2005 | Nelson et al. | |
| 6,915,817 | B2 | 7/2005 | Benstead et al. | |
| 7,699,241 | B2 | 4/2010 | Benstead | |
| 7,997,301 | B2 | 8/2011 | Marty et al. | |
| 8,091,929 | B2 | 1/2012 | Lorch | |
| 8,104,512 | B2 | 1/2012 | Nelson et al. | |
| 8,800,075 | B2 | 8/2014 | Van Leyen et al. | |
| 8,875,738 | B2 * | 11/2014 | Yang | E03C 1/0401 137/801 |
| 9,062,790 | B2 | 6/2015 | Esche et al. | |
| 9,175,458 | B2 | 11/2015 | Meehan et al. | |
| 9,194,109 | B2 | 11/2015 | Ho | |
| 9,259,744 | B2 | 2/2016 | Hansen | |
| 9,334,635 | B2 | 5/2016 | Keiter et al. | |
| 9,683,353 | B2 | 6/2017 | Myers et al. | |
| 9,695,580 | B2 | 7/2017 | Esche et al. | |
| 9,840,831 | B1 | 12/2017 | Esche et al. | |
| 9,988,796 | B2 | 6/2018 | Bosio | |
| 10,184,231 | B2 | 1/2019 | Pitsch et al. | |
| 10,260,216 | B2 | 4/2019 | Zhu et al. | |
| 10,526,773 | B2 | 1/2020 | Mu et al. | |
| 10,669,701 | B2 | 6/2020 | Hadfield et al. | |
| 10,745,895 | B2 | 8/2020 | Li | |
| 10,781,579 | B2 | 9/2020 | Mu et al. | |
| 11,053,670 | B2 | 7/2021 | Tracy et al. | |
| 11,208,792 | B2 | 12/2021 | Myers et al. | |
| 2003/0188381 | A1 | 10/2003 | Bosio | |
| 2004/0135010 | A1 | 7/2004 | Malek et al. | |
| 2014/0150896 | A1 | 6/2014 | Chucheng et al. | |
| 2015/0333360 | A1 | 11/2015 | Tajima et al. | |
| 2016/0237661 | A1 | 8/2016 | Teagarden | |
| 2017/0096801 | A1 | 4/2017 | Pitsch et al. | |
| 2017/0314241 | A1 | 11/2017 | Myers et al. | |
| 2018/0080203 | A1 | 3/2018 | Frye | |
| 2019/0040611 | A1 * | 2/2019 | Zhu | E03C 1/0404 |
| 2019/0071851 | A1 | 3/2019 | Meehan et al. | |
| 2019/0382990 | A1 | 12/2019 | Tracy | |
| 2020/0063408 | A1 | 2/2020 | Tracy et al. | |
| 2020/0378097 | A1 | 12/2020 | Li | |
| 2021/0404156 | A1 | 12/2021 | Tracy et al. | |

FOREIGN PATENT DOCUMENTS

| | | | | |
|---|---|---|---|---|
| CA | 2522873 | A1 | 9/2004 | |
| CA | 3000652 | A1 | 4/2017 | |
| CN | 1675435 | A | 9/2005 | |
| CN | 202629230 | U | 12/2012 | |
| CN | 203034539 | U | 7/2013 | |
| CN | 203096843 | | 7/2013 | |
| CN | 204628794 | U | 9/2015 | |
| CN | 205244538 | U | 5/2016 | |
| CN | 105756143 | A | 7/2016 | |
| CN | 105822791 | A | 8/2016 | |
| CN | 106715806 | A | 5/2017 | |
| CN | 107489189 | A | 12/2017 | |
| CN | 108290702 | A | 7/2018 | |
| CN | 110063675 | A | 7/2019 | |
| CN | 112262008 | | 1/2021 | |
| DE | 3339849 | A1 | 5/1985 | |
| DE | 11 2004 000 418 | T5 | 1/2006 | |
| DE | 20 2005 019 492 | U1 | 2/2006 | |
| EP | 1350895 | A1 * | 10/2003 | E03C 1/04 |
| EP | 1 418 008 | A1 | 5/2004 | |
| EP | 3 356 268 | A1 | 8/2018 | |
| GB | 2 415 484 | A | 12/2005 | |
| GB | 2 426 809 | A | 12/2006 | |
| GB | 2 435 502 | A | 8/2007 | |
| JP | 2003-027539 | | 1/2003 | |
| JP | 6783854 | B2 | 10/2018 | |
| MX | 2018003825 | A | 3/2018 | |
| WO | WO-2004/081437 | A2 | 9/2004 | |
| WO | WO-2014/130816 | | 8/2014 | |
| WO | WO-2017/058566 | A1 | 4/2017 | |

OTHER PUBLICATIONS

International Search Report and Written Opinion on PCT Appl. Ser. No. PCT/CN2021/090781 dated Dec. 29, 2021 (11 pages).

Foreign Search Report on PCT PCT/CN2022/076972 DTD May 18, 2022.

European Search Report, European Application No. 22170072.7, dated Oct. 6, 2022, 11 pages.

* cited by examiner

SPRAY HEAD RETRACTION ASSEMBLY

CROSS-REFERENCE TO RELATED PATENT APPLICATIONS

This application is a continuation-in-part of International Patent Application No. PCT/CN2021/090781 filed Apr. 28, 2021. This application also claims the benefit of and priority to U.S. Provisional Patent Application No. 63/183,322 filed May 3, 2021. This application also claims the benefit of priority to U.S. Provisional Patent Application No. 63/270,771 filed Oct. 22, 2021. This application is also a continuation-in-part of International Patent Application No. PCT/CN2022/076972 filed Feb. 18, 2022, which claims the benefit of and priority to International Patent Application No. PCT/CN2021/090781 filed Apr. 28, 2021, and U.S. Provisional Patent Application No. 63/270,771 filed Oct. 22, 2021. All of these applications are incorporated by reference herein in their entireties.

BACKGROUND

The present disclosure relates generally to the field of kitchen fixtures. In particular, the present disclosure relates to an assembly for retracting a spray head into a spout for docking.

Conventionally, a faucet with a removable spray head connected to a hose may include a counterweight on the hose positioned beneath the faucet to apply a force on the hose to retract the spray head toward the spout. The counterweight provides a substantially constant retraction force for biasing the spray head toward the spout, but does not prevent the hose from disturbing items stored beneath a sink, where the hose is stored. Other biasing mechanisms (e.g., springs) increase in resistance as the hose is withdrawn and therefore do not provide the desirable constant retraction force.

SUMMARY

At least one embodiment relates to a faucet mounting assembly for a faucet. The faucet includes a faucet body and a nozzle configured to releasably attached to an end of the faucet body. The faucet mounting assembly includes a conical nut and a receiving clip. The conical nut is coupled to the nozzle. The receiving clip is coupled to an inner surface of the faucet and is configured to receive the conical nut within. The receiving clip includes a substantially annular base, one or more tabs and a slot. The one or more tabs including fixed ends fixed to the substantially annular base and free ends opposite the fixed ends and bounded by the slot. The one or more tabs are configured to flex radially between a non-flexed position and a flexed position. The one or more tabs flex into the flexed position when the conical nut is repositioned in and out of engagement with the receiving clip and return to the non-flexed position when the conical nut is seated within the receiving clip.

Another embodiment relates to a hose retraction assembly. The hose retraction assembly includes a housing, a spool, a material, and a rotary damper. The spool is disposed within the housing and configured to rotate about an axis. The material is disposed around the spool and received through the housing. The material is coupled to a hose. The rotary damper is coaxially coupled to the spool and configured to selectively reposition between an engaged state and a disengaged state. The rotary damper prevents free rotation of the spool when the rotary damper is in the engaged state. The rotary damper permits free rotation of the spool when the rotary damper is in the disengaged state.

Another embodiment relates to a hose retraction assembly for a hose. The hose is selectively repositionable between an extended position and a retracted position. The hose retraction assembly includes an elongate member, a bracket, a biasing member, and a rotary damper. The elongate member extends from a faucet and includes a track therein. The bracket is coupled to the elongate member and is slidably repositionable along at least a portion of the elongate member between a first position and a second position. The biasing member is coupled to the bracket and configured to provide a biasing force onto the bracket into the first position. The rotary damper is configured to impose a unidirectional resistance onto the bracket. The elongate member is rotatably oriented out of engagement with components of the faucet.

This summary is illustrative only and should not be regarded as limiting.

BRIEF DESCRIPTION OF THE FIGURES

The disclosure will become more fully understood from the following detailed description, taken in conjunction with the accompanying figures, wherein like reference numerals refer to like elements, in which.

DETAILED DESCRIPTION

Before turning to the FIGURES, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

Referring generally to the FIGURES, a faucet having a spray head retraction assembly (i.e., system) is shown according to various exemplary embodiments. The faucet includes a body, a spout, and a spray head releasably coupled (e.g., removably coupled, selectively coupled, etc.) to the spout. A hose carries fluid through the spout to the spray head, where the fluid is ejected (e.g., released, sprayed, output) to the environment, for example, into a basin, sink, tub, or shower stall.

Figure 1:
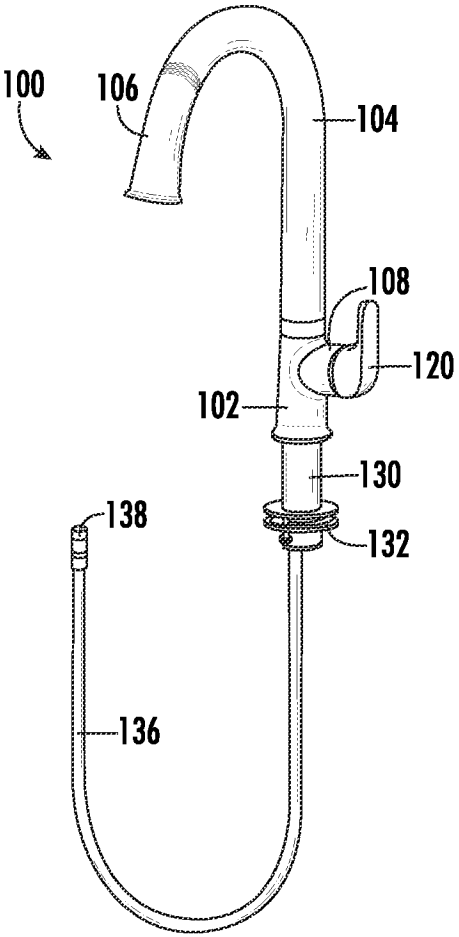
FIG. 1 is a perspective view of a faucet with a spray head in a retracted position, according to an example embodiment.

Referring to FIG. 1, the faucet 100 is shown in a retracted (e.g., first, docked, etc.) position. The faucet 100 is shown to include a base 102, a spout 104, and a spray head 106 removably coupled to (e.g., received in, engaging, etc.) the spout 104. In the retracted position, the spray head 106 is coupled to and received in the spout 104. According to the present disclosure, a spray head retraction assembly is configured to retract the spray head 106 from an extended position to the retracted position. Various embodiments of the spray head retraction assembly are described in greater detail below. The faucet 100 is shown to include an arm 108 configured to house and support a manual valve (not shown). The valve may be configured to control the volume, temperature, or some combination thereof, of the fluid (e.g., water, beverage, etc.) flow through the faucet 100. A handle 120 is coupled to the valve to control the operation thereof. According to other embodiments, the faucet 100 may not include an arm 108, and the valve and handle 120 may be located remotely from the faucet 100. According to various other embodiments, the faucet 100 may include an electronically controlled valve (e.g., solenoid valve) in addition to or instead of the manual valve.

Figure 2:
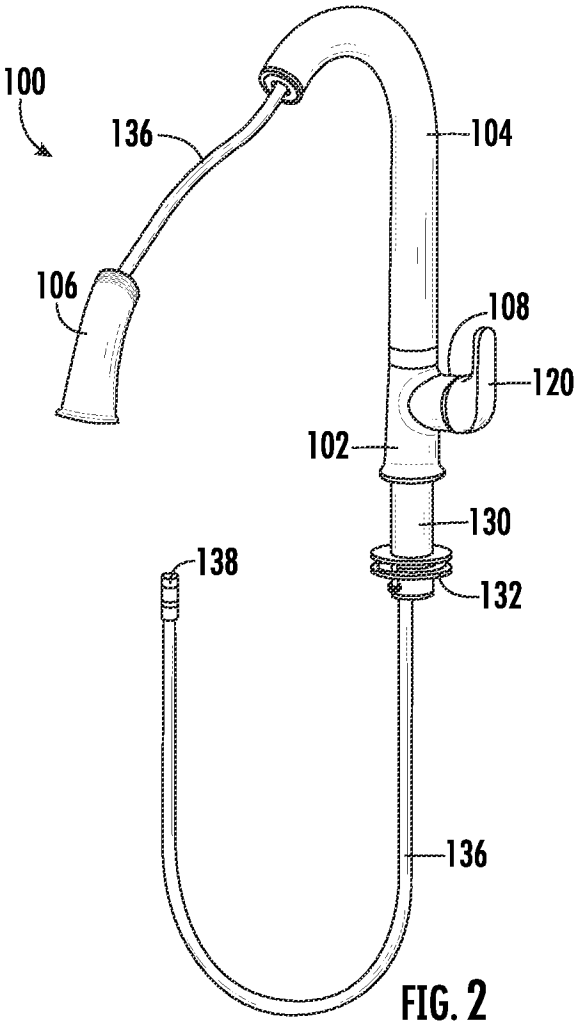
FIG. 2 is a perspective view of the faucet of FIG. 1 in an extended position, according to an example embodiment.

Referring now to FIG. 2, the faucet 100 is shown in an extended positon. The faucet 100 is operable to transition between the retracted position and the extended position. In some embodiments, the faucet 100 includes a fully extended position (e.g., a position in which the hose 136 may no longer be extended) and a plurality of partially extended positions (e.g., a position between the fully extended position and the retracted position). In some embodiments, a retraction assembly applies a force (e.g., constant force, variable force) to the hose 136 and the spray head 106 in the direction of the retracted position. Thus, if a user is using the spray head 106 in an extended position (e.g., partially extended position), release of the spray head 106 by the user will result in the spray head 106 moving toward the retracted positon and re-coupling to the spout 104.

Figure 3:
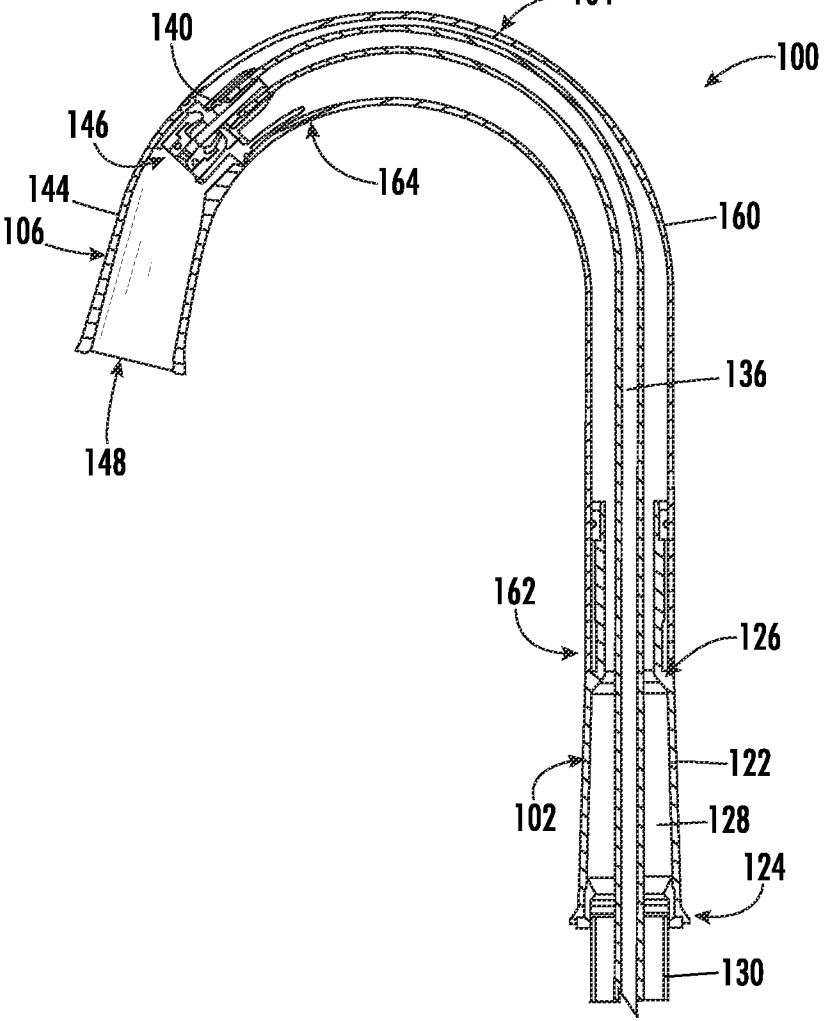
FIG. 3 is a side, cross-sectional view of the faucet of FIG. 1, according to an example embodiment.
Figure 7:
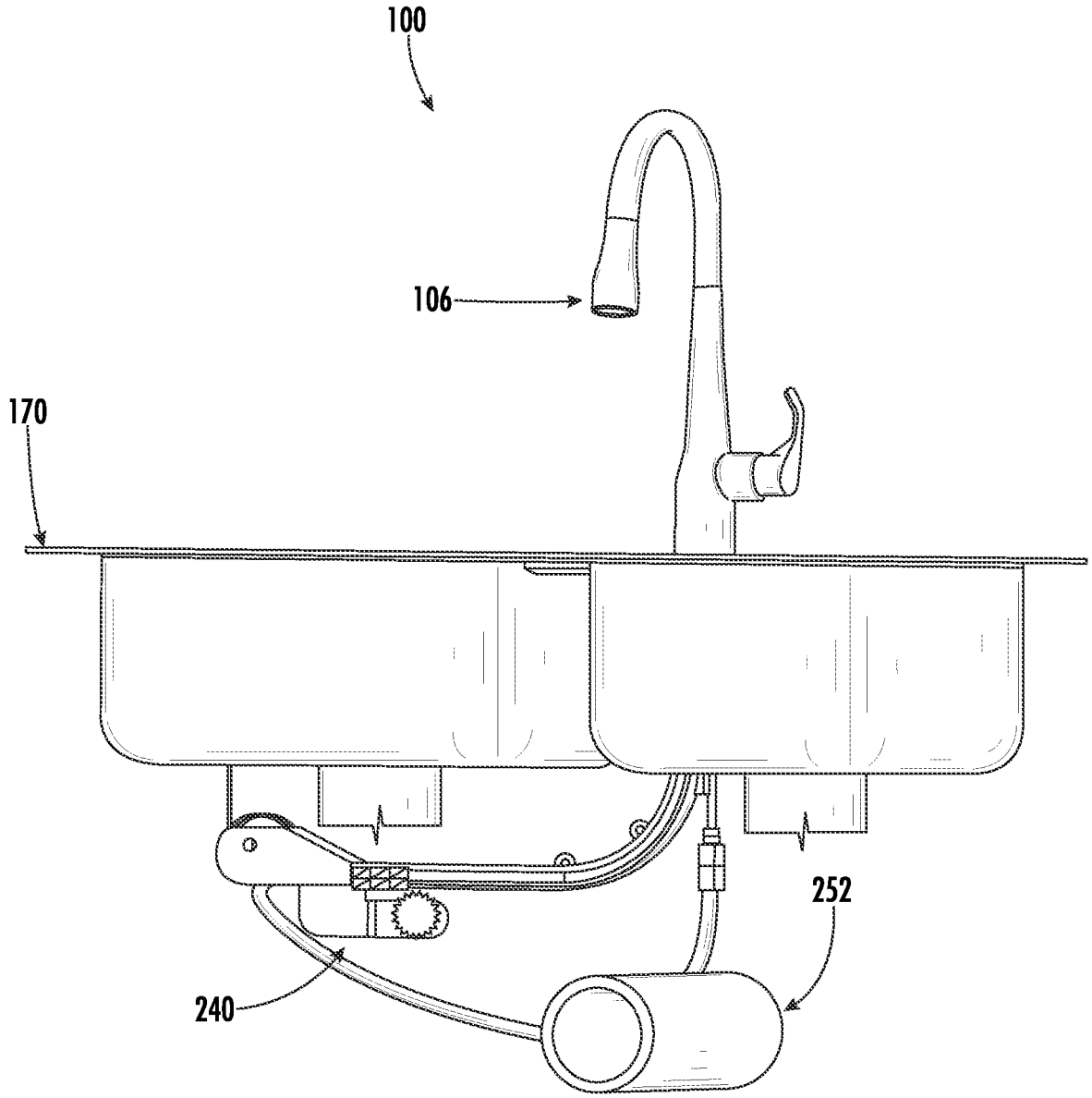
FIG. 7 is a perspective view of the faucet and the spray head retraction assembly of FIG. 4 mounted proximate to a wash basin, according to an example embodiment.

Referring to FIG. 3, the base 102 includes a sidewall 122, extending between a first or bottom end 124 to a second or top end 126, and an axially extending cavity 128. The bottom end 124 is configured to provide stable support to the faucet 100 when coupled to a first surface 170 (e.g., countertop, wall, bar, table, support structure, etc.), as shown in FIG. 7. A shank 130 (e.g., stem) may be coupled (e.g., threadably coupled) to the bottom end 124 and extend through the first surface 170. A clamping mechanism 132 is coupled to the shank 130 and configured to couple the shank 130 to an opposite side (e.g., underside, inside, etc.) of the first surface 170. According to an exemplary embodiment, the first surface 170 is a sink or countertop over a cabinet, the countertop receiving the sink therein.

The sidewall 122 is shown to at least partially define the cavity 128, which is configured to receive and permit the passage therethrough of water lines (not shown). For example, the cavity 128 may receive a cold water line (not shown) and a hot water line (not shown). The faucet 100 further includes an outlet line, shown as hose 136, according to an exemplary embodiment. The hose 136 is configured to carry water through the spout 104 to the spray head 106 and is sufficiently flexible to permit the hose 136 to travel through the shape of the spout 104 while the spray head 106 is moved between the docked and undocked position. According to the exemplary embodiment shown, the hose 136 extends from a first or inlet end 138, which fluidly couples to the valve, to a second or outlet end 140, which fluidly couples to the spray head 106.

The spray head 106 includes a sidewall 144 extending between a first or inlet end 146 and a second or outlet end 148. The spray head 106 transfers fluid from the hose 136 to an outlet port. For example, the spray head 106 may include an aerator and one or more non-aerated nozzles. A diverter mechanism controlled by a switch may transition the flow between modes, e.g., divert flow to the aerator, to the nozzles, or pause the flow of fluid through the spray head 106.

The spout 104 includes a sidewall 160 extending from a first or bottom end 162 to a second or top end 164. The bottom end 162 couples to the top end 126 of the base 102. According to other embodiments, the spout 104 may be fixed to the base 102, but according to the embodiment shown, the spout 104 is rotatably coupled to the base 102 to provide direction and range of the outlet flow of fluid to the environment, i.e., provides a greater usable work area. The top end 164 is configured to releasably couple to the spray head 106.

Figure 4:
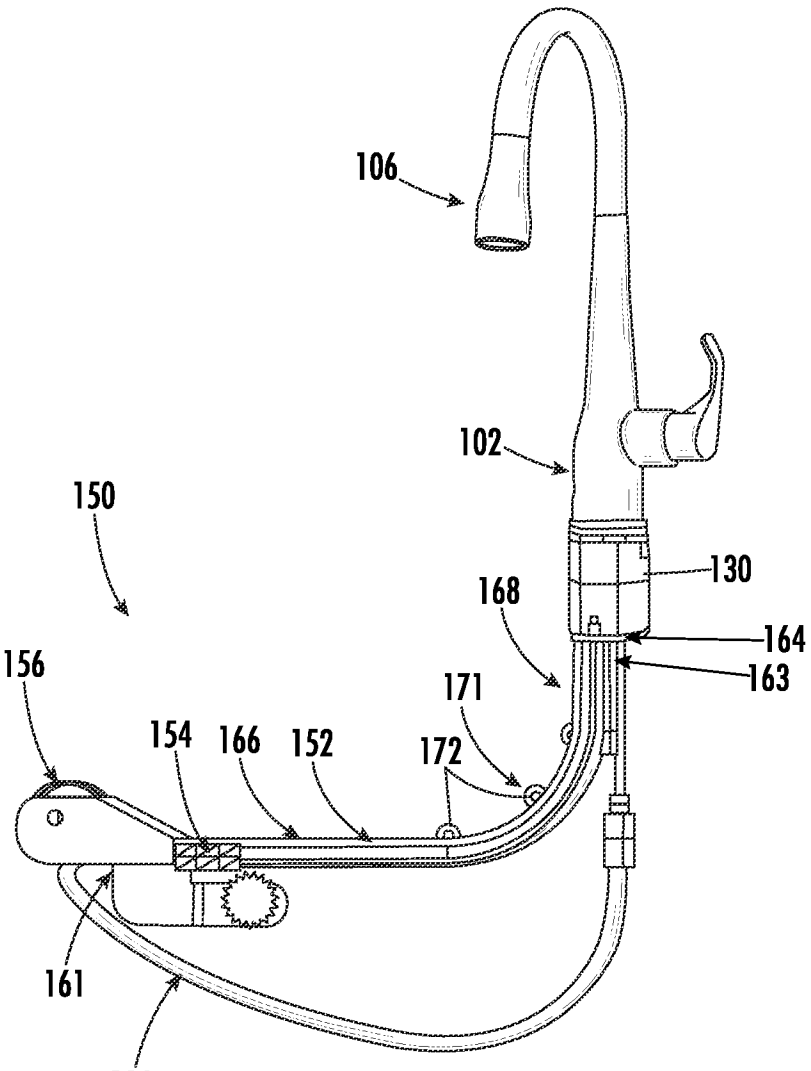
FIG. 4 is a perspective view of the faucet of FIG. 1 operably coupled with a spray head retraction assembly, according to an example embodiment.

Referring now to FIG. 4, a spray head retraction assembly 150 is shown according to an exemplary embodiment. The retraction assembly 150 includes a rail 152 (e.g., guide rail, elongate member, etc.), a bracket 154 movably coupled to rail 152, and a biasing member 156 operably coupled to the bracket 154. The bracket 154 is also coupled to the hose 136 such that movement of the hose 136 translates to movement of the bracket 154, and vice versa. When a user pulls on the spray head 106 to transition the spray head 106 out of the retracted position, the hose 136 is pulled through the spout 104 and the bracket 154 moves along the rail 152 toward the base 102. When the user releases the spray head 106, the biasing member 156 applies a force to the bracket 154 in a direction away from the base 102 such that the bracket 154 moves away from the base 102 along the rail 152. The hose 136 is then retracted though the spout 104 and the spray head 106 transitions toward the spout 104.

The rail 152 includes a first rail end 161 and a second rail end 163 positioned opposite to the first rail end 161. The bracket 154 is movably coupled to the rail 152 such that the bracket 154 may move between the first rail end 161 and the second rail end 163.

The rail 152 further defines a profile (e.g., path) between the first rail end 161 and the second rail end 163. The rail 152 may define most any continuous path between first rail end 161 and the second rail end 163. As shown in FIG. 4, the rail 152 includes a first rail portion 166 extending away from the first rail end 161, a second rail portion 168 extending away from the second rail end 163, and a bend portion 171 (e.g., third portion) positioned between and contiguous with both the first rail portion 166 and the second rail portion 168. As shown, the bend portion 171 facilitates an approximately 90-degree bend between the first rail portion 166 and the second rail portion 168. In some embodiments, the rail 152 extends linearly away from the shank 130 such that the rail 152 does not include the bend portion 171. In some embodiments, the bend portion 171 facilitates a 180-degree angle between the first rail portion 166 and the second rail portion 168 such that the rail 152 defines a substantially U-shaped profile. The rail 152 may define most any profile between the first rail end 161 and the second rail end 163 such that the hose 136 does not get tangled with or caught in objects positioned below the sink, such as bottles, drainage plumbing, and the like. The rail 152 may be adjusted depending on a needed profile for the installation. In some embodiments, a linear rail 152 is needed. In some embodiments, the rail 152 having the bend portion 171 is needed. In some embodiments, multiple bend portions 171 may be required, all bent at different angles and different radius of bending.

Positioned along an inner curve (e.g., intrados) of the bend portion 171 is a plurality of rollers 172 configured to engage the hose 136 and the biasing member 156 as the faucet 100 transitions between the extended position and the retracted position. Friction between the rail 152 and the hose 136 may cause the hose 136 to wear down and tear. The added friction may also increase the force required to transition the faucet 100 between the retracted positon and the extended position. The rollers 172 engage the hose 136 and guide the hose 136 along the extrados of the bend portion 171 to ease the transition of the hose between the first rail portion 166 and the second rail portion 168.

A mounting bracket 164 is coupled to the rail 152 at the second rail end 163 and is configured for coupling with at least one of the shank 130, the base 102, and the surface 170. The mounting bracket 164 may be coupled to the faucet 100 using adhesives, threaded couplings, fasteners, latches, and the like. In some embodiments, the rail 152 is coupled to a surface under the faucet 100, such as a wall or cabinet, such that the rail 152 is not directly coupled to the faucet 100. The mounting bracket 164 also behaves as a stop to prevent the bracket 154 from sliding off of the rail 152 proximate to the second rail end 163.

Figure 5:
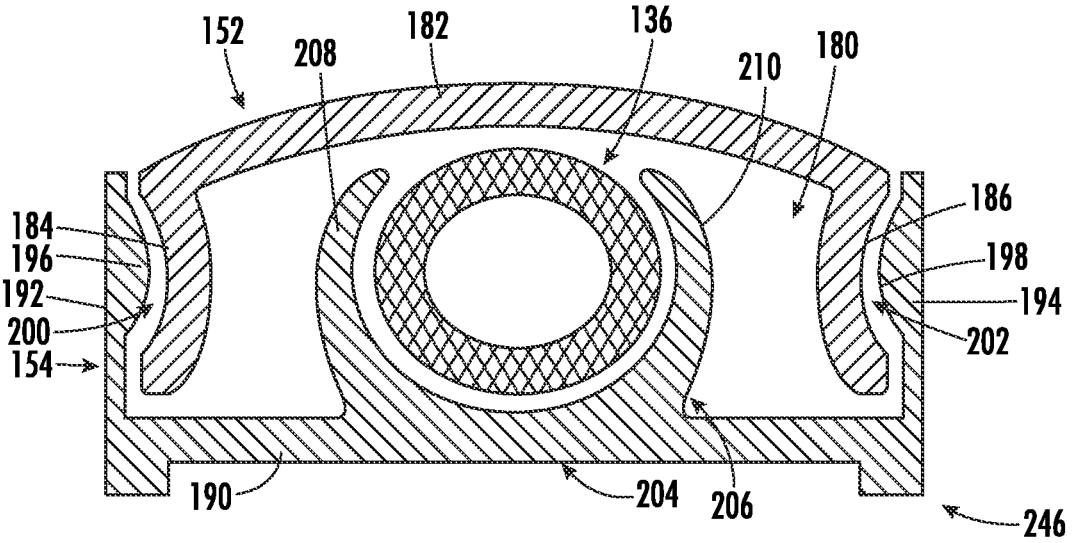
FIG. 5, is a cross-sectional view of the spray head retraction assembly of FIG. 4 about the line AA, according to an example embodiment.

Referring now to FIG. 5, a cross-sectional view of the rail 152 and the bracket 154 is shown along the line AA of FIG. 4. The rail 152 defines a channel 180 that extends between the first rail end 161 and the second rail end 163 and is configured to receive the hose 136. The channel 180 is defined by a base wall 182 (e.g., first wall) and a pair of sidewalls 184, 186 (e.g., a second wall and a third wall). The base wall 182 and the sidewalls 184, 186 cooperate to define a substantially U-shaped and/or C-shaped cross-sectional shape.

The bracket 154 includes a substantially planar bracket body 190 having a pair of bracket legs 192, 194 extending substantially orthogonally from the bracket body 190. The pair of bracket legs 192, 194 are configured to engage the sidewalls 184, 186 of the rail 152 such that the bracket 154 is slidable along the rail 152. Extending inward from each of the legs 192, 194 is a projection 196, 198 that engages a pair of grooves 200, 202 that extend toward the channel 180 and along the length of the rail 152.

Extending from a central portion 204 of the bracket body 190 is a clamp 206 configured for coupling with the hose 136. The clamp 206 includes a pair of fingers 208, 210 defining crescent shapes that extend away from the bracket body 190 in a direction similar to the legs 192, 194. In some embodiments, the clamp 206 is structured to be clamped, unclamped, and reclamped such that the hose 136 is adjustable relative to the bracket 154. Specifically, the bracket 154 is adjustable along the length of the hose 136 such that the tension on the hose 136 is adjustable to ensure that the spray head 106 is in the retracted position when the retraction assembly 150 is in the retracted position (e.g., the bracket 154 is proximate to the first rail end 161).

Figure 6:
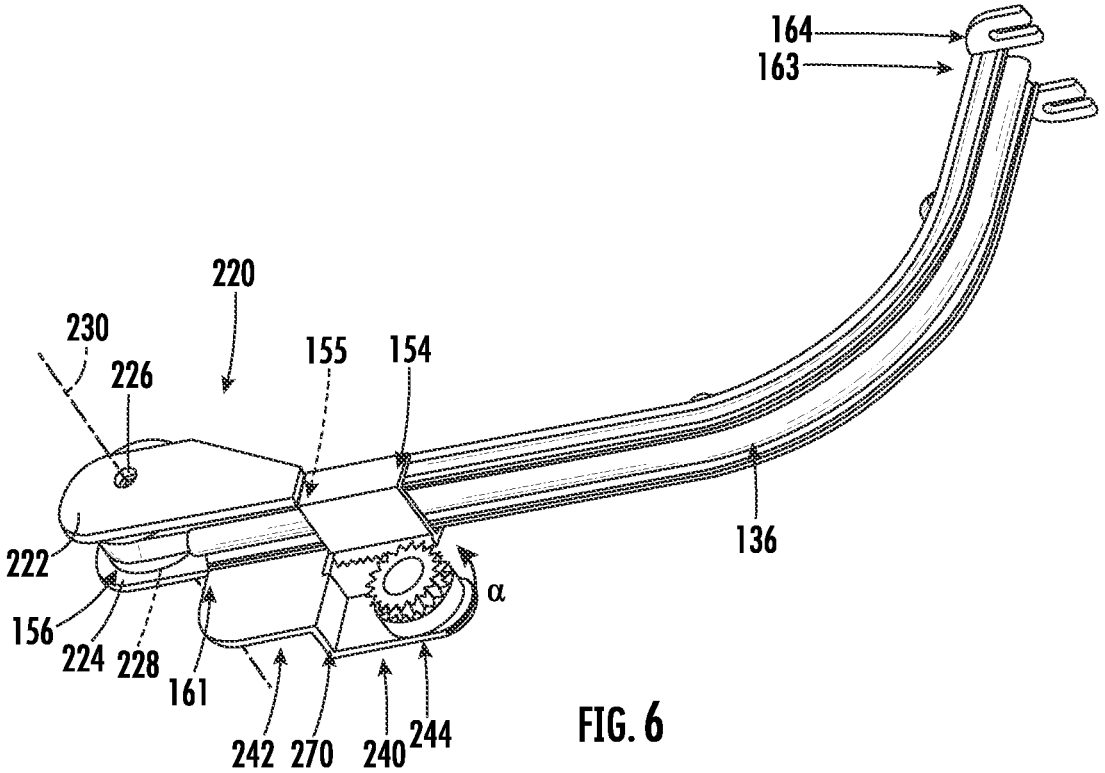
FIG. 6 is a detailed perspective view of the spray head retraction assembly of FIG. 4, according to an example embodiment.

Referring to FIG. 6, a fixture 220 (e.g., flange, chassis, etc.) is coupled to the rail 152 at the first rail end 161. The fixture 220 is configured to support the biasing member 156 while the hose 136 is transitioned between the retracted position and the extended position. The fixture 220 includes a first member 222 and a second member 224 that extend away from the first rail end 161 in a direction opposite to the second rail end 163. The first member 222 and the second member 224 have a lobe-like profile and cooperate to support and protect the biasing member 156. The biasing member 156 may be sensitive and susceptible to damage from blunt force, debris, and misalignment. The first member 222 and the second member 224 provide protection and guidance to the biasing member 156. Extending through the first member 222 is a first aperture 226 and extending through the second member 224 is a second aperture 228 (hidden in FIG. 6). The first aperture 226 and the second aperture 228 cooperate to define a fixture axis 230. The biasing member 156 may be coupled to the fixture 220 about the fixture axis 230. In some embodiments, the biasing member 156 is a constant force spring (e.g., clock spring) and is configured to apply a substantially constant force to the hose 136 when the hose 136 is in all of the retracted position, the fully extended position, and any one of plurality of partially extended positions (e.g., between the retracted position and the fully extended position). In some embodiments, a free end 155 of the constant force spring is coupled to the bracket 154. In some embodiments, the biasing member 156 is similar to a badge reel, where a constant force spring is housed entirely within a housing of the biasing member 156, and a sting (e.g., thread, line, etc.) extends from the biasing member 156 and is coupled to the bracket 154. In some embodiments, the biasing member 156 is a torsion spring, an extension spring, a compression spring, or the like. The biasing member 156 is coupled to the bracket 154 and is configured to bias the bracket 154 toward the first rail end 161.

The retraction assembly 150 further includes a soft-close assembly 240. The soft-close assembly 240 is configured to prevent the spray head 106 from retracting into the spout 104 too quickly and striking the spout 104 with great force. For example, the biasing member 156 may provide so much force that the bracket 154 moves quickly toward the first rail end 161, causing the spray head 106 to strike and break either the spray head 106 or the spout 104. The soft-close assembly 240 includes a damper flange 242 coupled to the rail 152, a damper 244 coupled to the damper flange 242, and an engagement body 246 (FIG. 5) coupled to the bracket 154 and extending toward the damper 244 when the retraction assembly 150 is in the first position. While the damper flange 242 is shown coupled to the rail 152 proximate to the first rail end 161, it should be understood that the damper flange 242 may extend from other positions along the rail 152. In some embodiments, the damper flange 242 is optional and the damper 244 is coupled directly to a surface proximate to the rail 152, such as a wall or cabinet wall. The damper flange 242 includes a flange offset 270 structured to position the damper 244 away from the path of the hose 136 when the hose 136 transitions between the retracted position and the extended position.

The damper 244 is a rotational damper configured to provide resistance in a rotational direction. In some embodiments, the damper 244 is a unidirectional rotational damper configured to provide resistance in a single rotational direction while rotating substantially freely in the opposite rotational direction. As shown in FIG. 6, the damper 244 is a unidirectional damper configured to resist, but not prevent, rotational movement in the rotational direction marked by arrow $\alpha$. Accordingly, the damper 244 does not resist the motion of the bracket 154 as the hose 136 is transitioned out of the retracted position, but the damper 244 does resist the motion of the bracket 154 as the hose 136 transitions into the retracted position. In some embodiments, the biasing member 156 and the damper 244 cooperate to provide a "soft close" feature and are calibrated relative to one another to achieve the desired movement proximate to the first rail end 161.

The engagement body 246 (e.g., rack, planar gear teeth, etc.) extends orthogonally away from the bracket body 190 in a direction opposite to the pair of bracket legs 192, 194 and opposite to the clamp 206. The engagement body 246 is configured to engage with the damper 244 when the faucet 100 is in the retracted position. The damper 244 and the engagement body 246 may be a rack and pinion assembly.

Referring now to FIG. 7, the faucet 100 is shown coupled to the surface 170 and the retraction assembly 150 is shown positioned below the surface 170. In some embodiments, drain plumbing 252 may be positioned below the faucet 100 and may interfere with the hose 136 as the faucet is transitioned between the retracted position and the extended position. The rail 152 allows the hose 136 to be directed away from the drain plumbing 252 to avoid snagging and binding that may resist or prevent the retraction and extension of the hose 136.

Figure 8:
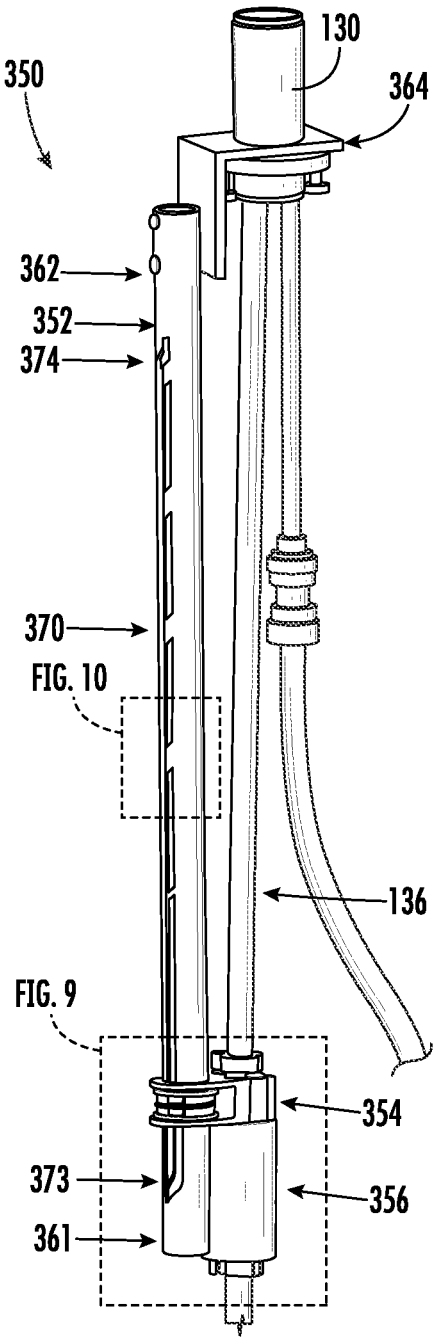
FIG. 8 is a perspective view of a spray head retraction assembly, according to an example embodiment, operably coupled with the faucet of FIG. 1.

Referring now to FIG. 8, a spray head retraction assembly 350 is shown, according to an exemplary embodiment. The retraction assembly 350 is similar to the retraction assembly 150. A difference between the retraction assembly 350 and the retraction assembly 150 is that the retraction assembly 350 includes a weight coupled to the hose 136 that applies a gravitational force to the hose 136 to transition the hose 136 toward the retracted position. The retraction assembly 350 includes a rail 352 (e.g., guide rail), a bracket 354 movably coupled to rail 352, and a weight 356 (e.g., mass) coupled to the bracket 354. The bracket 354 is also coupled to the hose 136 such that movement of the hose 136 translates to movement of the bracket 354, and vice versa. When a user pulls on the spray head 106, the hose 136 is pulled through the spout 104 and the bracket 354 moves along the rail 352 toward the base 102. When the user releases the spray head 106, the weight 356 applies a gravitational force to the bracket 354 in a direction away from the base 102 such that the bracket 354 moves away from the base 102 along the rail 352. The spray head 106 is then retracted into the spout 104.

The rail 352 includes a first rail end 361 and a second rail end 362 positioned opposite to the first rail end 361. The bracket 354 is movably coupled to the rail 352 such that the bracket 354 may move between the first rail end 361 and the second rail end 362. A mounting bracket 364 is coupled to the rail 352 at the second rail end 362 and is configured for coupling with at least one of the shank 130, the base 102, and the surface 170. The mounting bracket 364 may be coupled to the faucet 100 using adhesives, threaded couplings, fasteners, latches, and the like. In some embodiments, the rail 352 is coupled to a surface under the faucet 100, such as a wall or cabinet, such that the rail 352 is not directly coupled to the faucet 100.

The rail 352 further defines a profile (e.g., path) between the first rail end 361 and the second rail end 362. As shown, the rail 352 is substantially linear and does not include any bends. In some embodiments, the rail 352 may define most any continuous path between first rail end 361 and the second rail end 362. For example, the rail 352 may be bent to avoid drain plumbing, containers, and shelves positioned below the faucet 100.

Extending into the rail 352 is a channel 360. The channel 360 extends lengthwise along the rail 352 and includes a first channel end 373 positioned proximate to the first rail end 361 and the channel 360 includes a second channel end 374 positioned proximate to the second rail end 362. The channel 360 is depressed within the rail 352 and is configured to guide the movement of the bracket 354.

Figure 9:
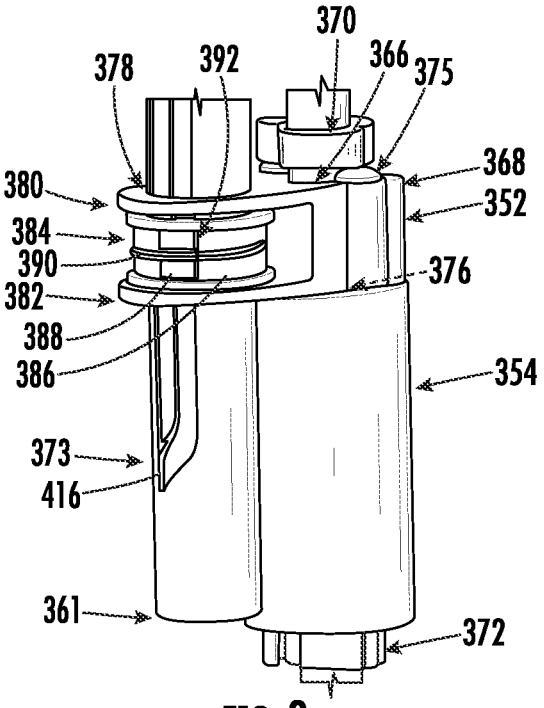
FIG. 9 is a detailed view of the spray head retraction assembly of FIG. 8 through view window BB, according to an example embodiment.

Referring now to FIG. 9, a detailed portion of the retraction assembly 350 from view window BB of FIG. 8 is shown. The bracket 354 defines a pair of apertures extending through the bracket 354 and having central axes that extend substantially parallel to one another. A first bracket aperture 366 extends through a main bracket body 368 of the bracket 354 and is configured to receive the hose 136 such that the hose 136 may slide freely through the first bracket aperture 366. In some embodiments, the hose 136 is selectively coupled to the main bracket body 368, such as with a set screw, latches, clamp, and the like. In some embodiments, a first hose coupling 370 and a second hose coupling 372 are coupled to the hose 136, the first hose coupling 370 coupled to the hose 136 downstream from the main bracket body 368, and the second hose coupling 372 coupled to the hose 136 upstream from the main bracket body 368. The first hose coupling 370 and the second hose coupling 372 are configured to fix the position of the bracket 354 relative to the hose 136 such that movement of the hose 136 translates to movement of the bracket 354.

Coupled to the main bracket body 368 and positioned about the hose 136 is the weight 356. The weight 356 is coupled to the main bracket body 368 with fasteners 375 that extend through the main bracket body 368 and thread into the weight 356. The weight 356 may be coupled to the hose 136 between the first hose coupling 370 and the second hose coupling 372 to prevent translational movement of the weight 356 along the hose 136. The weight 356 may be formed of metal, stone, sand, and the like such that the mass of the weight 356 may influence the movement of the hose 136 and the spray head 106. The weight 356 may define an aperture 376 that extends along the length of the weight 356 and is substantially concentric with the first bracket aperture 366 such that the hose 136 may slide freely through both the main bracket body 368 and the weight 356. In some embodiments, neither of the bracket 354 and the weight 356 are directly coupled to the hose 136. Instead, the first hose coupling 370 and the second hose coupling 372 are coupled to the hose 136 and prevent the bracket 354 and the weight 356 from moving translationally along the hose 136.

A second bracket aperture 378 extends through a peripheral portion of the bracket 354, defined by a first bracket flange 380 and a second bracket flange 382. The second bracket aperture 378 extends substantially parallel to the first bracket aperture 366. The second bracket aperture 378 is configured to receive the rail 352 such that the rail 352 is slidable through both the first bracket flange 380 and the second bracket flange 382. Positioned between the first bracket flange 380 and the second bracket flange 382 is a detent assembly 384. The detent assembly 384 is configured to facilitate movement of the bracket 354 along the rail 352. The detent assembly 384 includes a retainer ring 386, a detent 388 positioned within the retainer ring 386, and a biasing member 390 positioned about the retainer ring 386 and engaging the detent 388. The retainer ring 386 is positioned about the rail 352 and is positioned between the first bracket flange 380 and the second bracket flange 382 such that movement of the bracket 354 results in movement of the retainer ring 386. Extending through the retainer ring 386 is a detent aperture 392 configured to receive the detent 388. In some embodiments, the detent aperture 392 is substantially square shaped such that rotation of the detent 388 within the detent aperture 392 is prevented. In some embodiments, the detent aperture 392 is a non-circular aperture. In some embodiments, the detent aperture 392 is circular.

The detent 388 extends into the channel 360 to facilitate movement of the bracket 354 along the rail 352. The biasing member 390 applies a force to the detent 388 in the direction of the rail 352 to maintain the detent 388 within the channel 360. The biasing member 390 may be a rubber band, an O-ring, a spring, and the like.

Figure 10:
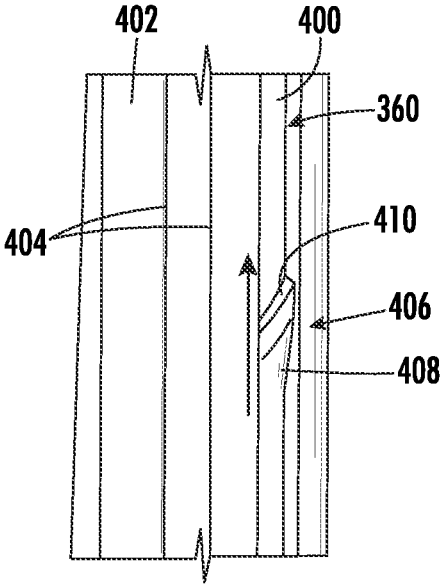
FIG. 10 is a detailed view of the spray head retraction assembly of FIG. 8 through view window CC, according to an example embodiment.
Figure 11:
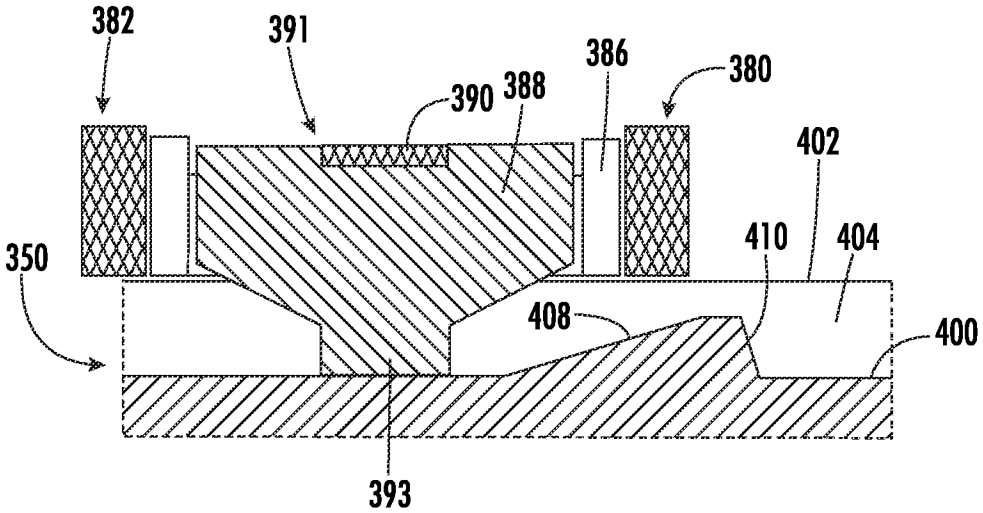
FIG. 11 is a cross-sectional view of a portion of the spray head retraction assembly of FIG. 8 about line DD, according to an example embodiment.

Referring now to FIG. 10, a detailed portion of the retraction assembly 350 from view window CC of FIG. 8 is shown. Specifically, a detailed view of the channel 360 is shown. The channel 360 is defined by a channel surface 400 positioned radially inward from an external surface 402 of the rail 352, and the channel 360 is defined by a pair of sidewalls 404 that extend perpendicularly away from the channel surface 400 and extend along the length of the channel 360 between the first channel end 373 and the second channel end 374. The pair of sidewalls 404 are contiguous with the channel surface 400 and the external surface 402. The detent 388 partially extends into the channel 360 between the pair of sidewalls 404 and engages with the channel surface 400 (FIG. 11). Referring to FIG. 11, a cross-section of the detent assembly 384 is shown along line DD of FIG. 8. In some embodiments, the detent 388 tappers as the detent 388 extends toward the channel surface 400. In some embodiments, the portion of the detent 388 that engages the biasing member 390, shown as a detent groove 391, has a wider cross-section that the portion of the detent 388 positioned within the channel 360, shown as a detent projection 393.

Referring again to FIG. 10, as the bracket 354 moves along the rail 352 between the first rail end 361 and the second rail end 362, the retainer ring 386 slides along the rail 352 and the detent 388 (e.g., the detent projection 393) slides within the channel 360. Positioned within the channel 360 and extending radially away from the channel surface 400 is a channel projection 406 configured to engage the detent 388 and allow movement of the detent 388 through the channel 360 in a single direction. The channel projection 406 includes a ramp 408 and a stop 410. As the detent 388 travels along the channel 360 in the direction of the arrow β, the detent 388 engages the ramp 408 and is biased radially away from the channel surface 400. The detent 388 is simultaneously biased by the biasing member 390 that applies a force to the detent 388 in the direction of the channel surface 400. As the detent 388 passes over the channel projection 406, the biasing member 390 biases the detent 388 into the channel surface 400. For example, as a user pulls on the spray head 106, the detent 388 may pass over the channel projection 406 and make a clicking noise (e.g., snapping noise, etc.) when the detent 388 passes over the ramp 408 and is quickly biased into the channel surface 400. If the user then releases the spray head 106, the mass of the weight 356 applies a gravitational force on the hose 136 in a direction along the channel 360 and opposite to the arrow β. The stop 410 is structured to engage the detent 388 to prevent motion of the detent 388, and thus the bracket 354, along the channel 360 in the direction opposite to the arrow β. The stop 410 extends substantially orthogonally away from the channel surface 400 and is contiguous with the ramp 408. The stop 410 is configured to engage the detent 388 without biasing the detent away from the channel surface 400. Thus, the bracket 354 may be positioned between the first rail end 361 and the second rail end 362 without a user applying a force to the spray head 106. This allows the spray head 106 to be maintained in a partially extended position without the user having to apply a force to the spray head 106 to counter the gravitational force applied on the hose 136 by the weight 356.

Figure 12:
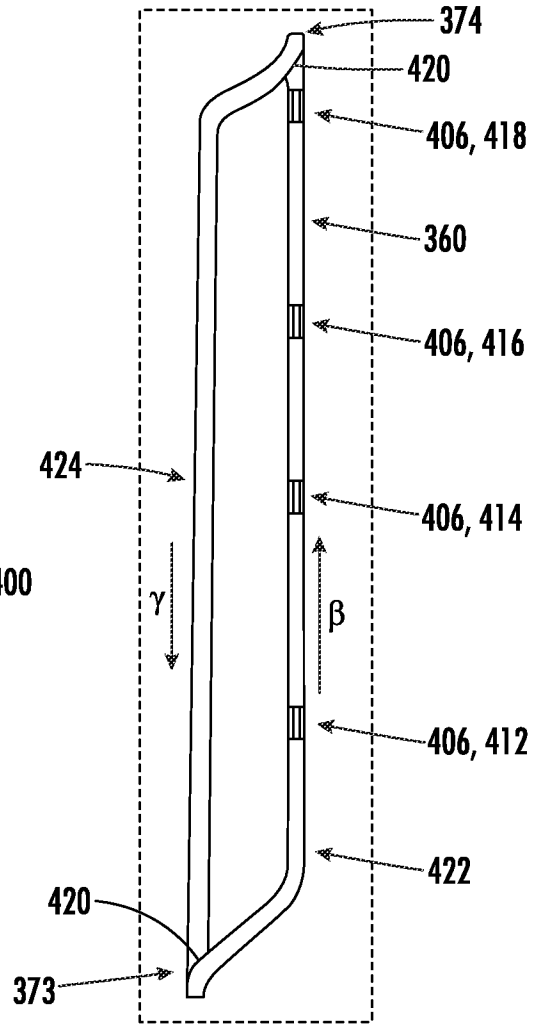
FIG. 12 is a side view of a portion of the spray head retraction assembly of FIG. 8, according to an example embodiment.

Referring now to FIG. 12, a side view of the rail 352 is shown. The channel 360 may include a plurality of channel projections 406 that extend from the channel surface 400 and are configure to maintain the hose 136 in a partially extended position. The channel 360 includes a first channel projection 412, a second channel projection 414, a third channel projection 416, and a fourth channel projection 418 positioned within the channel 360. As the bracket 354 moves along the channel 360 in the direction of the arrow β, the detent 388 may make a clicking noise as the detent 388 passes over each of the channel projections 412, 414, 416, 418 and is biased into the channel surface 400 by the biasing member 390. In this way, the user of the retraction assembly 350 may hear or feel that the bracket 354 passed by a channel projection 406, and may release the spray head 106 at a desired extended position.

The channel 360 defines a one-way (e.g., unidirectional) path that is traversed by the bracket 354 in a single direction. The channel 360 defines two portions, shown as a first channel portion 422 and a second channel portion 424. The first channel portion 422 of the channel 360 is configured to allow movement of the bracket 354 along the rail 352 in the direction of the arrow β while preventing movement of the bracket 354 in the direction opposite to the arrow β through use of the channel projections 406.

At the second channel end 374, the first channel portion 422 and the second channel portion 424 are joined together. The second channel end 374 is configured to receive the detent 388 and prevent the detent 388 from traversing further in the direction of the arrow β. In other words, when the detent 388 is positioned at the second channel end 374, the hose 136 and the spray head 106 are in a fully extended position. Separating the first channel portion 422 from the second channel portion 424 at the second channel end 374 is a channel step 420. The channel step 420 is similar to the stop 410 in that the channel step 420 extends orthogonally from the channel surface 400 and prevents the detent 388 from entering the first channel portion 422. The channel step 420 extends radially toward the central axis of the rail 352 from the channel surface 400 of the first channel portion 422 to the channel surface 400 of the second channel portion 424. After the detent 388 passes over the channel step 420, the detent 388 is positioned within the second channel portion 424 and is configured to travel toward the first channel end 373 within the second channel portion 424 in the direction of the arrow γ (gamma). At the first channel end 373, the first channel portion 422 and the second channel portion 424 are joined. When the detent 388 is positioned at the first channel end 373, the hose 136 and the spray head 106 are in the retracted position. Separating the first channel portion 422 from the second channel portion 424 proximate to the first channel end 373 is another channel step 420, shown in detail in FIG. 9. The channel step 420 is similar to the stop 410 in that the channel step 420 extends orthogonally from the channel surface 400 and prevents the detent 388 from entering the second channel portion 424. The channel step 420 extends radially toward the central axis of the rail 352 from the channel surface 400 of the second channel portion 424 to the channel surface 400 of the first channel portion 422. After the detent 388 passes over the channel step 420 proximate to the first channel end 373, the detent 388 is positioned within the first channel portion 422 and is configured to travel toward the second channel end 374 within the first channel portion 422 in the direction of the arrow β. In general, the channel 360 is a unidirectional closed loop that facilitates the movement of the detent 388, and thus the movement of the bracket 354, between the extended position and the retracted position.

The channel projections 412, 414, 416, 418 are optional and are not required to maintain the unidirectional closed-loop of the channel. In some embodiments, the channel 360 includes more or fewer channel projections 406 which are configured to maintain the hose 136, and thus the faucet 100, in a plurality of partially extended positions.

Figure 13:
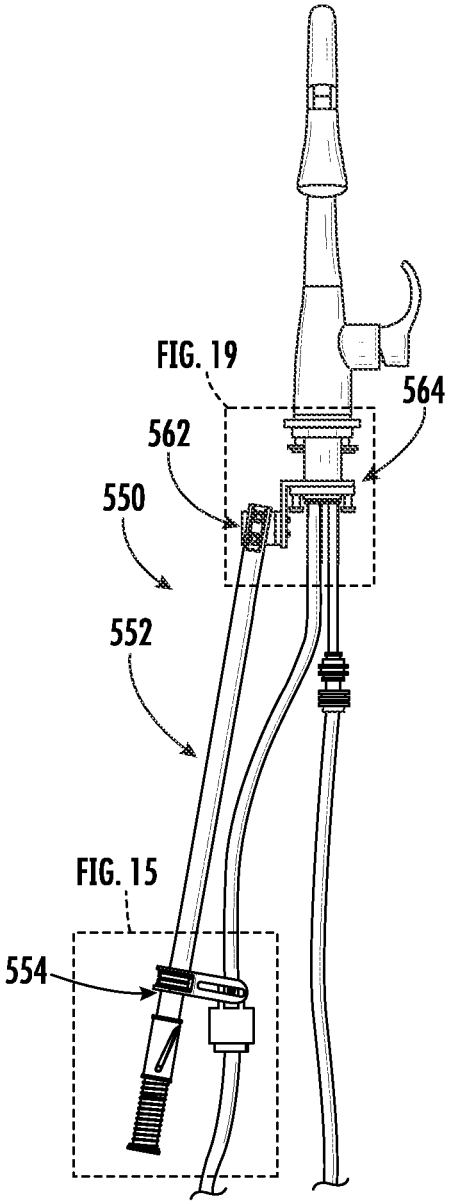
FIG. 13 is a perspective view of a spray head retraction assembly, according to an example embodiment, operably coupled with the faucet of FIG. 1.

Referring now to FIG. 13, a spray head retraction assembly 550 is shown, according to an example embodiment. The retraction assembly 550 is similar to the retraction assembly 350. Accordingly, like parts are labeled with like numbering. The retraction assembly 550 includes a rail 352, a bracket 354, and a weight 356. The rail 352 includes a first rail end 361 and a second rail end 362 opposite to the first rail end. The bracket 554 is movably coupled to the rail 552 such that the bracket 554 may move between the first rail end 361 and the second rail end 362. A mounting bracket 564 (FIGS. 19 and 20) is coupled to the rail 552 at the second rail end 562 and is configured for coupling with at least one of the shank 130, the base 102, and the surface 170. The mounting bracket 364 may be coupled to the faucet 100 using adhesives, threaded couplings, fasteners, latches, and the like. In some embodiments, the rail 552 is coupled to a surface under the faucet, such as a wall or cabinet, such that the rail 552 is not directly coupled to the faucet 100.

Extending into the rail 552 is a channel 660. The channel 660 extends lengthwise along the rail 552 and includes a first channel end 662 positioned proximate to the first rail end 560 and the channel 660 includes a second channel end 664 positioned proximate to the second rail end 562. The channel 660 is depressed within the rail 552 and is configured to guide the movement of the bracket 554. The bracket 554 is slidably coupled to the rail 552 and pivotally coupled to the weight 556.

The bracket 554 includes a first bracket flange 555 and a second bracket flange 557 having a first bracket aperture 559 extending through both the first bracket flange 555 and the second bracket flange 557 and configured to receive the rail 552. The first bracket aperture 559 is configured to receive the rail 552 such that the rail 552 is slidable through both the first bracket flange 555 and the second bracket flange 557. Positioned between the first bracket flange 555 and the second bracket flange 557 is a detent assembly 584. The detent assembly 584 is configured to facilitate movement of the bracket 554 along the rail 552. The detent assembly 584 includes a retainer ring 586, a detent 588 positioned within the retainer ring 586, and a biasing member 590 positioned about the retainer ring 586 and engaging the detent 588. The detent assembly 584 is substantially similar to the detent assembly 384. The retainer ring 586 is positioned about the rail 552 and is positioned between the first bracket flange 555 and the second bracket flange 557 such that movement of the bracket 554 results in movement of the retainer ring 586. Extending through the retainer ring 586 is a detent aperture 592 configured to receive the detent 588. In some embodiments, the detent aperture 592 is substantially square shaped such that rotation of the detent 588 within the detent aperture 592 is prevented. In some embodiments, the detent aperture 592 is a non-circular aperture. In some embodiments, the detent aperture 592 is circular.

The detent 388 extends into the channel 660 to facilitate movement of the bracket 554 along the rail 552. The biasing member 590 applies a force to the detent 588 in the direction of the rail 552 to maintain the detent 588 within the channel 660. The biasing member 590 may be a rubber band, an O-ring, a spring, and the like.

A difference between the bracket 554 and the bracket 354 is that the bracket 554 includes a pair of slots that are configured to pivotally couple the weight 556 to the bracket 554. The bracket 554 further includes a third flange 565 and a fourth flange 567 extending orthogonally away from a substantially planar bracket base 568. The third flange 565 and the fourth flange 567 extend substantially parallel to one another and define substantially parallel slots, shown as a first slot 570 extending through the third flange 565 and second slot 573 extending through the fourth flange 567. Extending through all of the first slot 570, the second slot 573, and the weight 556 is a weight pin 575 that engages the third flange 565 and the fourth flange 567 and is pivotally coupled with the bracket 554. Proximate to the weight pin 575, the weight 556 defines a flat spot 576 on either side of the weight 556, the flat spot 576 configured to interface with the third flange 565 and configured to prevent the weight 556 from rotating relative to the bracket 554 about an axis concentric with the hose 136. The flat spot 576 abuts the third flange 565 such that the weight 556 is prevented from rotating in a direction where the weight pin 575 would be removed from either of the first slot 570 or the second slot 573.

The weight pin 575 is configured to facilitate rotation of the weight 556 relative to the bracket 554 about a central axis of the weight pin 575. This prevents potential binding between the rail 552, the bracket 554, the weight 556, and the hose 136. The weight 556 may include an aperture that extends through the weight 556 and is configured to receive the hose 136. In some embodiments, the weight 556 is coupled to the hose 136, such as with a set screw, adhesives, clamps, latches, and the like. In some embodiments, a hose clamp 578 is coupled to the hose 136 upstream from the weight 556 such that the hose clamp 578 applies a force to the weight 556 when the hose 136 is moving to an extended position. In some embodiments, the weight 556 applies a force to the hose clamp 578, and thus the hose 136, when the weight is facilitating movement of the hose to a retracted position.

Figure 14:
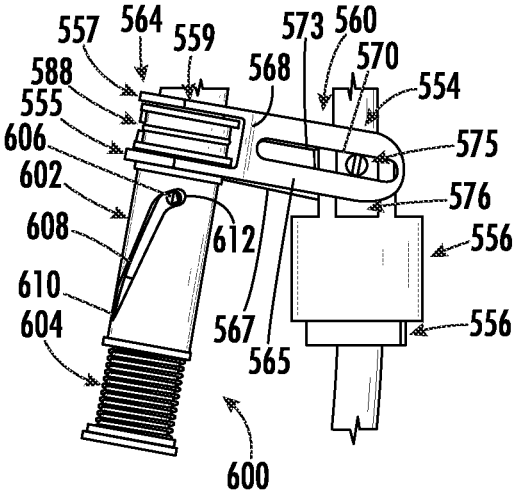
FIG. 14 is a detailed view of the spray head retraction assembly of FIG. 13 in a retracted position, according to an example embodiment.
Figure 15:
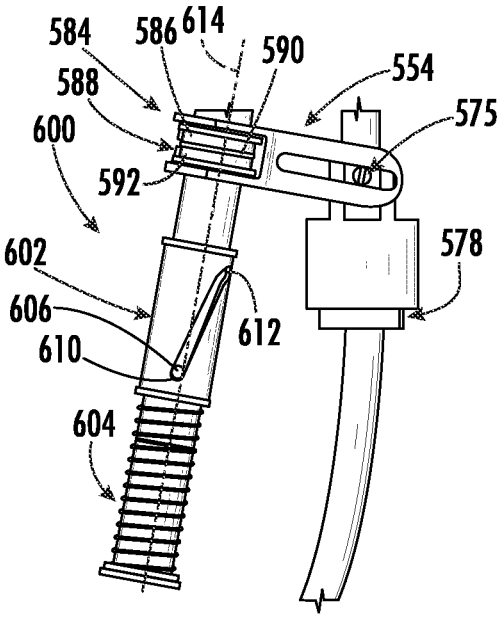
FIG. 15 is a detailed view of the spray head retraction assembly of FIG. 13 in an extended position, according to an example embodiment.

Referring now to FIGS. 14 and 15, a detailed portion of the retraction assembly 550 of FIG. 13 is shown. The retraction assembly 550 includes a damping system 600 coupled to the rail 552 proximate to the first rail end 560. The damping system 600 is configured to reduce the speed at which the spray head 106 and the hose 136 retract just before the spray head 106 and the hose 136 reach the retracted position. The damping system 600 includes a sleeve 602, a biasing member 604, and a pin 606. The sleeve 602 is positioned around the rail 552 proximate to the first rail end 560 and is configured to freely rotate about and slide relative to the rail 552. Extending through the sleeve 602 is an elongate slot 608 that receives the pin 606. The elongate slot 608 includes a first slot end 610 and a second slot end 612. The slot 608 extends between the first slot end 610 and the second slot end 612 at a variety of angles relative to a central axis 614 of the sleeve 602. As shown in FIG. 15, the slot 608 extends along the sleeve 602 at an angle θ (theta) relative to the central axis 614. Proximate to the second slot end 612, the angle of the slot 608 is greater than angle θ. The greater angle of the slot 608 proximate to the second slot end 612 results in a greater deceleration of the hose 136 as the hose 136 retracts toward the retracted position.

When the hose 136 is in the fully extended position shown in FIG. 15, the bracket 554 and the weight 556 are position proximate to the second rail end 562. When a user releases the spray head 106, the weight 556 applies a gravitational force to the hose 136 and to the bracket 554, biasing the bracket 554 toward the first rail end 560. As shown in FIG. 15, the damping system 600 is in an extended positon and the sleeve 602 is biased away from the first rail end 560 such that the pin 606 is abutting the first slot end 610. When the bracket 554 engages the sleeve 602, the bracket 554 applies a force to the sleeve 602, causing the sleeve 602 to translate toward the first rail end 560 while the pin 606 traverses through the slot 608. The biasing member 604 applies a force to the sleeve 602 in the opposite direction as the bracket 554 to slow down the descending bracket 554. As the sleeve 602 travels toward the first rail end 560, the pin 606 is nearing the second slot end 612. As the slot 608 changes angles relative to the central axis 614, the friction between the pin 606 and the slot 608 may increase the resistance of the sleeve 602 and further slow the movement of the bracket 554 toward the first rail end 560. This increased resistance provides a "soft-close" feature to the spray head 106 to prevent the spray head 106 from striking the faucet 100 too hard and causing damage to either of the spout 104 and/or the spray head 106. As shown in FIG. 14, the hose 136 is in the retracted position and the pin 606 is abutting the second slot end 612. When the spray head 106 is pulled into an extended position, the biasing member 604 biases the sleeve 602 toward the second rail end 562 until the pin 606 abuts the first slot end 610.

Figure 16:
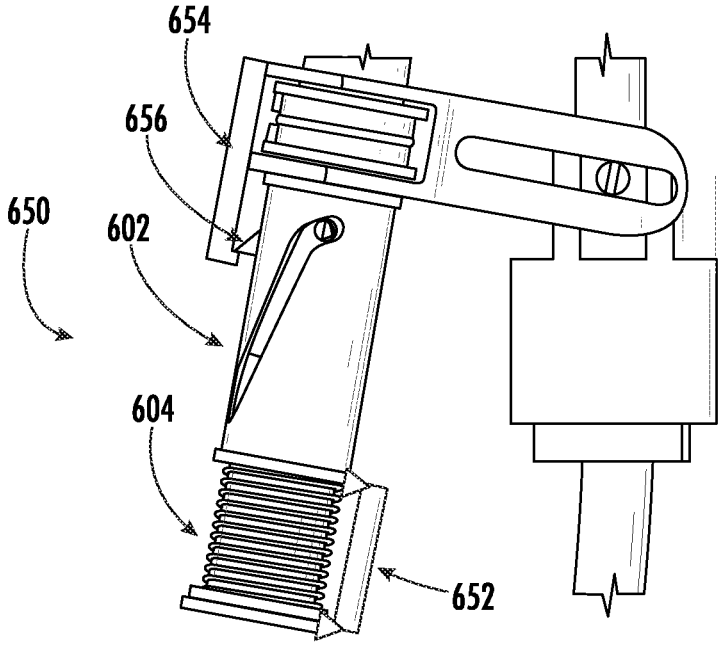
FIG. 16 is a detailed view of the spray head retraction assembly of FIG. 13 having a damper assembly according to an example embodiment.
Figure 17:
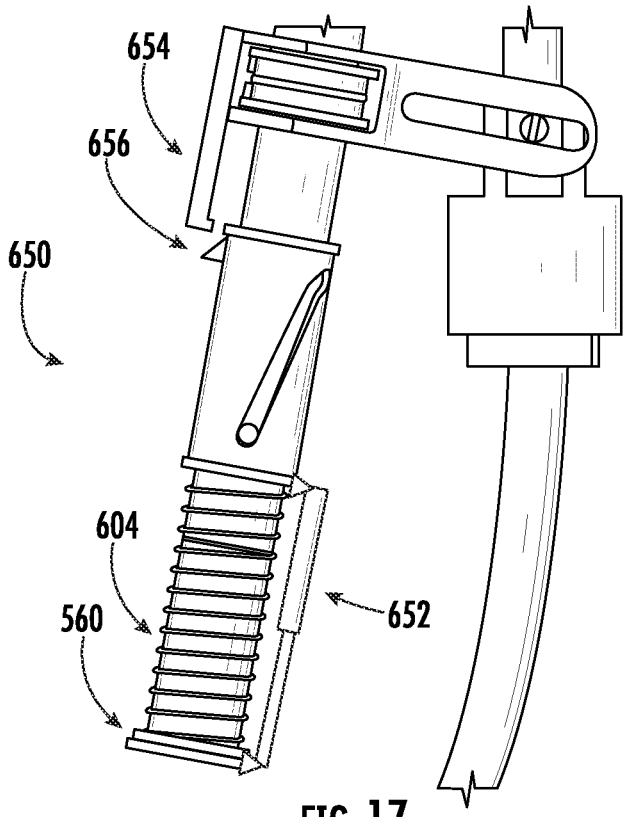
FIG. 17 is a detailed view of the spray head retraction assembly of FIG. 13 having the damper assembly of FIG. 16, according to an example embodiment.

Referring now to FIGS. 16 and 17, a damping system 650 is shown, according to another example embodiment. The damping system 650 is similar to the damping system 600 and can be used in place of the damping system 600 in some embodiments. A difference between the damping system 600 and the damping system 650 is that the damping system 650 includes an extension spring that biases the sleeve 602 toward the first rail end 560 when the bracket 554 is latched to the sleeve 602. The damping system 650 includes the sleeve 602, the biasing member 604, and a damper 652. The damper 652 has an end coupled to the sleeve 602 and an end coupled to the rail 552 proximate to the first rail end 560. The damper 652 is configured to resist, though not prevent, movement of the sleeve 602 toward the first rail end 560.

Extending away from the bracket 554 in a direction substantially toward the sleeve 602 may be a latch flange 654 configured to engage with (e.g., latch to, removably couple with, etc.) a tab 656 extending radially away from the sleeve 602. When the spray head 106 and the hose 136 are transitioned out of the retracted position, the hose 136 biases the bracket 554 toward the second rail end 562. At the same time, the latch flange 654 applies a force to the tab 656 to pull the sleeve 602 toward the second rail end 562. The force applied by the latch flange 654 on the tab 656 elongates (e.g., extends, pre-loads, etc.) both the biasing member 604 and the damper 652. In some embodiments, the biasing member 604 is an extension spring that applies a force to the sleeve 602 in a direction toward the first rail end 560. In some embodiments, the damper 652 is a unidirectional damper that resists compression, but does not resist extension. When the sleeve 602 reaches a limit distance from the first rail end 560, a latching mechanism (not shown) engages with the rail 552 to maintain the sleeve 602 in an extended position as the latch flange 654 disengages with the tab 656 and the bracket 554 translates along the rail 552 toward the second rail end 562.

When the hose 136 transitions out of an extended position and toward the retracted position, the bracket 554 translates toward the sleeve 602. Depending on the mass of the weight 556, the bracket 554 may strike the sleeve 602 with considerable force. When the latch flange 654 re-engages the tab 656, the latching mechanism disengages the rail 552 and allows the sleeve 602 to transition toward the first rail end 560. When the latching mechanism is disengaged, the biasing member 604 applies a force to the sleeve 602, and thus the bracket 554, toward the first rail end 560. The damper 652 likewise resists motion of the bracket 554 and the sleeve 602 as the damper 652 is compressed. The biasing member 604 and the damper 652 cooperate to slowly transition the hose 136 to the retracted position.

Figure 18:
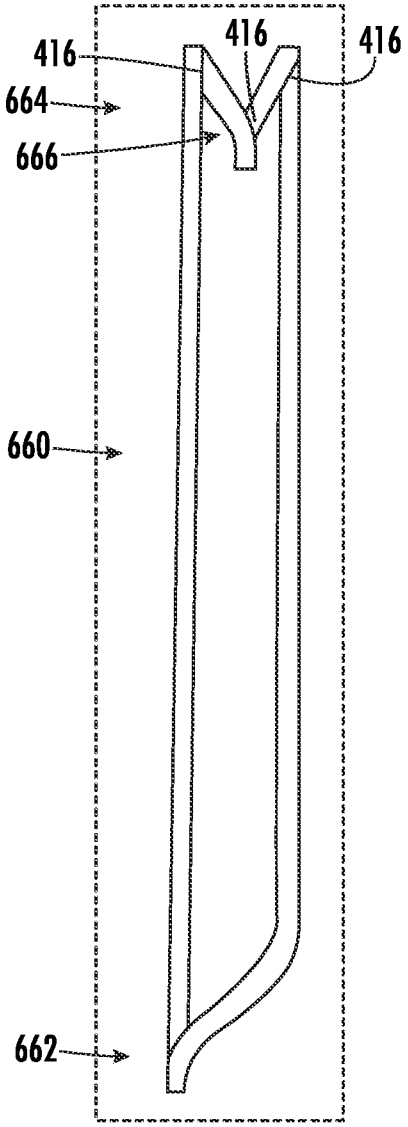
FIG. 18 is a side view of a portion of the spray head retraction assembly of FIG. 13, according to an example embodiment.

Referring now to FIG. 18, a side view of the rail 552 is shown. The channel 660 extends radially into the rail 552 and is configured to receive the detent 588. The channel 660 is similar to the channel 360. Accordingly, like numbering is used to denote like parts. In some embodiments, the rail 352 may include either of the channel 360 or the channel 660. Similarly, the rail 552 may include either of the channel 360 or the channel 660. The channel 660 includes the channel surface 400

The channel 660 defines a one-way (e.g., unidirectional) path that is traversed by the bracket 554 in a single direction. The channel 660 includes a first channel end 662 proximate to the first rail end 560 and a second channel end 664 proximate to the second rail end 562. At the second rail end 562, the channel 660 includes a V-shaped catch 666 configured to maintain the detent 588, and thus the hose 136, in an extended position. The V-shaped catch 666 allows a user to pull the spray head 106 until the spray head 106 stops extending, and then release the spray head 106 to maintain the spray head 106 in an extended position. The channel steps 420 facilitate the transition of the detent 588 to the V-shaped catch 666. Upon a second pull of the spray head 106, the detent 588 exits the V-shaped catch 666 after passing over a channel step 420. When the user then releases the spray head 106, the weight 556 applies a gravitational force to the hose 136 and retracts the hose 136.

Figure 19:
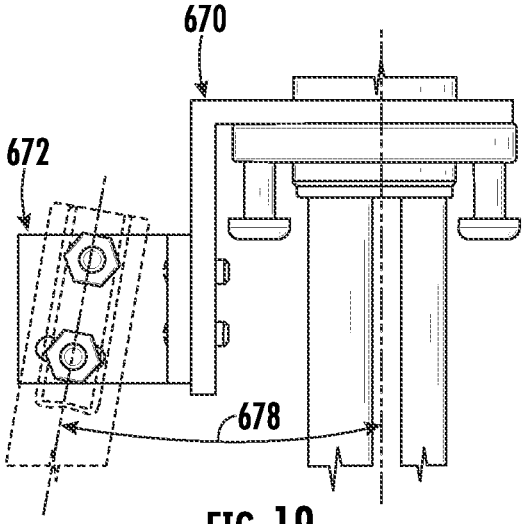
FIG. 19 is a detailed view of a portion of the spray head retraction assembly of FIG. 13, shown through view window GG, according to an example embodiment.
Figure 20:
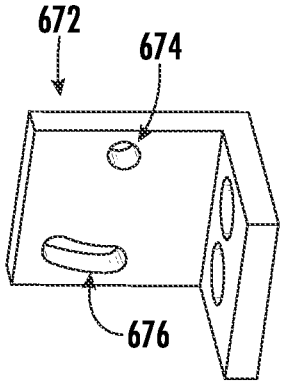
FIG. 20 is a perspective view of a portion of the portion of the spray head retraction assembly of FIG. 19, shown through view window GG, according to an example embodiment.

Referring now to FIGS. 19 and 20, the mounting bracket 564 is shown, according to an example embodiment. The mounting bracket 564 includes a pair of angle brackets configured for coupling with the shank 130. The mounting bracket 564 includes a first angle bracket 670 and a second angle bracket 672. The first angle bracket 670 is configured for coupling with any one of the shank 130, the surface 170, and the faucet 100. The second angle bracket 672 is coupled with the first angle bracket 670, such as by fasteners, welding, adhesives, latches, and the like. The second angle bracket 672 is further structured for coupling with the rail 552 proximate to the second rail end 562. Extending through the second angle bracket 672 are a bracket aperture 674 and a bracket slot 676 positioned radially away from the bracket aperture 674 and extending circumferentially about the bracket aperture 674. The bracket aperture 674 and the bracket slot 676 are configured to receive fasteners that extend through both the rail 552 and the second angle bracket 672. The bracket slot 676 being circumferentially positioned about the bracket aperture 674 allows the central axis of the rail 552 to be positioned at a non-zero angle 678 with respect to the central axis of the shank 130. Thus, the rail 552 may be positioned such that no portion of the rail 552 engages with or interferes with drainage plumbing, shelves, sink basins, garbage disposals, and the like positioned below the faucet.

Figure 21:
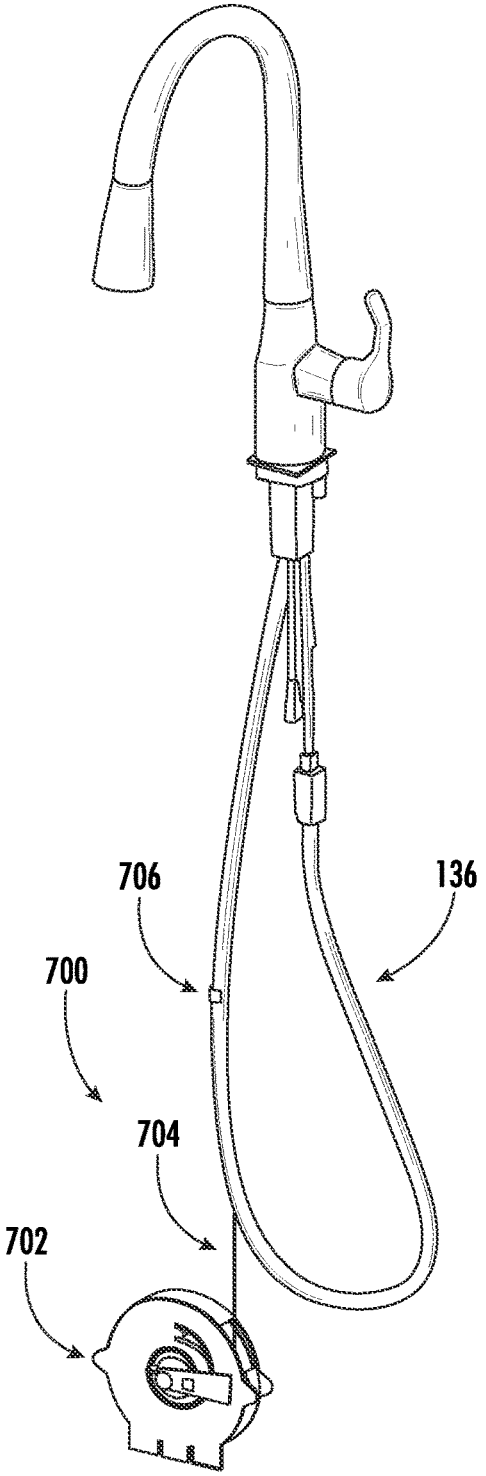
FIG. 21 is a perspective view of a spray head retraction assembly, according to an example embodiment.
Figure 23:
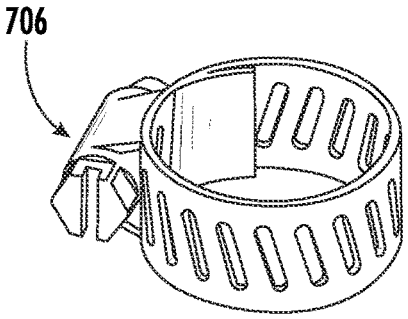
FIG. 23 is a perspective view of a portion of the spray head retraction assembly of FIG. 21, according to an example embodiment.

Referring now to FIG. 21, a spray head retraction assembly 700 is shown, according to an example embodiment. The retraction assembly 700 includes a retraction device 702, a retractable cord 704 (e.g., string, rope, etc.), and a coupling 706 (FIG. 23) coupled with an end of the cord 704. The retraction device 702 is configured to facilitate extension and retraction of the cord 704. The retraction device 702 is configured for coupling below the faucet 100. For example, the retraction device 702 may be coupled with a cabinet, a wall, a floor, a drain pipe, or a similar structural feature positioned below the faucet 100. The retraction device 702 is configured for coupling such that the retraction device 702 does not move while facilitating extension and retraction of the spray hose 136. When the spray hose 136 is in the retracted position (FIG. 1, FIG. 21), the retraction device 702 may apply a slight force to the cord 704 to keep the cord 704 taut and to maintain the spray head 106 and the spray hose 136 in the retracted position. When the spray hose 136 is in an extended position (FIG. 2), the retraction device 702 applies a force to the cord 704 to bias the spray hose 136 toward the retracted position. The coupling 706 is coupled (e.g., fixedly coupled) with the spray hose 136 such that the coupling 706 does not slide along the length of the spray hose 136. As the spray hose 136 is transitioned to an extended position, the coupling 706 moves toward the shank 130.

Figure 22:
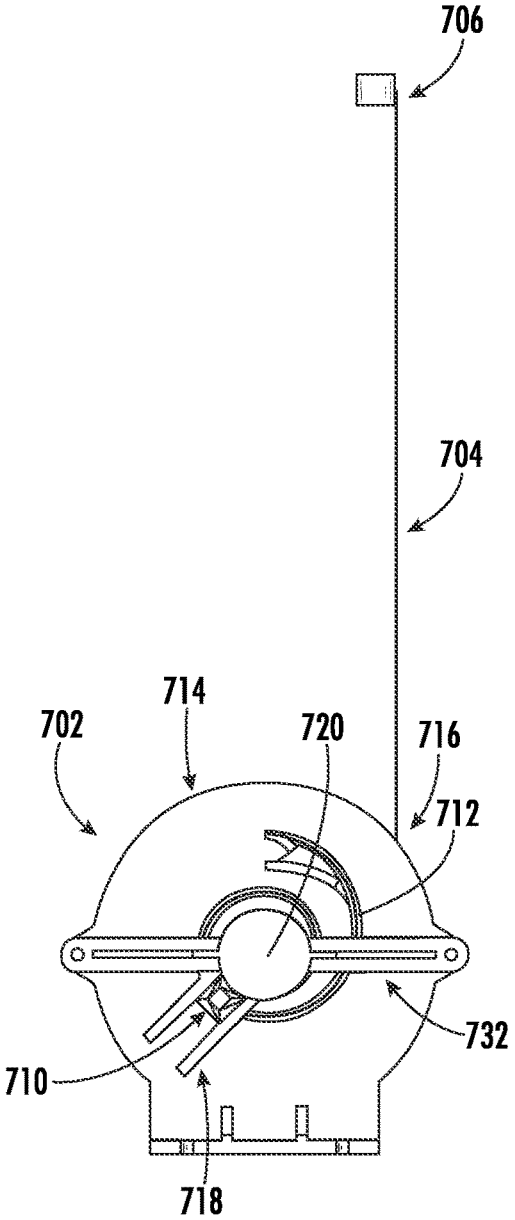
FIG. 22 is a front view of a portion of the spray head retraction assembly of FIG. 21, according to an example embodiment.

Referring now to FIG. 22, a detailed front view of the retraction device 702 is shown. The retraction device 702 includes a detent feature 710 that traverses along a track 712 formed within a chassis 714 of the retraction device 702. As the cord 704 is extended out of an aperture 716 formed at a peripheral of the retraction device 702, the detent feature 710 transverses along the track 712 in an outwardly spiraling manner, counterclockwise relative to the orientation of FIG. 22. A fixture 718 (e.g., guide rails, etc.) slidably engages the detent feature 710, maintaining the orientation of the detent feature 710, as the fixture 718 rotates. The detent feature 710 moves radially relative to a central axis 720 of the retraction device 702.

Figure 24:
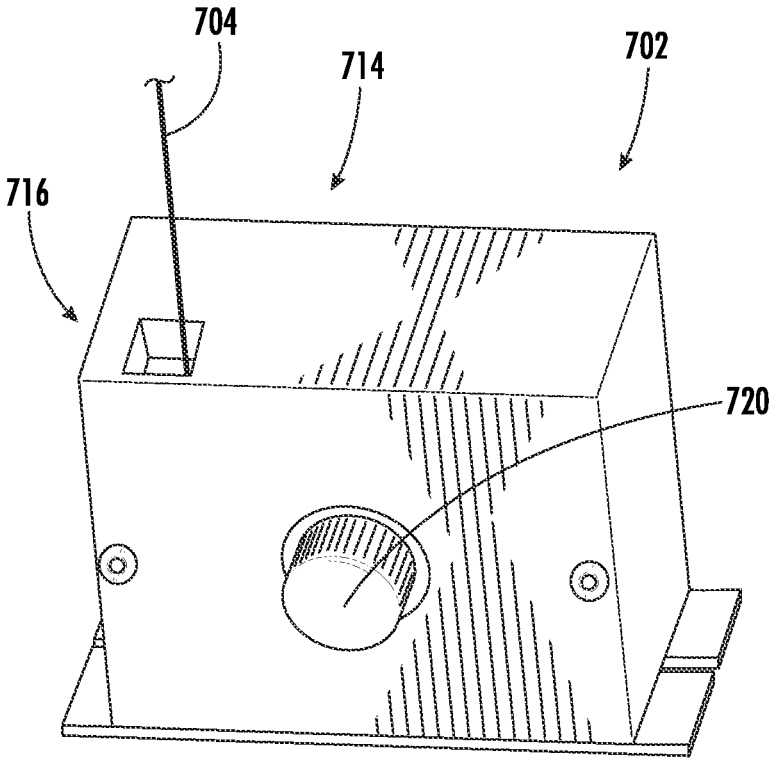
FIG. 24 is a perspective view of a retraction device, according to an example embodiment.

Referring now to FIG. 24, a perspective view of the retraction device 702 is shown, according to an exemplary embodiment. The retraction device 702, shown in FIG. 24, may be substantially similar to the retraction device 702, shown in at least FIGS. 21 and 22. However, one difference is that the retraction device 702, shown in FIG. 24, has a prismatic housing, where components of the retraction device 702 may be positioned therein.

Figure 25:
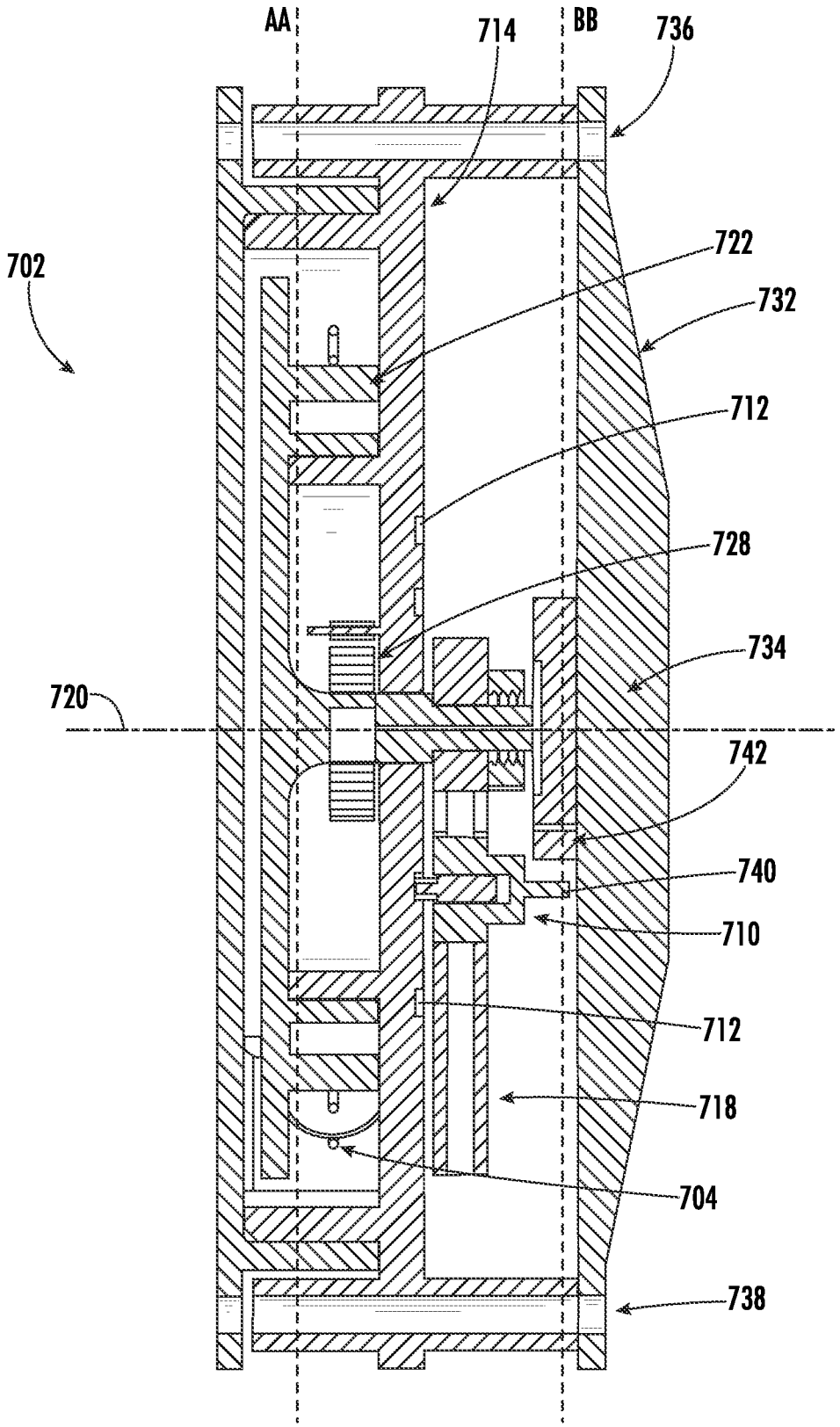
FIG. 25 is a cross-sectional side view of the portion of the spray head retraction assembly of FIG. 22, according to an example embodiment.
Figure 26:
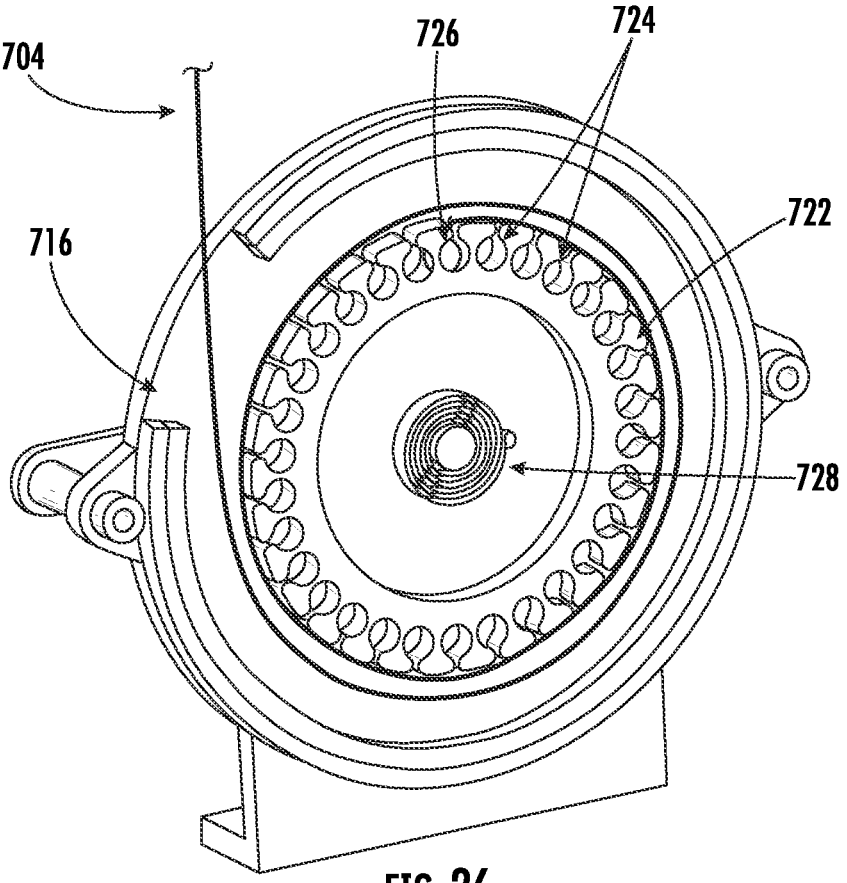
FIG. 26 is a cross-sectional front view of the portion of the spray head retraction assembly of FIG. 22 along line AA of FIG. 25, according to an example embodiment.

Referring now to FIG. 25, a side, cross-sectional view of the retraction device 702 is shown. The retraction device 702 further includes a rotatable body 722 rotatably coupled with the chassis 714 and fixedly couple with the fixture 718. Referring to FIG. 26, a front perspective, cross-sectional view of the retraction device 702 is shown along line AA of FIG. 25. The rotatable body 722 includes a plurality of apertures 724 extending about a circumference of the rotatable body 722. The apertures 724 provide an adjustable feature to the cord 704 such that the length of the cord 704 relative to the extended position of the faucet 100 may be changed and adjusted. For example, in embodiments where the retraction device 702 must be positioned far away from the spray hose 136, a bulbous end 726 of the cord 704 may be positioned in a different one of the plurality of apertures 724. In some embodiments, such as when the retraction device 702 is positioned much closer to the spray hose 136, the bulbous end 726 of the cord 704 may be moved to a different one of the plurality of apertures 724 to remove the slack from the cord 704. As the faucet 100 is transitioned out of the retracted position, the bulbous end 726 applies a circumferential force on the rotatable body 722 (in the clockwise direction relative to FIG. 26). As the rotatable body 722 is rotated during the extension of the faucet 100, potential energy is stored in a biasing member 728. As shown, the biasing member 728 is a coil spring. When the faucet 100 is in an extended position, the biasing member 728 applies a counterforce to the rotatable body 722, which in turn applies a force to the cord 704, which applies a force to the spray hose 136 in a direction toward the retracted positon.

Referring again to FIG. 25, a damping assembly 730 is coupled with the chassis 714 and is configured to provide a soft-close feature to the faucet 100. The damping assembly 730 includes a support bracket 732 and a damper 734 coupled with the support bracket 732. The support bracket 732 includes two arms extending radially away from the damper 734 and configured for coupling with the chassis 714, such as by fasteners via the first coupling aperture 736 and the second coupling aperture 738. Specifically, the detent feature 710 includes a projection 740 configured to engage an engagement surface 742 of the damper 734.

The damper 734 may be similar to the damper 244. The damper 734 is coupled to the support bracket 732 proximate a central axis 720 of the retraction device 702. The damper 734 is configured to engage with the detent feature 710 as the faucet 100 transitioned toward a fully retracted position.

Figure 27:
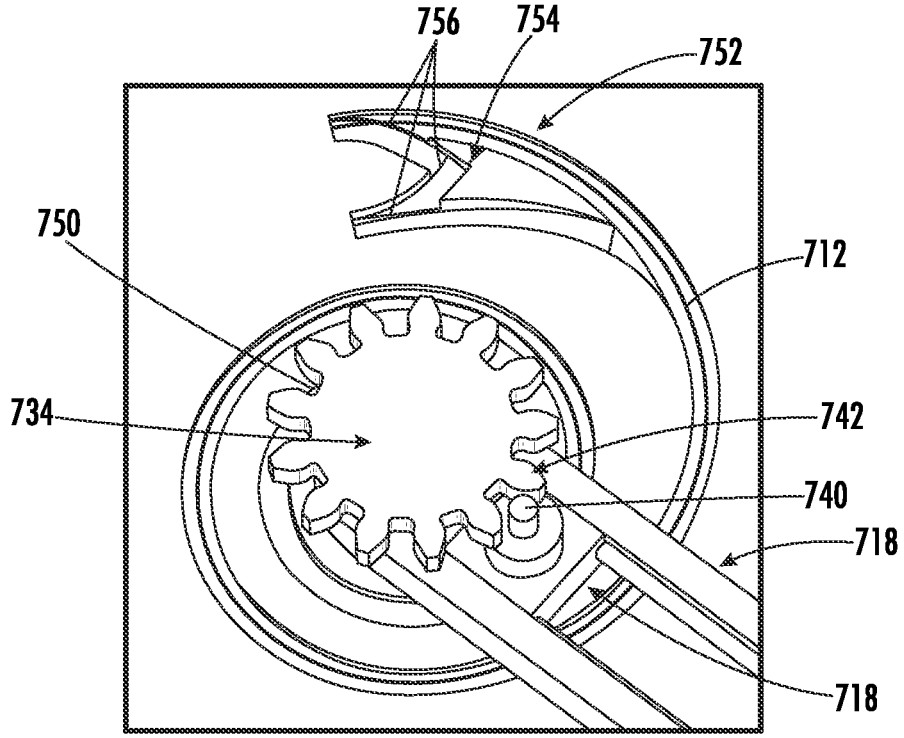
FIG. 27 is a detailed cross-sectional view of the portion of the spray head retraction assembly of FIG. 22 along line BB of FIG. 25, according to an example embodiment.

Turning now to FIG. 27, a detailed cross-sectional front perspective view of the damper 734 and the detent feature 710 is shown along line BB of FIG. 25. The detent feature 710 translates along and within the track 712 as the faucet 100 is transitioned between the extended position and the retracted position. The track 712 includes a first track end 750 and a second track end 752. The first track end 750 spirals inward toward the central axis 720 of the retraction device 702. The second track end 752 is opposite to the first track end 750 and spirals outward away from the central axis 720. The second track end 752 is configured to retain the spray hose 136 in an extended position. The second track end 752 is similar to the second channel end 664 (FIG. 18). Specifically, the second track end 752 includes a V-shaped catch 754 configured to maintain the detent feature 710, and thus the spray hose 136, in an extended position. The V-shaped catch 754 allows a user to pull the spray head 106 until the spray head 106 stops extending, and then release the spray head 106 to maintain the spray head 106 in an extended position.

A plurality of track steps 756 (similar to the channel steps 420) facilitate the transition of the detent feature 710 to the V-shaped catch 754. Upon a second pull of the spray head 106, the detent feature 710 exits the V-shaped catch 754 after passing over a track step 756. When the user then releases the spray head 106, the biasing member 728 applies a force to the spray hose 136 and retracts the hose 136.

When the faucet 100 is transitioned out of a fully extended position, the biasing member 728 causes rotation of the rotating body 722 (in the counterclockwise direction as shown in FIG. 26). The rotation of the rotating body 722 pulls on the cord 704, which applies a retraction force to the spray hose 136. As the cord 704 is retracted and coiled around the rotating body 722, the detent feature 710 spirals inward within the track 712. As the detent feature 710 spirals closer to the central axis 720, the projection 740 engages with the damper 734. The damper 734 is configured to provide a soft-close feature to the faucet 100. Referring to FIG. 27, the damper 734 may be a unidirectional damper that resists clockwise rotation while allowing uninhibited rotation in the counterclockwise direction. When the projection 740 engages the damper 734, the damper 734 slows down the rotation of the fixture 718 and the rotating body 722 to provide the soft-close feature.

When the faucet 100 is transitioned out of the retracted position, a force is applied to the spray head 106, which is translated to the spray hose 136 which is translated to the cord 704. The force applied to the cord 704 is translated to the rotatable body 722 and causes the rotatable body to rotate about the central axis 720 (in a clockwise direction relative to FIG. 26). The rotation of the rotatable body 722 translates to rotation of the fixture 718. The fixture 718 is fixedly coupled with the rotatable body 722 at the central axis 720 such that rotation of the rotatable body 722 about the central axis 720 results in rotation of the fixture 718 about the central axis 720. The fixture 718 facilitates movement of the detent feature 710 within the track 712. As shown in FIG. 27, as the fixture 718 is rotated in the counterclockwise direction about the central axis 720, the detent feature 710 slides within the fixture 718 and travels within the track 712 in an outward spiraling counterclockwise direction. When the spray hose 136 is in a fully extended position, the detent feature 710 rests within the V-shaped catch 754.

Figure 28:
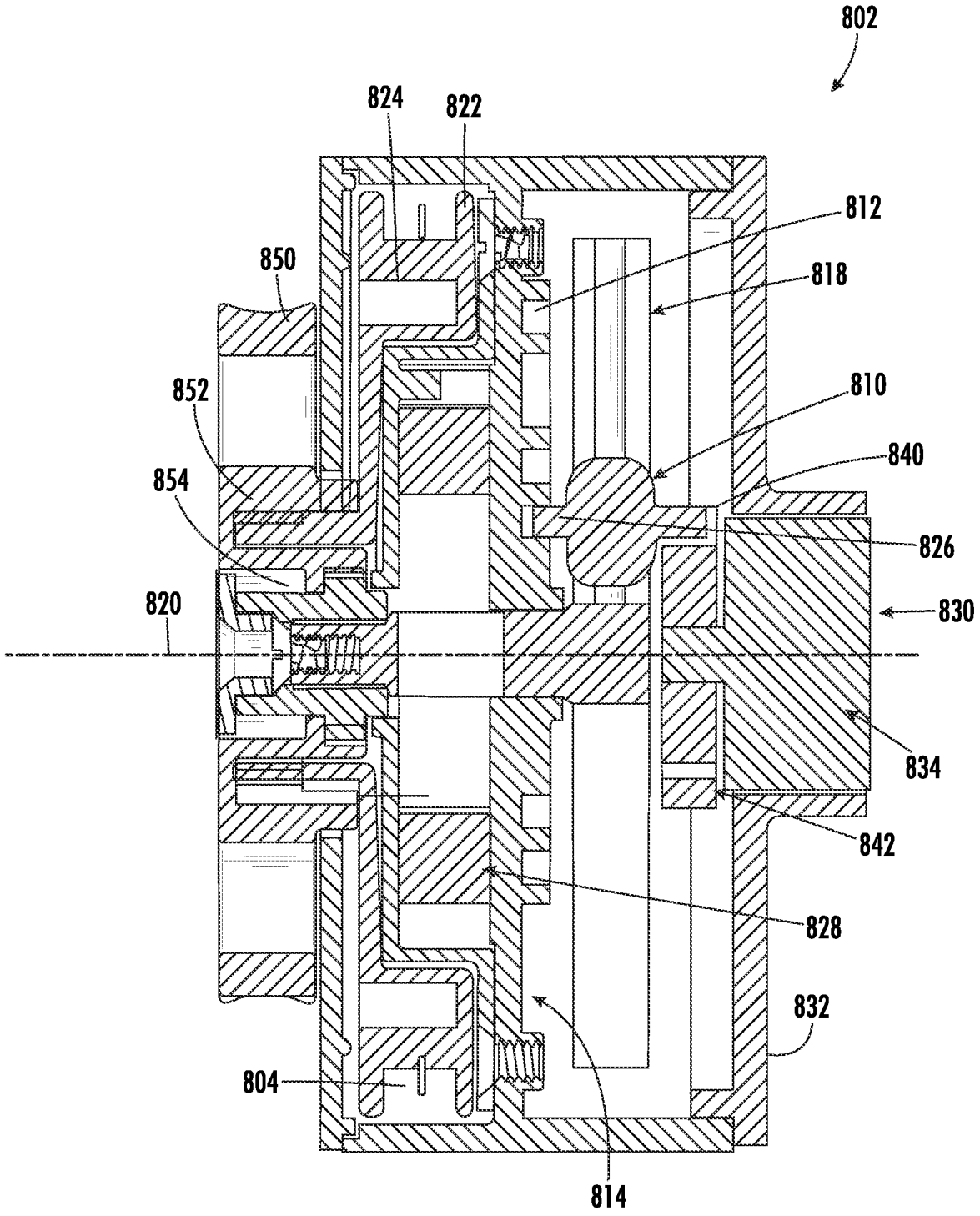
FIG. 28 is a detailed side view of a spray head retraction assembly, shown in a first position, according to an example embodiment.
Figure 29:
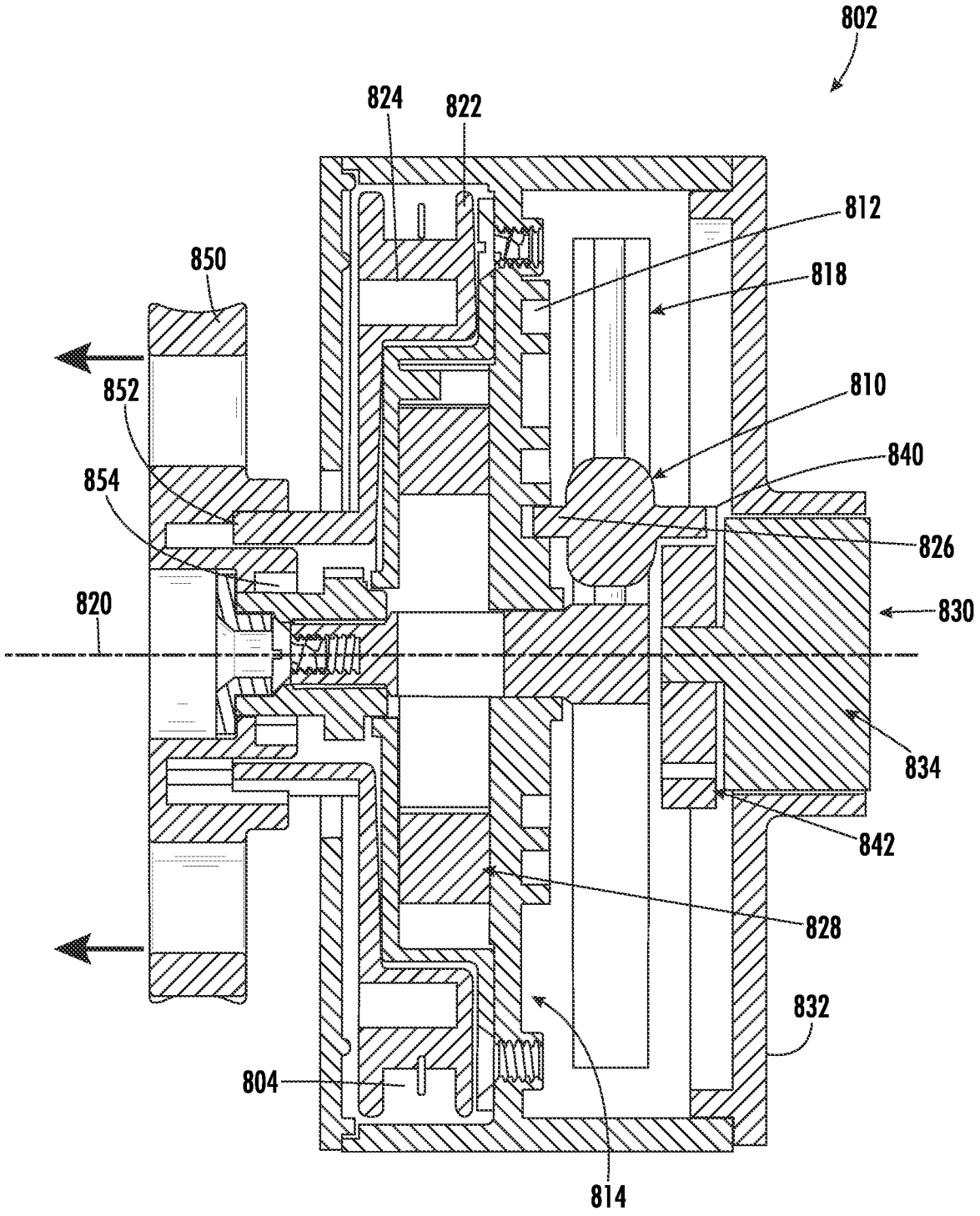
FIG. 29 is a detailed side view of the spray head retraction assembly of FIG. 28, shown in a second position, according to an example embodiment.
Figure 30:
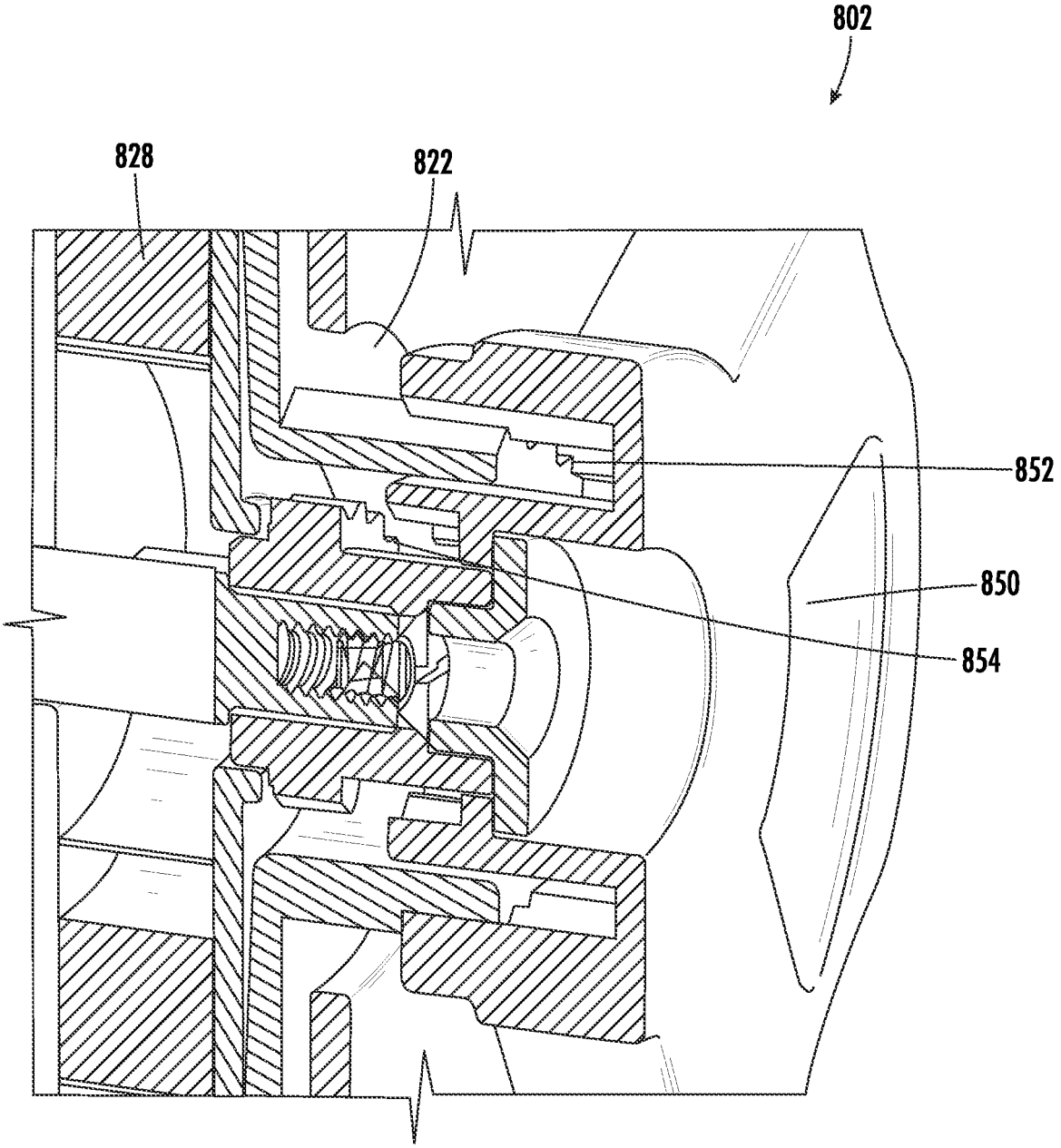
FIG. 30 is a detailed perspective view of the spray head retraction assembly of FIG. 28, according to an example embodiment.

Referring now to FIGS. 28-30, a spray head retraction assembly 800 is shown, according to an example embodiment. The retraction assembly 800 includes a retraction device 802 and a retractable cord 804 (e.g., string, rope, etc.). The retraction assembly 802 is substantially similar to the retraction assembly 702 such that similar reference numerals may be used to describe the retraction assembly 802. The retraction device 802 is configured to facilitate extension and retraction of the cord 804. The retraction device 802 is configured for coupling below a faucet (e.g., such as faucet 100 discussed above). For example, the retraction device 802 may be coupled with a cabinet, a wall, a floor, a drain pipe, or a similar structural feature positioned below the faucet 100. The retraction device 802 is configured for coupling such that the retraction device 802 does not move while facilitating extension and retraction of the spray hose 136 (e.g., shown in FIG. 1). When the spray hose 136 is in the retracted position (e.g., shown in FIG. 1), the retraction device 802 may apply a slight force to the cord 804 to keep the cord 804 taut and to maintain the spray head 106 and the spray hose 136 in the retracted position. When the spray hose 136 is in an extended position (e.g., shown in FIG. 2), the retraction device 802 applies a force to the cord 804 to bias the spray hose 136 toward the retracted position.

The retraction device 802 includes a detent feature 810 that traverses along a track 812 formed within a chassis 814 of the retraction device 802. As the cord 804 is extended out of an aperture 816 formed at a peripheral of the retraction device 802, the detent feature 810 transverses along the track 812 in an outwardly spiraling manner. A fixture 818 (e.g., guide rails, etc.) slidably engages the detent feature 810, maintaining the orientation of the detent feature 810, as the fixture 818 rotates. The detent feature 810 moves radially relative to a central axis 820 of the retraction device 802.

FIGS. 28-30 also show a side, cross-sectional view of the retraction device 802. The retraction device 802 further includes a rotatable body 822 that is rotatably coupled with the chassis 814 and fixedly couple with the fixture 818. The rotatable body 822 includes a plurality of apertures 824 extending about a circumference of the rotatable body 822. The apertures 824 provide an adjustable feature to the cord 804 such that the length of the cord 804 relative to the extended position of the faucet 100 may be changed and adjusted. As the faucet 100 is transitioned out of the retracted position, the bulbous end 826 applies a circumferential force on the rotatable body 822. As the rotatable body 822 is rotated during the extension of the faucet 100, potential energy is stored in a biasing member 828. As shown, the biasing member 828 is a coil spring. When the faucet 100 is in an extended position, the biasing member 828 applies a counterforce to the rotatable body 822, which in turn applies a force to the cord 804, which applies a force to the spray hose 136 in a direction toward the retracted positon.

A damping assembly 830 is coupled with the chassis 814 and is configured to provide a soft-close feature to the faucet 100. The damping assembly 830 includes a support bracket 832 and a damper 834 coupled with the support bracket 832. The support bracket 832 includes two arms extending radially away from the damper 834 and configured for coupling with the chassis 814, such as by fasteners via the first coupling aperture 836 and the second coupling aperture 838. Specifically, the detent feature 810 includes a projection 840 configured to engage an engagement surface 842 of the damper 834. The damper 834 may be similar to the damper 244. The damper 834 is coupled to the support bracket 832 proximate a central axis 820 of the retraction device 802. The damper 834 is configured to engage with the detent feature 810 as the faucet 100 transitioned toward a fully retracted position.

When the faucet 100 is transitioned out of a fully extended position, the biasing member 828 causes rotation of the rotatable body 822. The rotation of the rotatable body 822 pulls on the cord 804, which applies a retraction force to the spray hose 136. As the cord 804 is retracted and coiled around the rotatable body 822, the detent feature 810 spirals inward within the track 812. As the detent feature 810 spirals closer to the central axis 820, the projection 840 engages with the damper 834. The damper 834 is configured to provide a soft-close feature to the faucet 100. The damper 834 may be a unidirectional damper that resists clockwise rotation while allowing uninhibited rotation in the counterclockwise direction. When the projection 840 engages the damper 834, the damper 834 slows down the rotation of the fixture 818 and the rotatable body 822 to provide the soft-close feature.

When the faucet 100 is transitioned out of the retracted position, a force is applied to the spray head 106, which is translated to the spray hose 136 which is translated to the cord 804. The force applied to the cord 804 is translated to the rotatable body 822 and causes the rotatable body to rotate about the central axis 820. The rotation of the rotatable body 822 translates to rotation of the fixture 818. The fixture 818 is fixedly coupled with the rotatable body 822 at the central axis 820 such that rotation of the rotatable body 822 about the central axis 820 results in rotation of the fixture 818 about the central axis 820. The fixture 818 facilitates movement of the detent feature 810 within the track 812. As the fixture 818 is rotated in the counterclockwise direction about the central axis 820, the detent feature 810 slides within the fixture 818 and travels within the track 812 in an outward spiraling counterclockwise direction. When the spray hose 136 is in a fully extended position, the detent feature 810 rests within the track 812.

The retraction device 802 includes a rotatable member or wheel, shown as retraction wheel 850. The retraction wheel 850 may be selectively coupled to the rotatable body 822, distal the support bracket 832. In some embodiments, the retraction wheel 850 may be coupled to the rotatable body 822 proximate the support bracket 832. The retraction wheel 850 may be configured to be used for calibration of the retraction device 802 by selectively maintaining either tension or slack in the cord 804. The retraction wheel 850 may be selectively repositionable between a first position and a second position. The first position (shown in FIG. 28) is a closed position, where the retraction wheel 850 may be coupled to the rotatable body 822, and the second position (shown in FIG. 29) is an open position, where the retraction wheel 850 may not be coupled to the rotatable body 822. In some embodiments, the first position may be the open position and the second position may be the closed position. Coupled to the retraction wheel 850, proximate the central axis 820, is a first threaded interface, interface, or spline, shown as first wheel interface 852. The first wheel interface 852 may be configured to selectively couple the retraction wheel 850 to the rotatable member 822. In some embodiments, the first wheel interface 852 may be configured to fixedly couple the retraction wheel 850 to the rotatable member 822. The first wheel interface 852 may be a spline, where the spline includes teeth that engage the rotatable body 822. Positioned between the first wheel interface 852 and the central axis 820 is a second threaded interface, interface, or spline, shown as second wheel interface 854. The second wheel interface 854 may be configured to selectively couple the retraction wheel 850 to the biasing member 828. In some embodiments, the second wheel interface 854 may be configured to fixedly couple the retraction wheel 850 to the biasing member 828. The second wheel interface 854 may be a spline, where the spline includes teeth that engage the biasing member 828.

Referring specifically to FIG. 28, the retraction wheel 850 is shown in the first position. In the first position, the retraction wheel 850 may be positioned proximate the rotatable member 822 so that the cord 804 maintains tension. That is, in the first position, at least one of the first wheel interface 852 and the second wheel interface 854 are engaged such to maintain tension in the cord 804. In some embodiments, both the first wheel interface 852 and the second wheel interface 854 are engaged so as to maintain tension in the cord 804.

Referring now to FIG. 29, the retraction wheel 850 is shown in the second position. The retraction wheel 850 may be moved (e.g., pushed, pulled, etc.) along a direction parallel to the central axis 820 to selectively reposition the retraction wheel 850 from the first position to the second position. In the second position, the retraction wheel 850 may be positioned distal the rotatable member 822 so that the cord 804 releases tension. That is, in the second position, at least one of the first wheel interface 852 and the second wheel interface 854 are disengaged such to eliminate tension in the cord 804. In some embodiments, both the first wheel interface 852 and the second wheel interface 854 are disengaged such to eliminate tension in the cord 804.

To install the retraction assembly 802, a coupling mechanism (e.g., tape, adhesive, etc.) may be positioned on the back side of the support bracket 832, proximate the central axis 820, to couple the retraction assembly 802 to a cabinet, wall, floor, drain pipe, or similar structure. Once the retraction assembly 802 is coupled to the structure, the retraction wheel 850 is pulled, in the direction parallel the central axis 820, to release tension on the cord 804. When the tension is released, the cord 804 is coupled to the spray hose 136 by a clamp, zip tie, or similar coupling mechanism. With the retraction wheel 850 still in the second position, the retraction wheel 850 is rotated in the counterclockwise direction to wind the cord 804 until tension is gained in the cord 804. Once tension is back in the cord 804, the retraction wheel 850 is pushed back into the first position to maintain tension in the cord 804.

Figure 31:
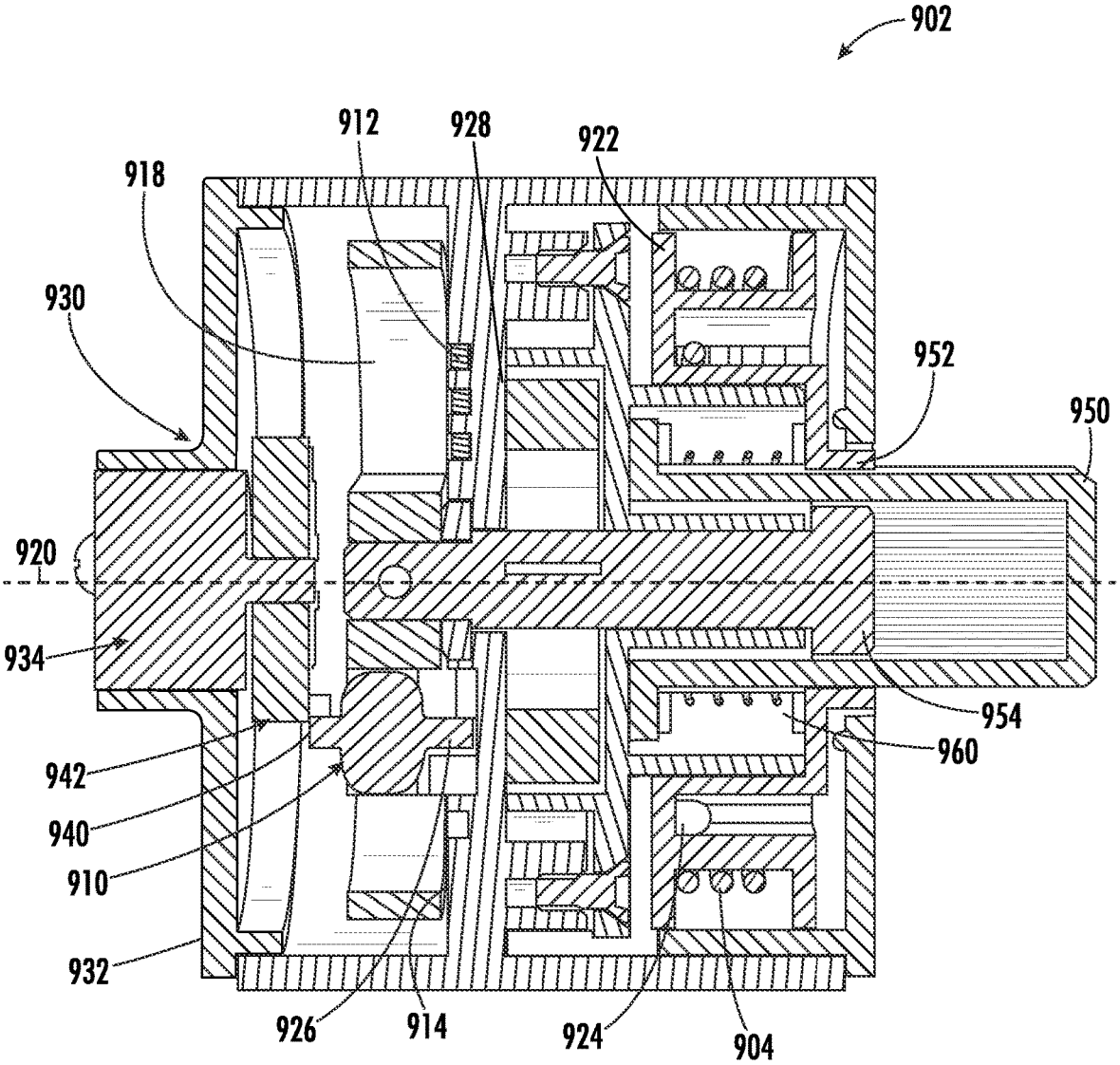
FIG. 31 is a detailed side view of a spray head retraction assembly, according to an example embodiment.
Figure 32:
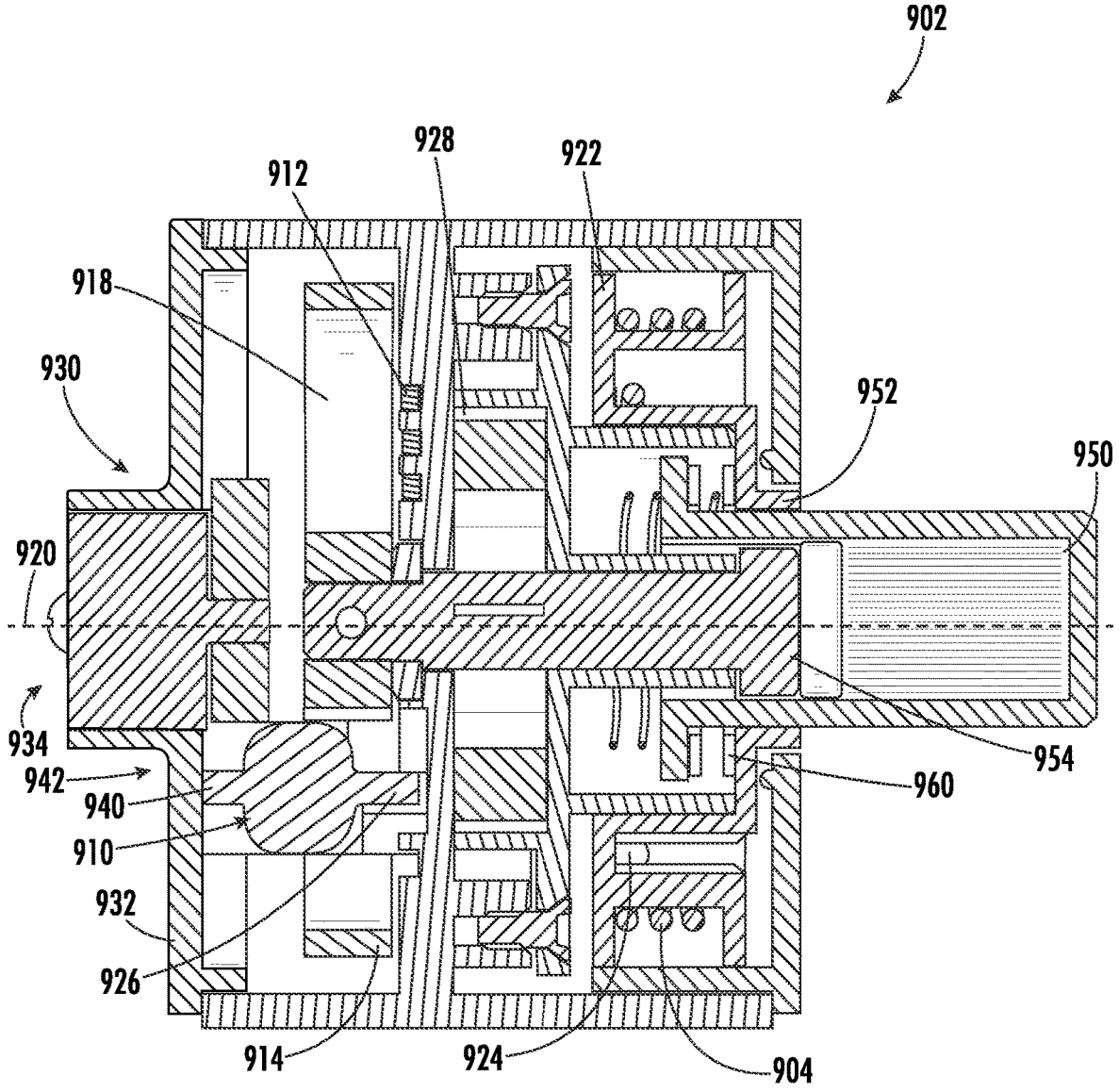
FIG. 32 is a detailed side view of the spray head retraction assembly of FIG. 31, shown in a second position, according to an example embodiment.

Referring now to FIGS. 31 and 32, a spray head retraction assembly 900 is shown, according to another example embodiment. The retraction assembly 900 includes a retraction device 902 and a retractable cord 904 (e.g., string, rope, etc.). The retraction assembly 902 is substantially similar to the retraction assembly 702 such that similar components may be used to describe the retraction assembly 902. The retraction device 902 is configured to facilitate extension and retraction of the cord 904. The retraction device 902 is configured for coupling below a faucet (e.g., such as the faucet 100 discussed above). For example, the retraction device 902 may be coupled with a cabinet, a wall, a floor, a drain pipe, or a similar structural feature positioned below the faucet 100. The retraction device 902 is configured for coupling such that the retraction device 902 does not move while facilitating extension and retraction of the spray hose 136 (e.g., shown in FIG. 1). When the spray hose 136 is in the retracted position (e.g., shown in FIG. 1), the retraction device 902 may apply a slight force to the cord 804 to keep the cord 904 taut and to maintain the spray head 106 and the spray hose 136 in the retracted position. When the spray hose 136 is in an extended position (e.g., shown in FIG. 2), the retraction device 902 applies a force to the cord 904 to bias the spray hose 136 toward the retracted position.

FIGS. 31 and 32 also show a cross sectional view of the retraction device 902. The retraction device 902 includes a detent feature 910 that traverses along a track 912 formed within a chassis 914 of the retraction device 902. As the cord 904 is extended out of an aperture 916 formed at a peripheral of the retraction device 902, the detent feature 910 transverses along the track 912 in an outwardly spiraling manner. A fixture 918 (e.g., guide rails, etc.) slidably engages the detent feature 910, maintaining the orientation of the detent feature 910, as the fixture 918 rotates. The detent feature 910 moves radially relative to a central axis 920 of the retraction device 902.

Referring specifically to FIG. 31, a side, cross-sectional view of the retraction device 902 is shown. The retraction device 902 further includes a rotatable body 922 rotatably coupled with the chassis 914 and fixedly couple with the fixture 918. The rotatable body 922 includes a plurality of apertures 924 extending about a circumference of the rotatable body 922. The apertures 924 provide an adjustable feature to the cord 904 such that the length of the cord 904 relative to the extended position of the faucet 100 may be changed and adjusted. As the faucet 100 is transitioned out of the retracted position, the bulbous end 926 applies a circumferential force on the rotatable body 922. As the rotatable body 922 is rotated during the extension of the faucet 100, potential energy is stored in a biasing member 928. As shown, the biasing member 928 is a coil spring. When the faucet 100 is in an extended position, the biasing member 928 applies a counterforce to the rotatable body 922, which in turn applies a force to the cord 904, which applies a force to the spray hose 136 in a direction toward the retracted positon.

A damping assembly 930 is coupled with the chassis 914 and is configured to provide a soft-close feature to the faucet 100. The damping assembly 930 includes a support bracket 932 and a damper 934 coupled with the support bracket 932. The support bracket 932 includes two arms extending radially away from the damper 934 and configured for coupling with the chassis 914, such as by fasteners via the first coupling aperture 936 and the second coupling aperture 938. Specifically, the detent feature 910 includes a projection 940 configured to engage an engagement surface 942 of the damper 934. The damper 934 may be similar to the damper 244. The damper 934 is coupled to the support bracket 932 proximate a central axis 920 of the retraction device 902. The damper 934 is configured to engage with the detent feature 910 as the faucet 100 transitioned toward a fully retracted position.

When the faucet 100 is transitioned out of a fully extended position, the biasing member 928 causes rotation of the rotatable body 922. The rotation of the rotatable body 922 pulls on the cord 904, which applies a retraction force to the spray hose 136. As the cord 904 is retracted and coiled around the rotatable body 922, the detent feature 910 spirals inward within the track 912. As the detent feature 910 spirals closer to the central axis 920, the projection 940 engages with the damper 934. The damper 934 is configured to provide a soft-close feature to the faucet 100. The damper 934 may be a unidirectional damper that resists clockwise rotation while allowing uninhibited rotation in the counterclockwise direction. When the projection 940 engages the damper 934, the damper 934 slows down the rotation of the fixture 918 and the rotatable body 922 to provide the soft-close feature.

When the faucet 100 is transitioned out of the retracted position, a force is applied to the spray head 106, which is translated to the spray hose 136 which is translated to the cord 904. The force applied to the cord 904 is translated to the rotatable body 922 and causes the rotatable body to rotate about the central axis 920. The rotation of the rotatable body 922 translates to rotation of the fixture 918. The fixture 918 is fixedly coupled with the rotatable body 922 at the central axis 920 such that rotation of the rotatable body 922 about the central axis 920 results in rotation of the fixture 918 about the central axis 920. The fixture 918 facilitates movement of the detent feature 910 within the track 912. As the fixture 918 is rotated in the counterclockwise direction about the central axis 920, the detent feature 910 slides within the fixture 918 and travels within the track 912 in an outward spiraling counterclockwise direction. When the spray hose 136 is in a fully extended position, the detent feature 910 rests within the track 912.

As shown in FIG. 31, the retraction device 902 includes a rotatable member or wheel, shown as retraction wheel 950. The retraction wheel 950 may be selectively coupled to the rotatable body 922, distal the support bracket 932. In some embodiments, the retraction wheel 950 may be coupled to the rotatable body 922 proximate the support bracket 932. The retraction wheel 950 may be configured to be used for retraction device 902 calibration by selectively maintaining either tension or slack in the cord 904. The retraction wheel 950 may be selectively repositionable between a first position and a second position. The first position may be a closed position, where the retraction wheel 950 may be coupled to the rotatable body 922, and the second position may be an open position, where the retraction wheel 950 may not be coupled to the rotatable body 922. In some embodiments, the first position may be the open position and the second position may be the closed position.

Coupled to the retraction wheel 950, proximate the central axis 920, is a first threaded interface, interface, or spline, shown as first wheel interface 952. The first wheel interface 952 may be configured to selectively couple the retraction wheel 950 to the rotatable member 922. In some embodiments, the first wheel interface 952 may be configured to fixedly couple the retraction wheel 950 to the rotatable member 922. The first wheel interface 952 may be a spline, where the spline includes teeth that engage the rotatable body 922. Positioned between the first wheel interface 952 and the central axis 920 is a second threaded interface, interface, or spline, shown as second wheel interface 954. The second wheel interface 954 may be configured to selectively couple the retraction wheel 950 to the biasing member 928. In some embodiments, the second wheel interface 954 may be configured to fixedly couple the retraction wheel 950 to the biasing member 928. The second wheel interface 954 may be a spline, where the spline includes teeth that engage the biasing member 928. The retraction wheel 950 further includes a biasing mechanism, spring, compression mechanism, shown as spring 960. The spring 960 may be positioned between the first wheel interface 952 and the second wheel interface 954. The spring 960 may be configured to bias the retraction wheel 950 into the first position. In some embodiments, the spring 960 may be configured to bias the retraction wheel 950 into the second position.

In the first position, the retraction wheel 950 may be positioned proximate the rotatable member 922 so that the cord 904 maintains tension. That is, in the first position, at least one of the first wheel interface 952 and the second wheel interface 954 are engaged such to maintain tension in the cord 904. In some embodiments, both the first wheel interface 952 and the second wheel interface 954 are engaged such to maintain tension in the cord 904. The retraction wheel 950 may be moved (e.g., pushed, pulled, etc.) along a direction parallel to the central axis 920 to selectively reposition the retraction wheel 950 from the first position to the second position. In the second position, the retraction wheel 950 may be positioned distal the rotatable member 922 so that the cord 904 releases tension. That is, in the second position, at least one of the first wheel interface 952 and the second wheel interface 954 are disengaged such to eliminate tension in the cord 904. In some embodiments, both the first wheel interface 952 and the second wheel interface 954 are disengaged such to eliminate tension in the cord 904. To selectively reposition the retraction wheel 950 between the first position and the second position, the user may pull on the retraction wheel 950 to disengage at least one of the first wheel interface 952 and the second wheel interface 954. When the retraction wheel 950 is released, the retraction wheel 950 may be repositioned back into the first position by the spring 960.

Referring now to FIG. 32, the retraction wheel 950 is shown in the second position. The retraction wheel 950 may be moved (e.g., pushed, pulled, etc.) along a direction parallel to the central axis 920 to selectively reposition the retraction wheel 950 from the first position to the second position. In the second position, the retraction wheel 950 may be positioned distal the rotatable member 922 so that the cord 904 releases tension. That is, in the second position, at least one of the first wheel interface 952 and the second wheel interface 954 are disengaged such to eliminate tension in the cord 904. In some embodiments, both the first wheel interface 852 and the second wheel interface 954 are disengaged such to eliminate tension in the cord 904. In the second position, the spring 960 is compressed by moving the retraction wheel 950 along the direction parallel to the central axis 920.

Figure 33:
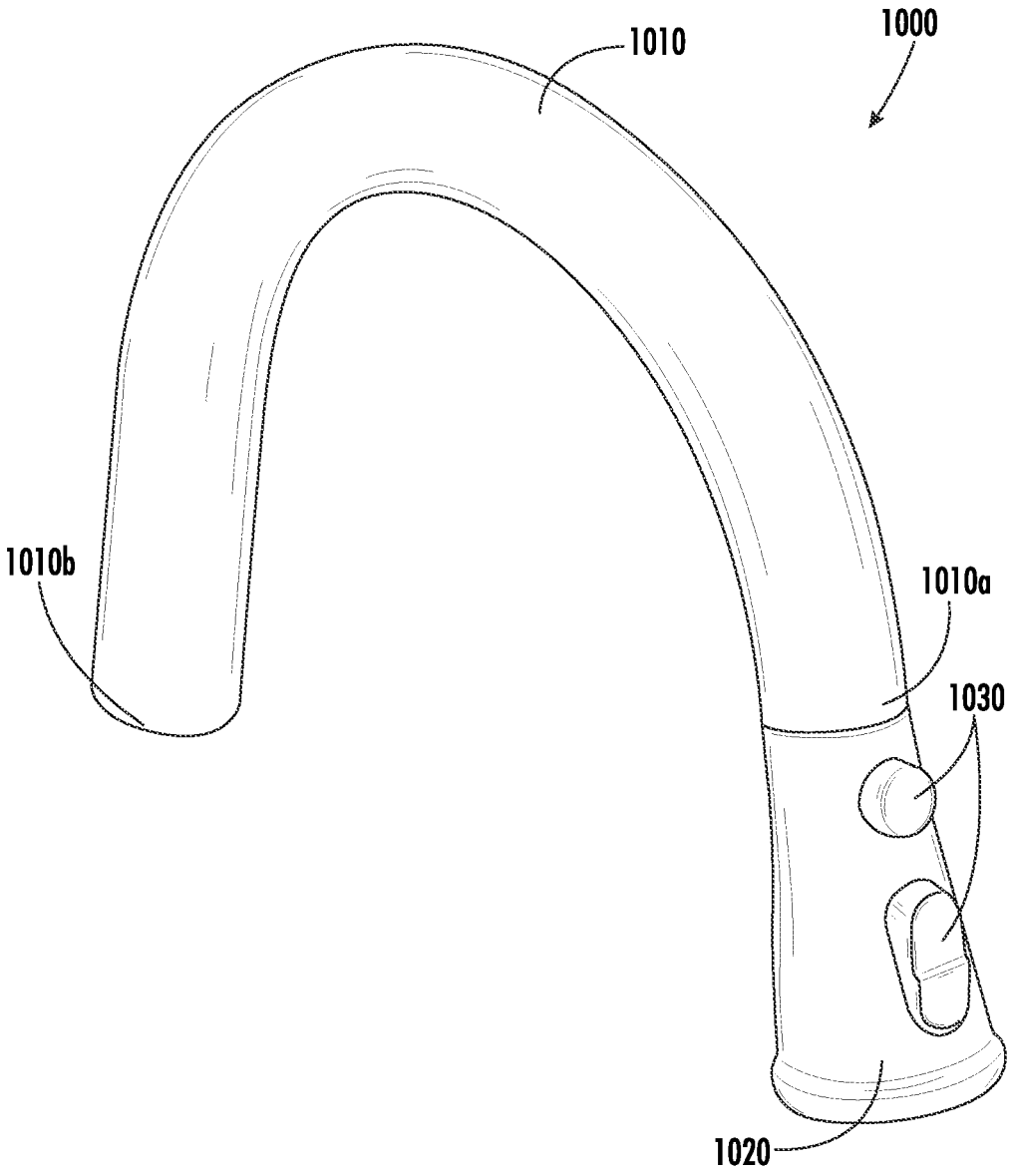
FIG. 33 is a perspective view of a faucet assembly, according to an example embodiment.

Referring to FIG. 33, a faucet assembly, shown as faucet 1000, is shown, according to an exemplary embodiment. The faucet 1000 may configured for use in kitchen environments (e.g., sink faucet, etc.). In other embodiments, the faucet 1000 may be configured for use in additional environments (e.g., bathroom environment, etc.). The faucet 1000 may be configured to facilitate the transfer of fluid from a fluid source to an outside environment. In particular, the faucet 1000 may be a retractable and/or spray head faucet, where a nozzle of the faucet may be retractable and fully received within the faucet 1000. The faucet 1000 may include a faucet body 1010. The faucet body 1010 may be an annular body extending along at least a length of the faucet 1000. The faucet body 1010 may be an outer shell, housing, etc. that is configured to support internal components of the faucet 1000. In some embodiments, the faucet body 1010 may be of any geometrical configuration (e.g., conical, frustoconical, rectangular, etc.). The faucet body 1010 may include a first end 1010*a* and a second end 1010*b*. The first end 1010*a* may be an end positioned proximate the fluid source. In other embodiments, the first end 1010*a* may be an end positioned proximate a faucet base. The second end 1010*b* may be an end positioned distal the first end 1010*a*, where fluid may be outputted proximate the second end 1010*b*. In some embodiments, the second end 1010*b* may be positioned proximate the first end 1010*a*.

The faucet 1000 may further include a nozzle 1020 coupled to an end of the faucet body 1010. To be more precise, the nozzle 1020 may be selectively coupled to the second end 1010*b*. The nozzle 1020 may be configured to output fluid via one or more nozzle apertures. The nozzle apertures may be positioned on a face of the nozzle, distal the second end 1010*b*. The nozzle 1020 may be selectively repositionable between an extended position and a retracted position. In the extended position, the nozzle 1020 may be positioned distal the second end 1010*b*, where a user may direct the nozzle 1020 in a particular direction. In the retracted position, the nozzle 1020 may be positioned proximate the second end 1010*b*, where the nozzle 1020 may be substantially fixed relative to the faucet body 1010.

According to an exemplary embodiment, the nozzle 1020 may include one or more buttons, mechanisms, etc., shown as buttons 1030, which are configured to alter the flow of fluid. As can be appreciated, the buttons 1030 may be actuated to do at least one of (a) promote fluid flow, (b) prohibit fluid flow, and (c) alter the pattern of the fluid flow out of the nozzle apertures. In other embodiments, the buttons 1030 may be a single button that may be actuated one or more times.

Figure 34:
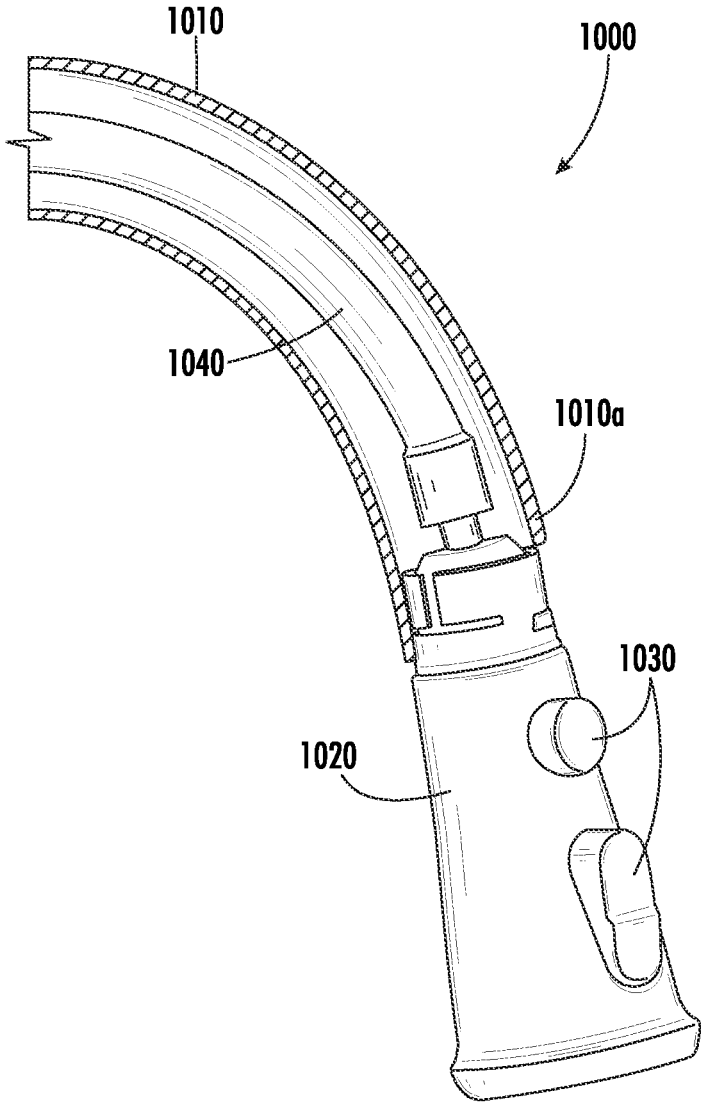
FIG. 34 is a perspective view of the faucet assembly of FIG. 33, showing an internal waterway, according to an example embodiment.

Referring now to FIG. 34, the faucet 1000 may include a waterway, shown as internal waterway 1040. The internal waterway 1040 may be a passage configured to facilitate the flow of fluid from a fluid source to an external environment. The internal waterway 1040 may further be configured as a bendable internal waterway, where the internal waterway 1040 may be bended at a radius threshold to take the shape of an internal passage or direct the nozzle 1020 in a particular direction. The internal waterway 1040 may be fixedly coupled to the nozzle 1020, where the internal waterway 1040 provides fluid to the nozzle 1020 to output fluid from the nozzle apertures. As shown in FIG. 34, the internal waterway 1040 may be disposed along a midpoint of the faucet body 1010. In other embodiments, the internal waterway 1040 may be disposed offset the midpoint of the faucet body 1010.

Figure 35:
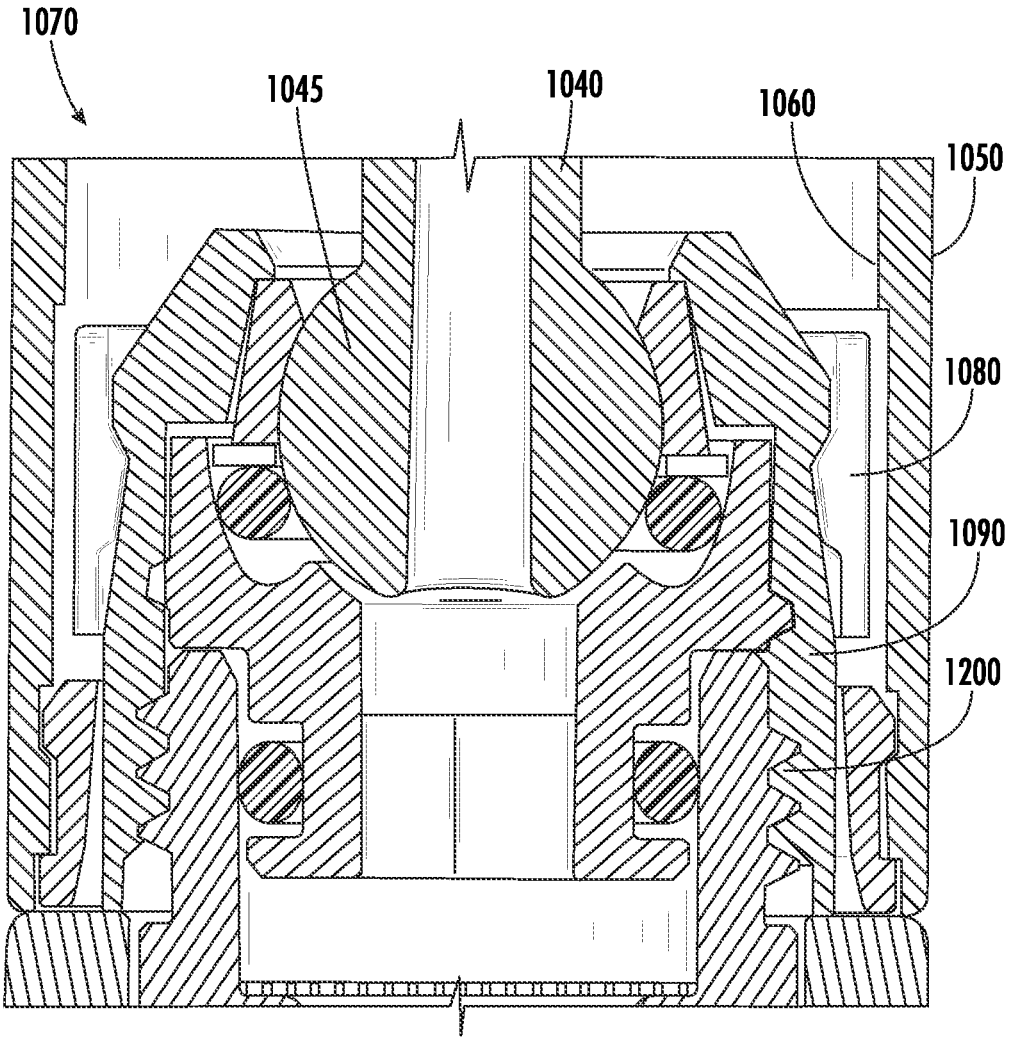
FIG. 35 is a detailed side view of a faucet mounting assembly of FIG. 33, according to an example embodiment.

As shown in FIG. 35, the internal waterway 1040 may be coupled to the nozzle 1020 via the joint 1045. The joint 1045 may be a ball joint that is selectively repositionable within the nozzle 1020 where the nozzle 1020 may rotate about the joint 1045. The joint 1045 may be at least partially received within the nozzle 1020, where the internal waterway 1040 may not disengage from the nozzle 1020. In some embodiments, the joint 1045 may be another joint other than a ball joint, where the internal waterway 1040 is still coupled to the nozzle 1020. The faucet body 1010 is shown to include an outer portion 1050 and an inner portion 1060. The outer portion 1050 may define a substantially annular body and the inner portion 1060 may define a structure substantially similar to the outer portion 1050.

Referring still to FIG. 35, the faucet 1000 may include a faucet mounting assembly, mounting structure, receiving structure, etc., shown as mounting assembly 1070. The mounting assembly 1070 may be configured to support the nozzle 1020, when the nozzle 1020 is in the retracted position. In other embodiments, the mounting assembly 1070 may support the nozzle 1020, when the nozzle 1020 is in the extended position. The mounting assembly 1070 may include a receiving clip 1080. The receiving clip 1080 may be a structure coupled to the inner portion 1060. In some embodiments, the receiving clip 1080 may be integrated into the faucet body 1010 where the receiving clip 1080 at least partially defines at least one of the outer portion 1050 and the inner portion 1060. The mounting assembly 1070 may further include a nut, conical nut, receiving nut, shown as conical nut 1090. The conical nut 1090 may be insertably coupled to the receiving clip 1080, where the conical nut 1090 may be selectively repositioned in and out of engagement with the receiving clip 1080. As shown in FIG. 35, the conical nut 1090 may include an engagement structure 1200 at least partially disposed on an internal surface of the conical nut 1090. The engagement structure 1200 may be configured to receive an engagement structure of the nozzle 1020 to couple the nozzle 1020 to the conical nut 1090. The engagement structure 1200 may be at least one of threads, receiving tabs, fasteners, or the like.

The primary functional components of the mounting assembly 1070 are the receiving clip 1080 and the conical nut 1090. When installed in the faucet 1000, the receiving clip 1080 may be fixed or otherwise secured to the inner portion 1060 of the faucet body 1010 (e.g., clipped or snapped into position within the inner portion 1060), whereas the conical nut 1090 may be fixed or otherwise secured to the nozzle 1020, the internal waterway 1040, the joint 1045, or other portion of the faucet 1000 that can be removed from the faucet body 1010 (e.g., threaded onto the nozzle 1020 via the engagement structure 1200). In the position shown in FIG. 35, the receiving clip 1080 engages the conical nut 1090 within the faucet body 1010 to retain the conical nut 1090 and the attached nozzle 1020 at the first end 1010*a* of the faucet body 1010. However, when the nozzle 1020 is pulled away from the faucet body 1010, the conical nut 1090 may disengage from the receiving clip 1080 and move out of the faucet body 1010 and away from the faucet body 1010 along with the nozzle 1020. The receiving clip 1080 may be configured to engage and secure the conical nut 1090 within the faucet body 1010 when no force or minimal force is applied to the nozzle 1020, but may release the conical nut 1090 to allow the nozzle 1020 to be pulled away from the faucet body 1010 when sufficient force is applied to the nozzle 1020. The structural features of the receiving clip 1080 and the conical nut 1090 may facilitate this functionality, as described in greater detail below.

Figure 36:
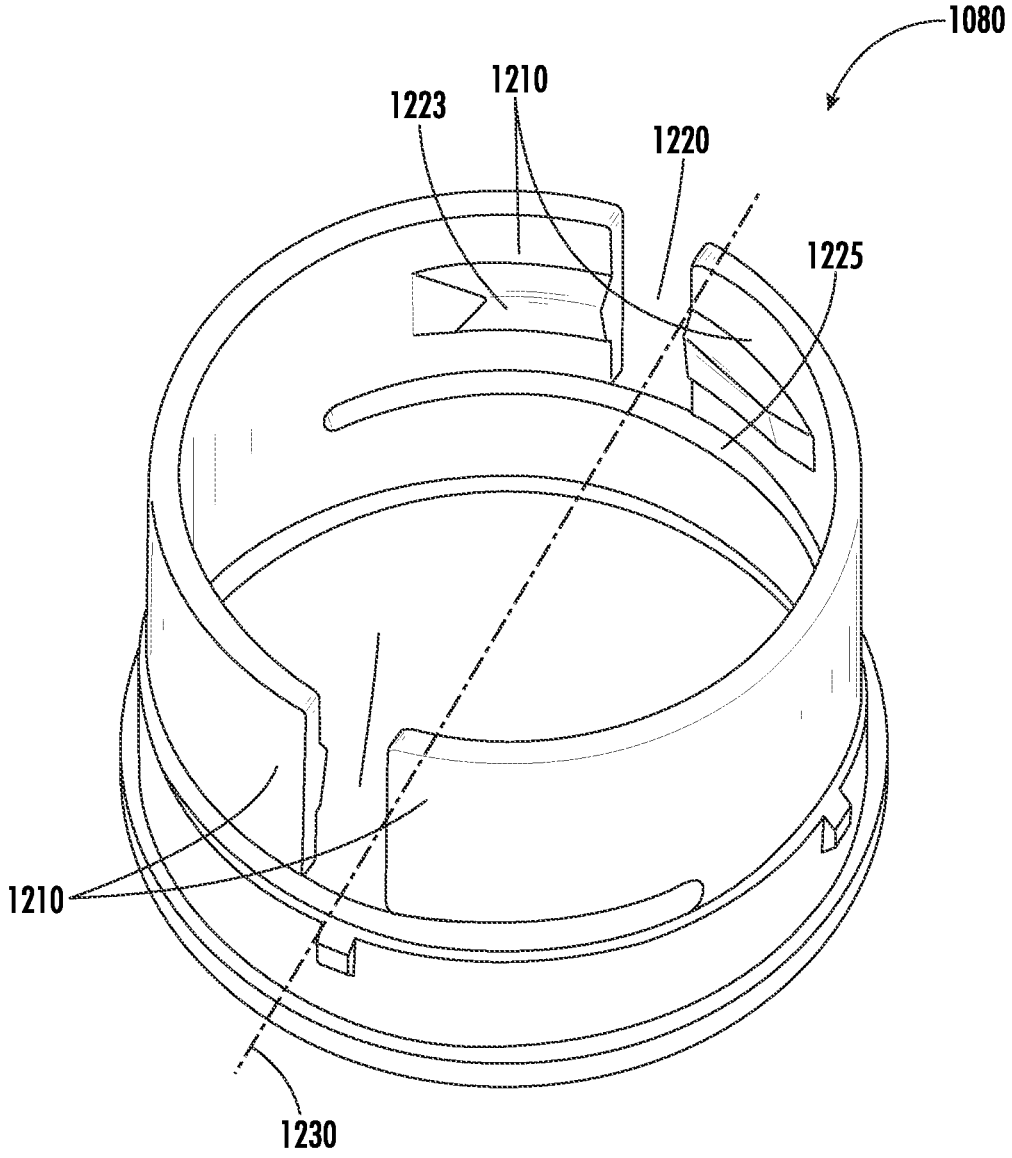
FIG. 36 is a perspective view of a receiving clip of FIG. 35, according to an example embodiment.
Figure 37:
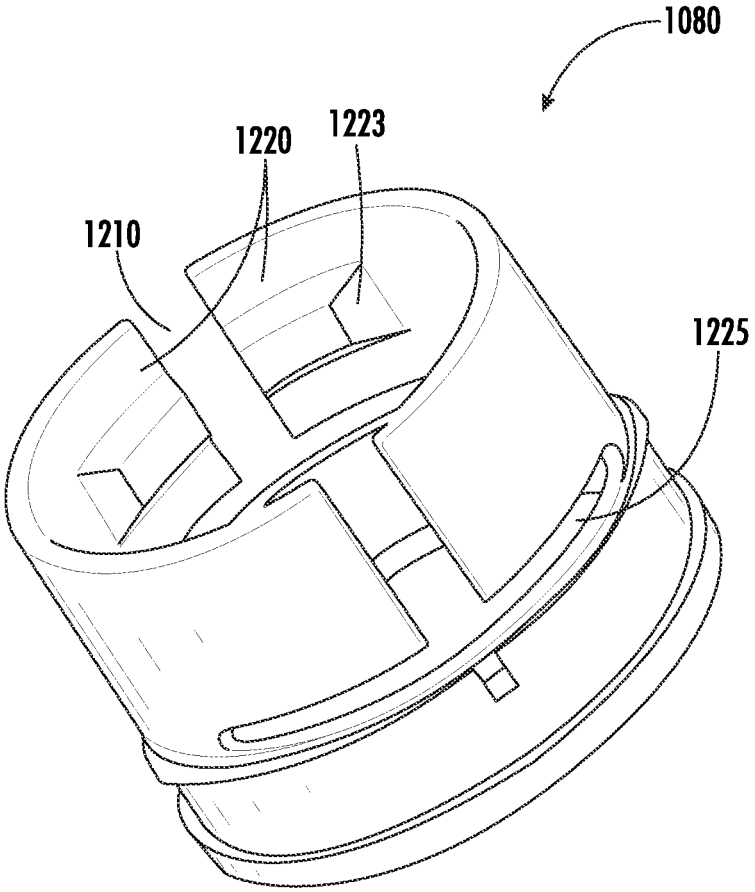
FIG. 37 is a perspective view of the receiving clip of FIG. 36, according to an example embodiment.

Referring to FIGS. 35-37, the receiving clip 1080 may have a generally annular structure (i.e., an annular base) with several openings in the annular base, shown as receiving apertures 1220 and tab slots 1225, which intersect to form opposing "T-shaped" openings on opposite sides of the receiving clip 1080. The receiving clip 1080 includes one or more tabs 1210, shown as the portions of the annular base adjacent to the intersections of the "T-shaped" openings. The one or more tabs 1210 are annularly provided and configured to be selectively repositionable between a flexed position and a non-flexed position. The one or more tabs 1210 may abut the conical nut 1090, when the nozzle 1020 is in the non-flexed position. Furthermore, the one or more tabs 1210 may be biased toward the retracted positon. By way of example, when the nozzle 1020 is selectively repositioned between the non-flexed positon and the flexed position, the conical nut 1090 provides an outward force onto the one or more tabs 1210 to move the one or more tabs 1210 into the flexed position. In some embodiments, the nozzle 1020 may undergo a rotational force prior to being selectively repositioned between the non-flexed position and the flexed position.

The receiving clip 1080 may further include one or more protrusions, shown as protrusion 1223. The protrusion 1223 may extend inward from the one or more tabs 1210 and further be laterally provided within the receiving clip 1080. In other embodiments, the protrusion 1223 may extend outward from the one or more tabs 1210. The protrusion 1223 may selectively engage the conical nut 1090, when the conical nut 1090 is being selectively engaged within the receiving clip 1080. As can be appreciated, when the conical nut 1090 is engaged within the receiving clip 1080, the protrusion 1223 engages the conical nut 1090 proximate at least one of the angular portions (e.g., angular portions 1240*a*, 1240*b* in FIG. 38) to hold the conical nut 1090 in the engaged position.

As shown in FIGS. 36 and 37, the receiving clip 1080 includes four tabs 1210. To be more precise, the receiving clip 1080 includes two sets of tabs 1210, where the individual tabs in each of the sets of tabs 1210 are positioned adjacent one another. Positioned between the individual tabs, in each set of tabs, is a receiving aperture 1220. The receiving apertures 1220 may promote the sets of tabs 1210 to be selectively repositionable into the flexed position. In other embodiments, the receiving apertures 1220 may be removed, where the material is positioned between the individual tabs. In such an embodiment, the sets of tabs 1210 may still be selectively repositionable between the non-flexed position and the flexed position. The receiving clip 1080 may further include a slot, aperture, etc., shown as tab slot 1225. The tab slot 1225 may be extend substantially perpendicular from the receiving aperture 1220 and be annularly disposed along the receiving clip 1080. The tab slot 1225 may be positioned distal an end of the receiving clip 1080. As can be appreciated, the one or more tabs 1210 may be coupled to a body of the receiving clip 1080 on one side of the one or more tabs 1210. In other embodiments, the one or more tabs 1210 may be coupled to the body of the receiving clip 1080 on more than one side of the one or more tabs 1210.

When the nozzle 1020 may be selectively repositionable between the non-flexed position and the flexed position, the conical nut 1090 may provide an outward force on the one or more tabs 1210 to allow the conical nut 1090 to be moved out of engagement with the receiving clip 1080. According to an exemplary embodiment, the one or more tabs 1210 may flex proximate the receiving apertures 1220 to allow the conical nut 1090 to be removed. In other embodiments, the receiving clip 1080 may flex about a location distal the receiving apertures 1220.

The receiving clip 1080 may be manufactured out of a plastic material, where the plastic material may include a high elasticity. As can be appreciated, a high elasticity may allow the one or more tabs 1210 to be selectively repositioned between the non-flexed position and the flexed position without incurring a high stress or a high material degradation. In other embodiments, the receiving clip 1080 may be manufactured out of an alternate material such as metal, composite, polymer, carbon fiber, or the like.

Referring still to FIGS. 36 and 37, the receiving clip 1080 may include a lateral axis 1230, extending through at least one of the receiving apertures 1220. The lateral axis 1230 may further extend through a midpoint of the receiving apertures 1220. By way of example, the lateral axis 1230 may be disposed through a midpoint of both the receiving apertures 1220, where the sets of tabs 1210 may further be further be symmetrically provided. The lateral axis 1230 may separate the receiving clip 1080 into two portions, where each of the two portions are substantially similar to one another.

Figure 38:
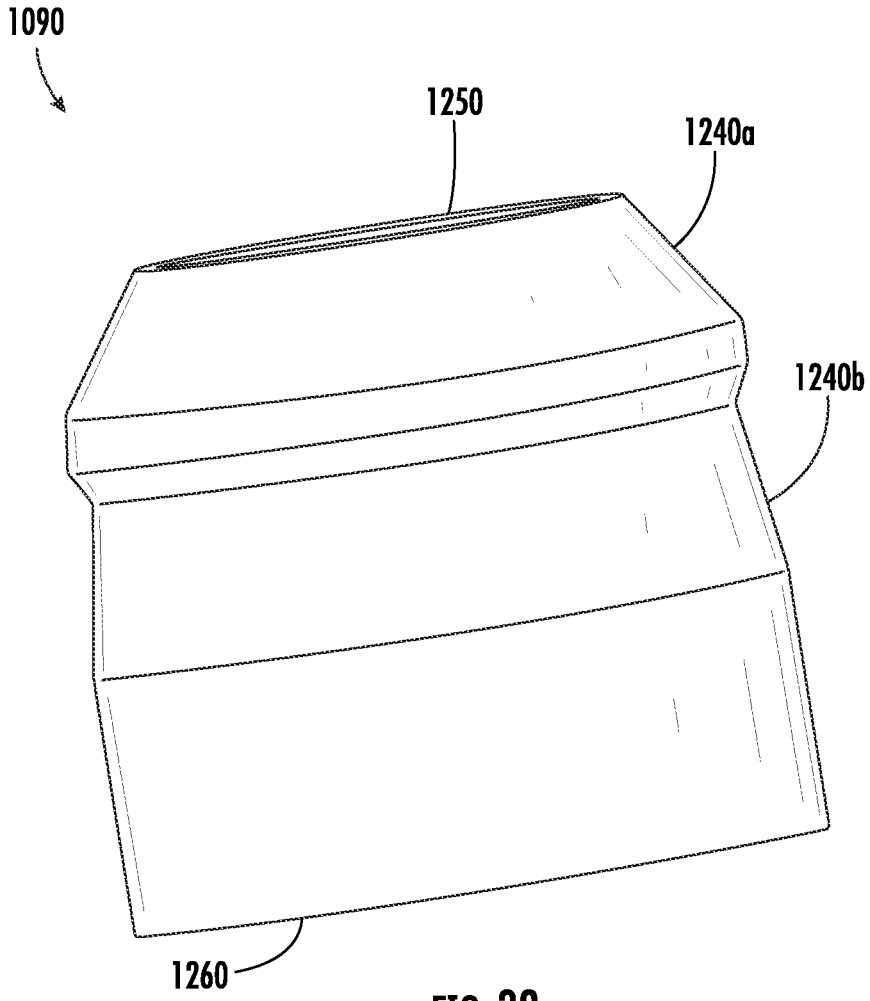
FIG. 38 is a perspective view of a conical nut of FIG. 35, according to an example embodiment.

Referring to FIG. 38, the conical nut 1090 includes one or more angular portions, shown as first angular portion 1240*a* and second angular portion 1240*b*. The angular portions 1240*a*, 1240*b* may be angled substantially inward, where the receiving apertures 1220 are positioned outward when the conical nut 1090 is inserted into the receiving clip 1080. By way of example, the angular portions 1240*a*, 1240*b* may define a substantially different angles compared to a vertical axis. In other embodiments, the angled portions 1240*a*, 1240*b* may define substantially the same angles compared to the vertical axis.

The conical nut 1090 may further include one or more openings, shown as first opening 1250 and second opening 1260. The openings 1250, 1260 may be configured to receive components of the faucet 1000 therethrough. By way of example, the internal waterway 1040 may be disposed through the first opening 1250 and at least a portion of the nozzle 1020 may be disposed through the second opening. The conical nut 1090 may further include an engagement interface (e.g., threads, etc.), where the nozzle 1020 may couple to the conical nut 1090. As can be appreciated, the conical nut 1090 may be coupled to the nozzle 1020 by threading the conical nut 1090 onto the nozzle 1020.

Figure 39:
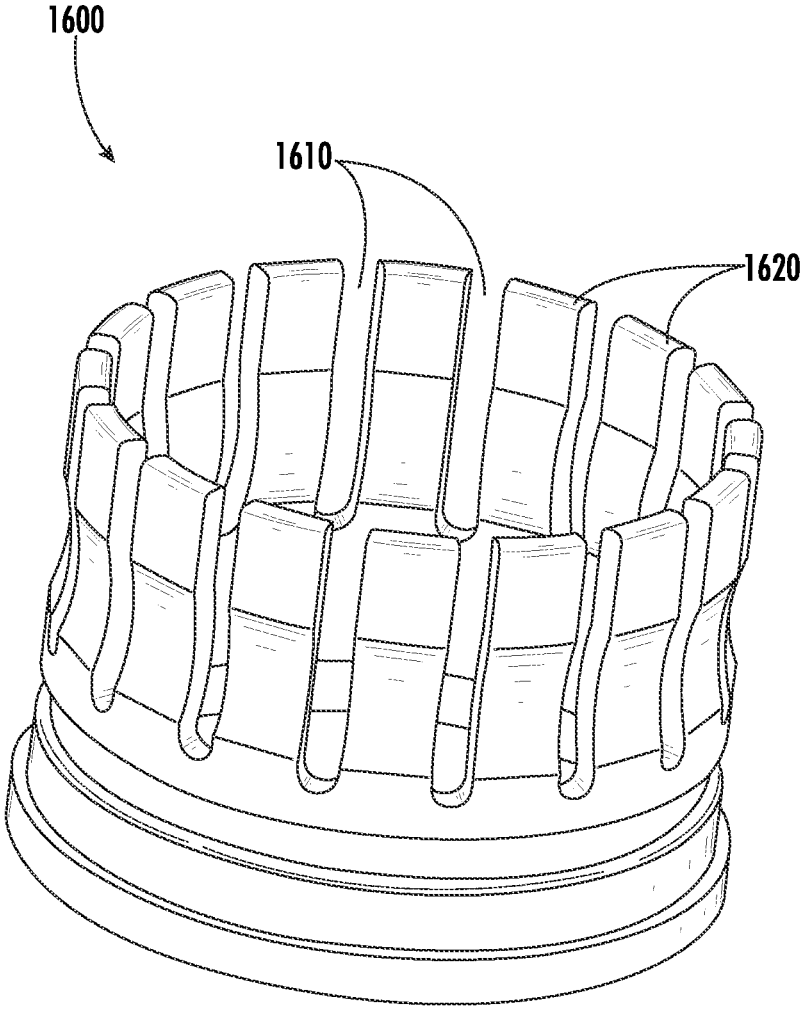
FIG. 39 is a perspective view of a receiving clip, according to an example embodiment.
Figure 40:
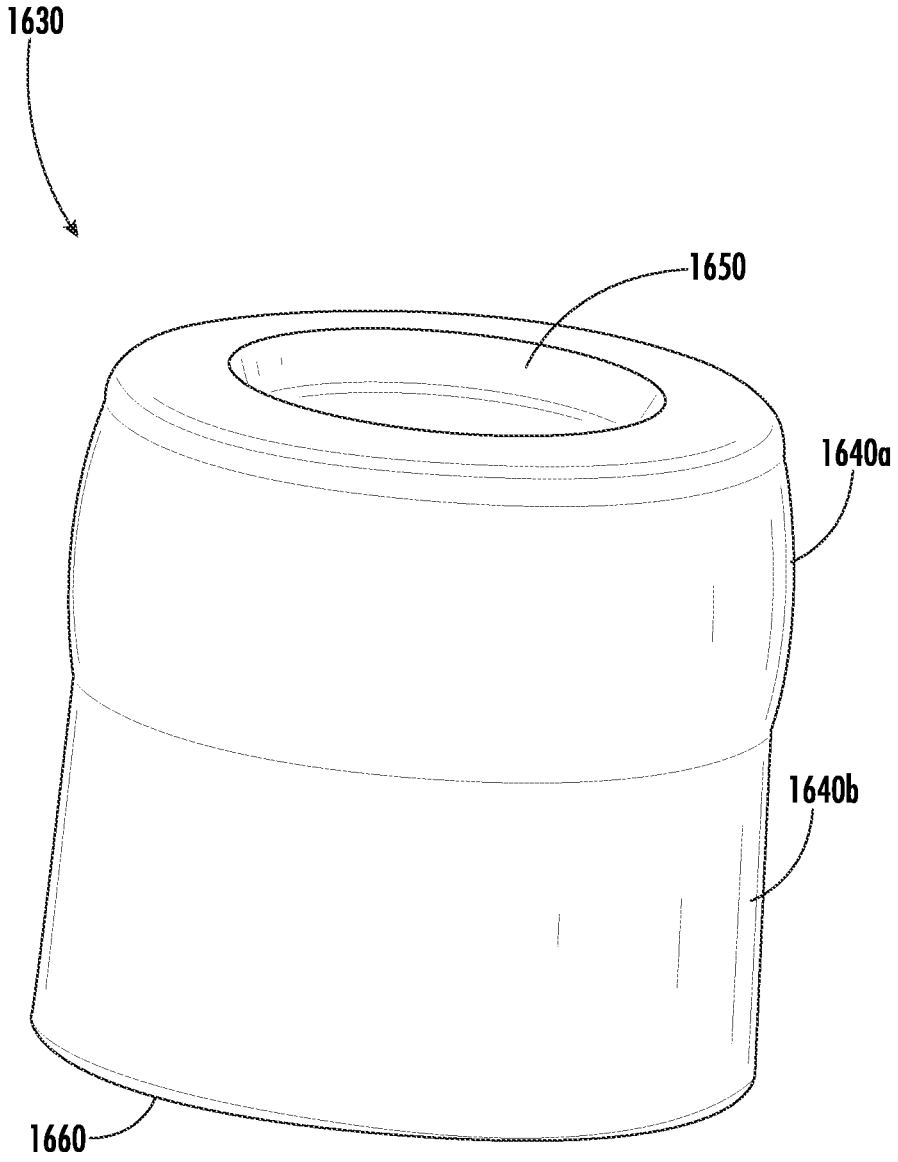
FIG. 40 is a perspective view of a conical nut, according to an example embodiment.

Referring now to FIGS. 39 and 40, a mounting assembly is shown, according to an alternate embodiment. The mounting assembly may be substantially similar to the mounting assembly 1070, and, as such, like components may be used to describe the mounting assembly. The mounting assembly includes a receiving clip 1600 and a conical nut 1630.

The receiving clip 1600 may include one or more openings, apertures, or the like, shown as receiving apertures 1610. The receiving apertures 1610 may be positioned between one or more sets of tabs, shown as tabs 1620. The receiving apertures 1610 may separate the tabs 1620 such that the tabs 1620 may flex between a normal position and an flexed position. As can be appreciated, each receiving aperture 1610 may have a corresponding receiving aperture 1610 positioned opposite along the receiving clip 1600.

The conical nut 1630 may include a first surface 1640*a* and a second surface 1640*b*. The surfaces 1640*a*, 1640*b* may be external surfaces that engage the tabs 1620. When the conical nut 1630 is received within the receiving clip 1630, the surfaces 1640*a*, 1640*b* flex the tabs 1620 into the flexed position, such to hold the conical nut 1630 within the receiving clip 1600. The conical nut 1630 further includes one or more openings, shown as first opening 1640 and second opening 1650. The first opening 1640 and the second opening 1650 may be positioned proximate a midpoint of the conical nut 1630 and wholly extend through the conical nut 1630. Accordingly, a flow of water or water transport device may be provided therein to facilitate a flow of water through a faucet.

Figure 41:
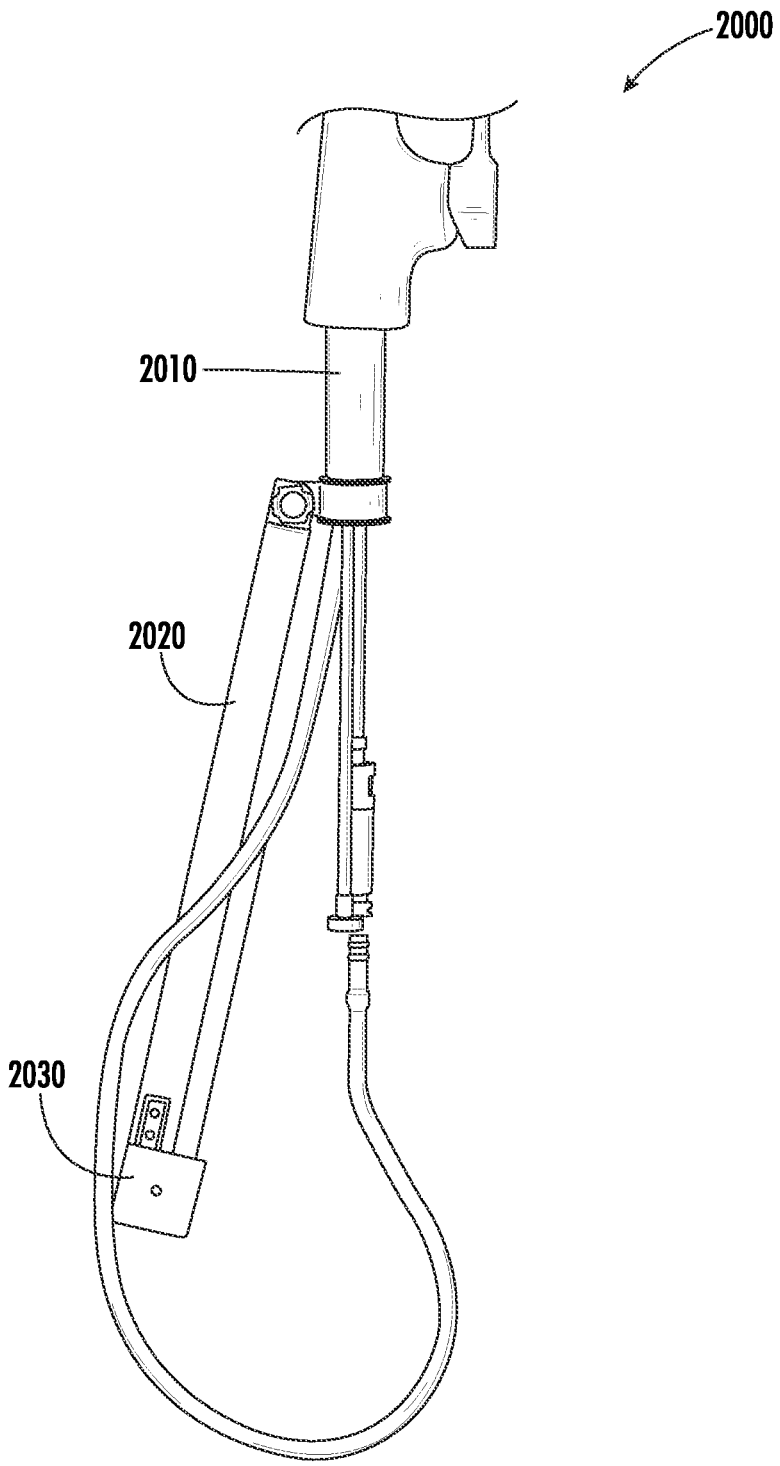
FIG. 41 is a front view of a shank mounted retraction assembly, according to an example embodiment.

Referring now to FIG. 41, a front view of a shank mounted retraction assembly, shown as retraction assembly 2000, is shown, according to an exemplary embodiment. The retraction assembly 2000 may be configured for use in kitchen, bathroom, or shower environments, where a faucet head may be pulled out of a seated position. In other embodiments, the retraction assembly 2000 may be used in applications other than kitchen, bathroom, or shower environments. The retraction assembly 2000 may include (i) a faucet shank, shank, etc., shown as shank 2010, (ii) a bar, pole, elongated member, member, etc., shown as member 2020, and (iii) a retraction device 2030. When assembled, the retraction assembly 2000 may be a rigid structure configured to maintain a fixed position upon use. In other embodiments, the retraction assembly 2000 may not be a rigid structure. The shank 2010 may be a member extending downward from a faucet in a vertical direction. By way of example, the shank 2010 may extend below a neutral surface of the faucet, such that the shank 2010 may be accessible from a positioned below the faucet.

Figure 42:
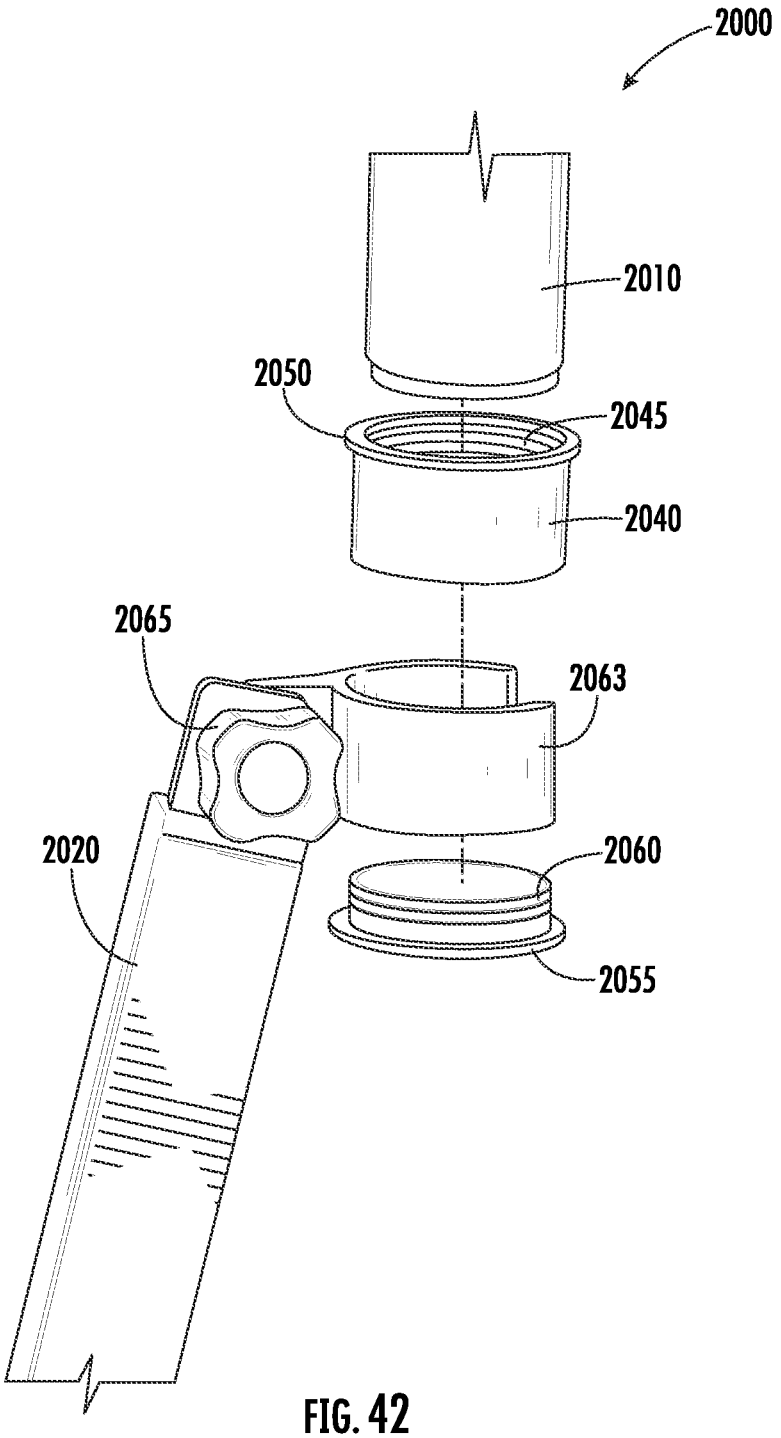
FIG. 42 is a detailed view of the shank mount of FIG. 41, according to an example embodiment.

Referring now to FIG. 42, retraction assembly 2000 may further include a coupling, cap, etc., shown as coupling 2040. The coupling 2040 may be coupled to an end of the shank 2010. In other embodiments, the coupling 2040 may be omitted and the shank 2010 may display a structure substantially similar to the coupling 2040. The coupling 2040 may be an annular structure having a smooth outer surface and an inner surface including an engagement structure 2045. The engagement structure 2045 may be a threaded structure, ribbed structure, barbed structure, or the like. By way of example, the inner surface is a threaded surface, where the coupling 2040 may be threadably coupled to an end of the shank 2010. The engagement structure 2045 may be disposed along the entirety of the coupling 2040. In other embodiments, the engagement structure 2045 may be provided only along a portion of the coupling 2040. The coupling 2040 may include a ridge, lip, protrusion, shown as outer edge 2050. The outer edge 2050 may be a lip positioned on a first end of the coupling 2040 and protruding radially outward from the coupling 2040. The outer edge 2050 may further define a first diameter and the smooth outer surface may define a second diameter, where the first diameter is greater than the second diameter. In other embodiments, the first diameter is less than the second diameter. The coupling 2040 may receive a cap 2055, at a second end of the coupling 2040. The cap 2055 may be a cap threadably coupled to the coupling 2040. By way of example, the cap 2055 may include an engagement structure 2060, where the engagement structure 2060 is substantially similar to that of the engagement structure 2045. The cap 2055 may be threadably coupled to a second end of the coupling 2040.

The member 2020 may be coupled to a bracket 2063. The bracket 2063 may define a structure substantially similar to that of the coupling 2040. The bracket 2063 may include a smooth inner surface, where the smooth inner surface has a third diameter. The third diameter may be between the first diameter and the second diameter. As can be appreciated, the bracket 2063 may slide onto the coupling 2040, without the cap 2055 engaged. Once the bracket 2063 is positioned over the coupling 2040, the cap 2055 may be threadably coupled to the coupling 2040 to secure the bracket 2063 onto the coupling 2040. The member 2020 may be coupled to the bracket 2063 by a tightening fastener, shown as knob 2065. The knob 2065 may be selectively repositionable between a tightened position and a loosened position. In the tightened position, the member 2020 may be rigidly held such that the member 2020 may not pivot about the knob 2065. In the loosened position, the member 2020 may be able to pivot about the tightening fastener such to reposition the member 2020. The member 2020 may be angularly offset from the shank 2010. The member 2020 may be positioned 1 degree, 5 degrees, 10 degrees, 15 degrees, 20, degrees, 25 degrees, 30 degrees, 35 degrees, 40, degrees, 45 degrees, etc. from the shank 2010. In other embodiments, the member 2020 may be angularly offset from a horizontal axis from the shank 2010.

The bracket 2063 may provide rotational adjustability to the member 2020 and the knob 2065 may provide angular adjustability to the member 2020. As can be appreciated, the amount of rotational adjustability and angular adjustability may be any amount needed to avoid obstructions beneath the faucet.

Figure 43:
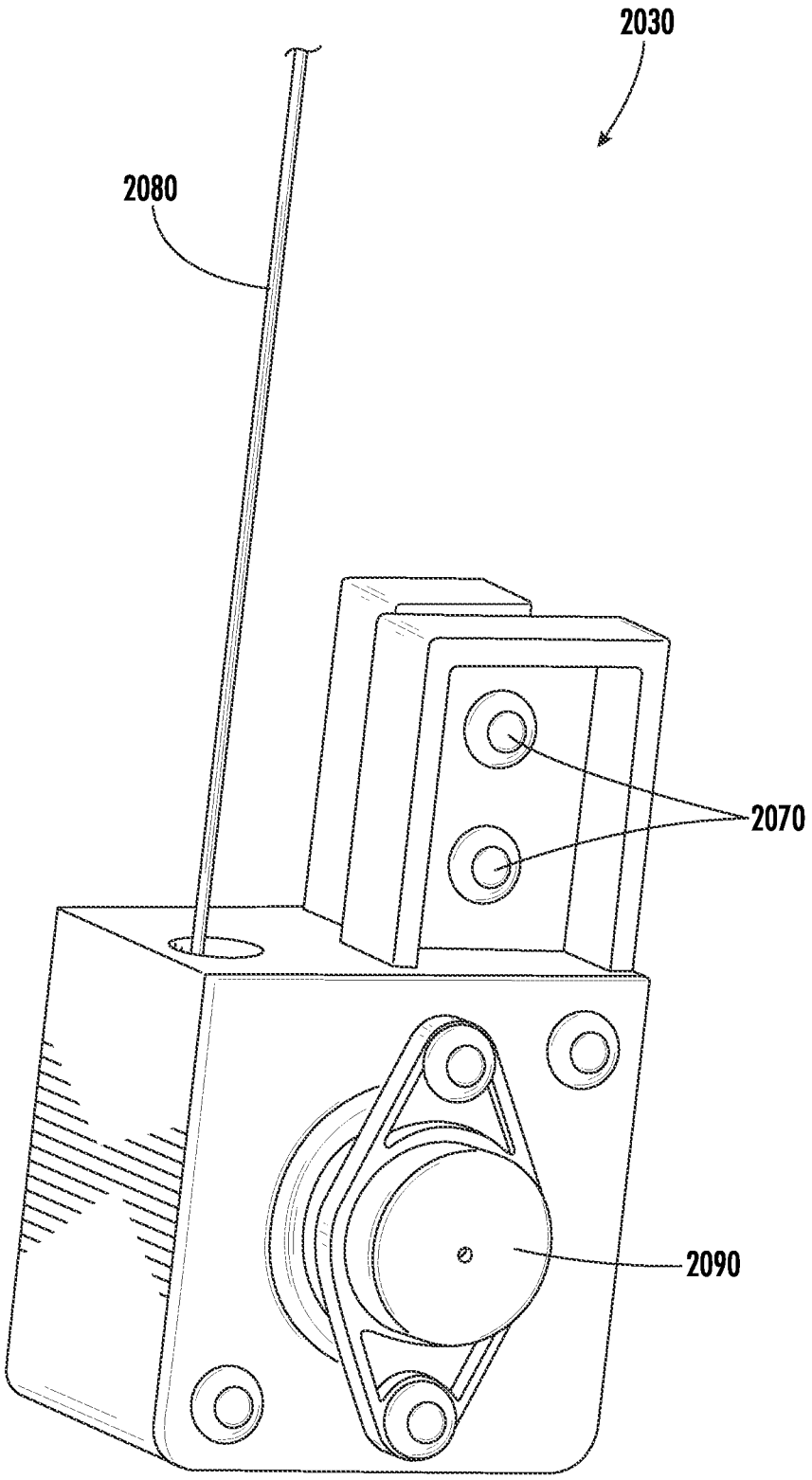
FIG. 43 is a perspective view of a retraction device of FIG. 41, according to an example embodiment.

Referring now to FIG. 43, the retraction device 2030 may be coupled to the member 2020 at an end distal the bracket 2063. In other embodiments, the retraction device 2030 may be coupled to the member 2020 at an end proximate the bracket 2063. The retraction device 2030 may be coupled to the member 2020 via one or more apertures 2070. The one or more apertures 2070 may be through holes configured to receive a fastener therethrough. The retraction device 2030 may be configured to retract a hose of the faucet once the user has pulled the nozzle out of a seated position. The retraction device 2030 may include a wire 2080, where the wire 2080 is coupled to the retraction device 2030 and the hose, nozzle, and/or faucet. The retraction device 2030 may further include a rotary damper 2090 positioned on one side of the retraction device 2030. The rotary damper 2090 may be a one-direction rotary damper configured to wind and unwind the wire 2080. In other embodiments, the rotary damper 2090 may be a dual-direction rotary damper configured to wind and unwind the wire 2080.

Figure 44:
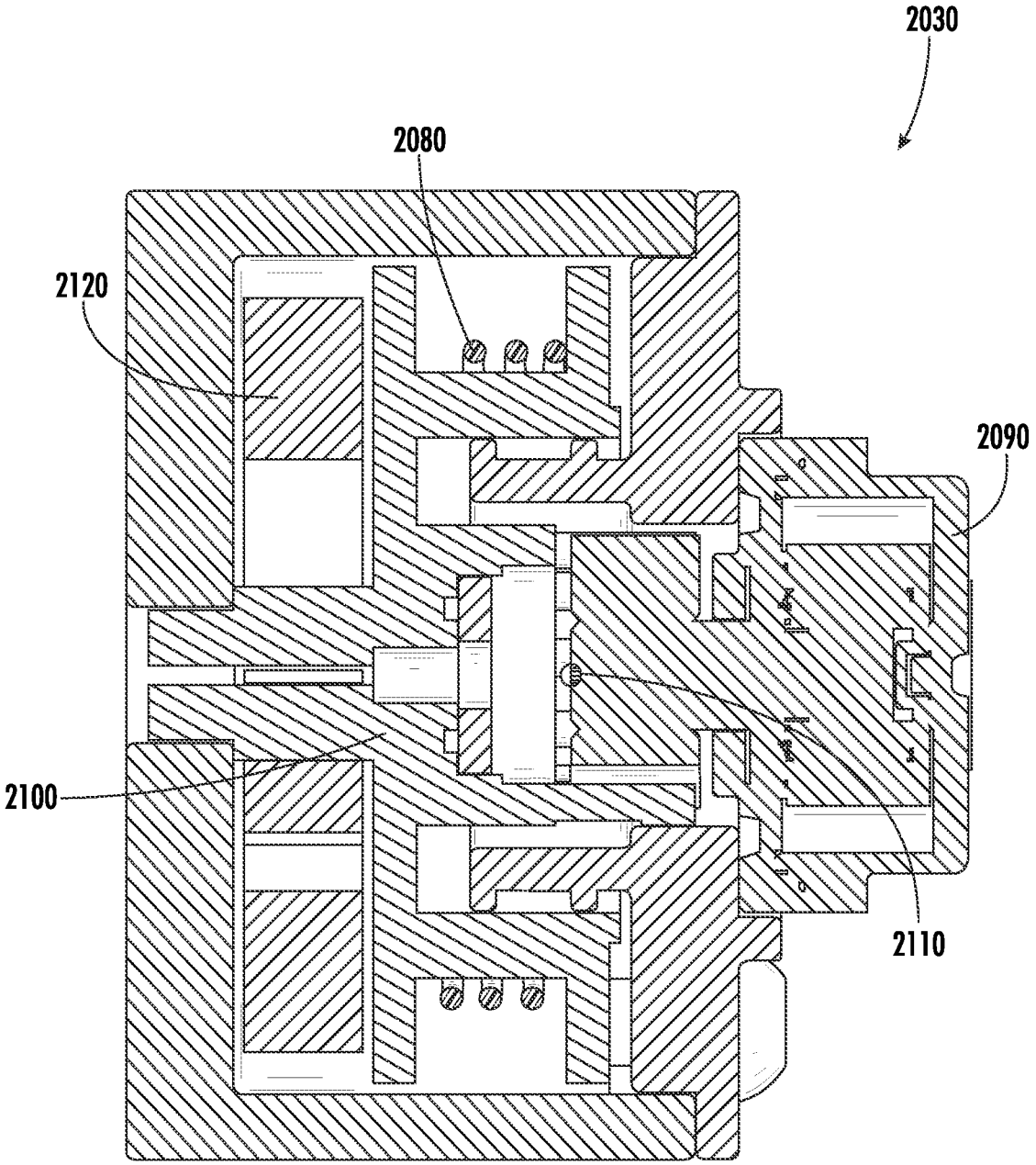
FIG. 44 is a detailed side view of the retraction device of FIG. 42, according to an example embodiment.

Referring now to FIG. 44, the retraction device 2030 may further include (i) a spool 2100, (ii) a coupling mechanism 2110, and (iii) a spring 2120. The spool 2100 may be an annular spool configured to receive the wire 2080 and hold the wire 2080 in an annular fashion. The spool 2100 may be coupled to the rotary damper 2090 via the coupling mechanism 2110. The coupling mechanism 2110 may be an inserted mechanism, where the spool 2100 receives the rotary damper 2090. The rotary damper 2090 may be coaxially aligned with the spool 2100, where the spool 2100 rotates about a central axis. By way of example, the rotary damper 2090 may maintain constant engagement with the spool 2100 via the coupling mechanism 2110 such to provide a slow retrieve of the wire 2080. The spring 2120 may be coupled to the spool 2100 and configured to bias the spool 2100 in a first direction. The spring 2120 may be positioned distal the rotary damper 2090, where the rotary damper 2090 and the spring 2120 may operate in a coordinated fashion such to provide a slow close/slow retrieve of the wire 2080.

Figure 45:
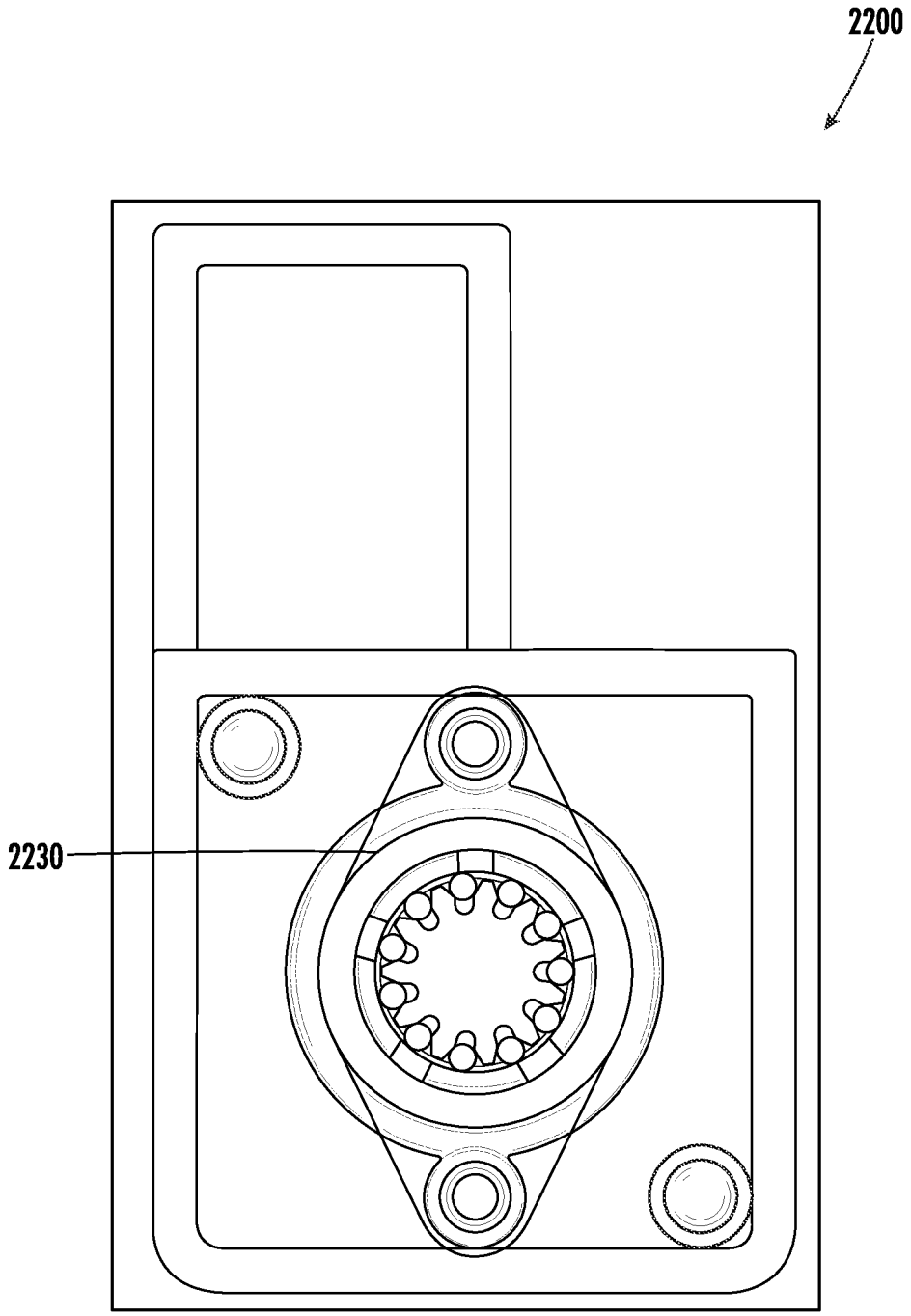
FIG. 45 is a front view of a retraction device, according to an example embodiment.
Figure 46:
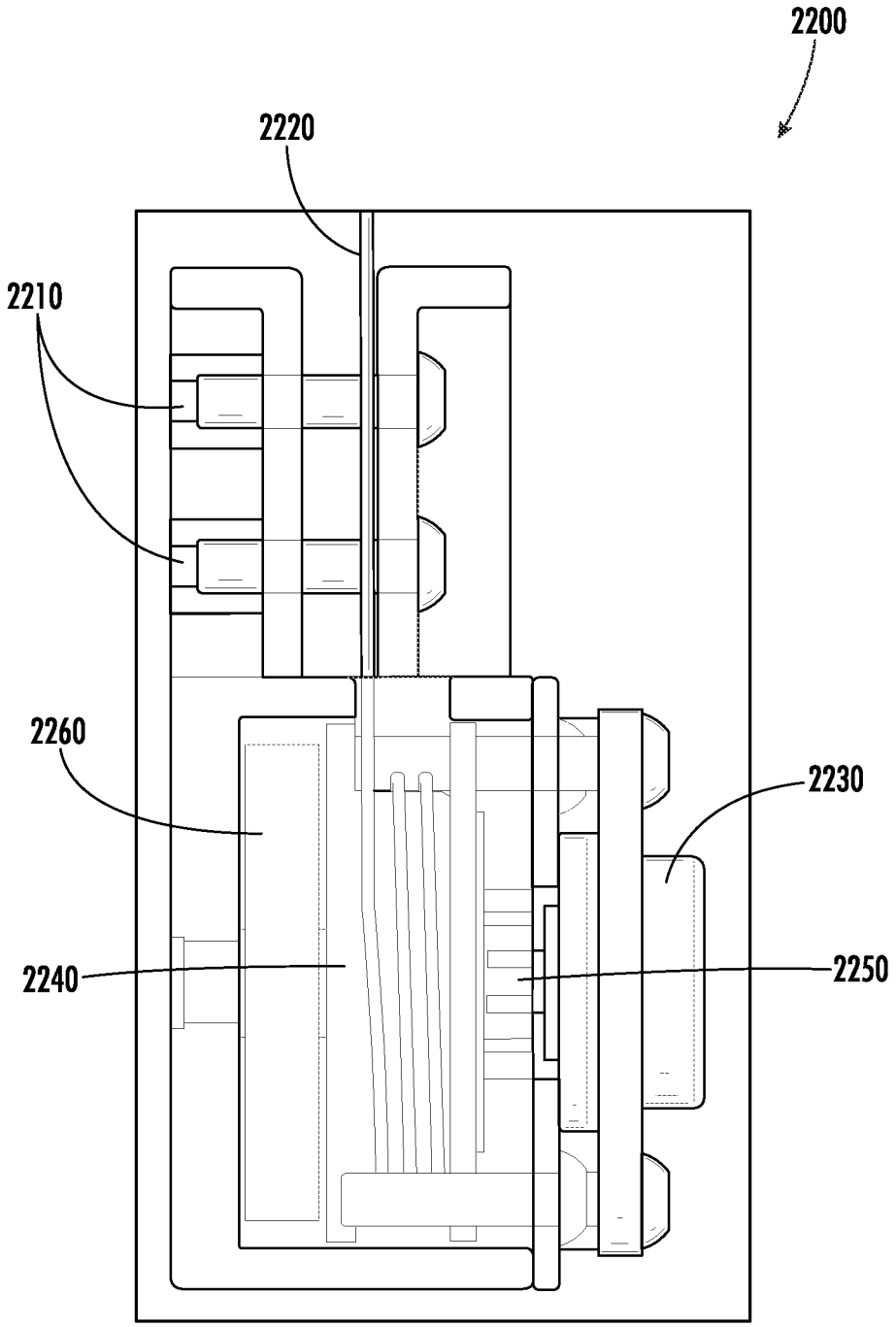
FIG. 46 is a rear view of the retraction device of FIG. 45, according to an example embodiment.
Figure 47:
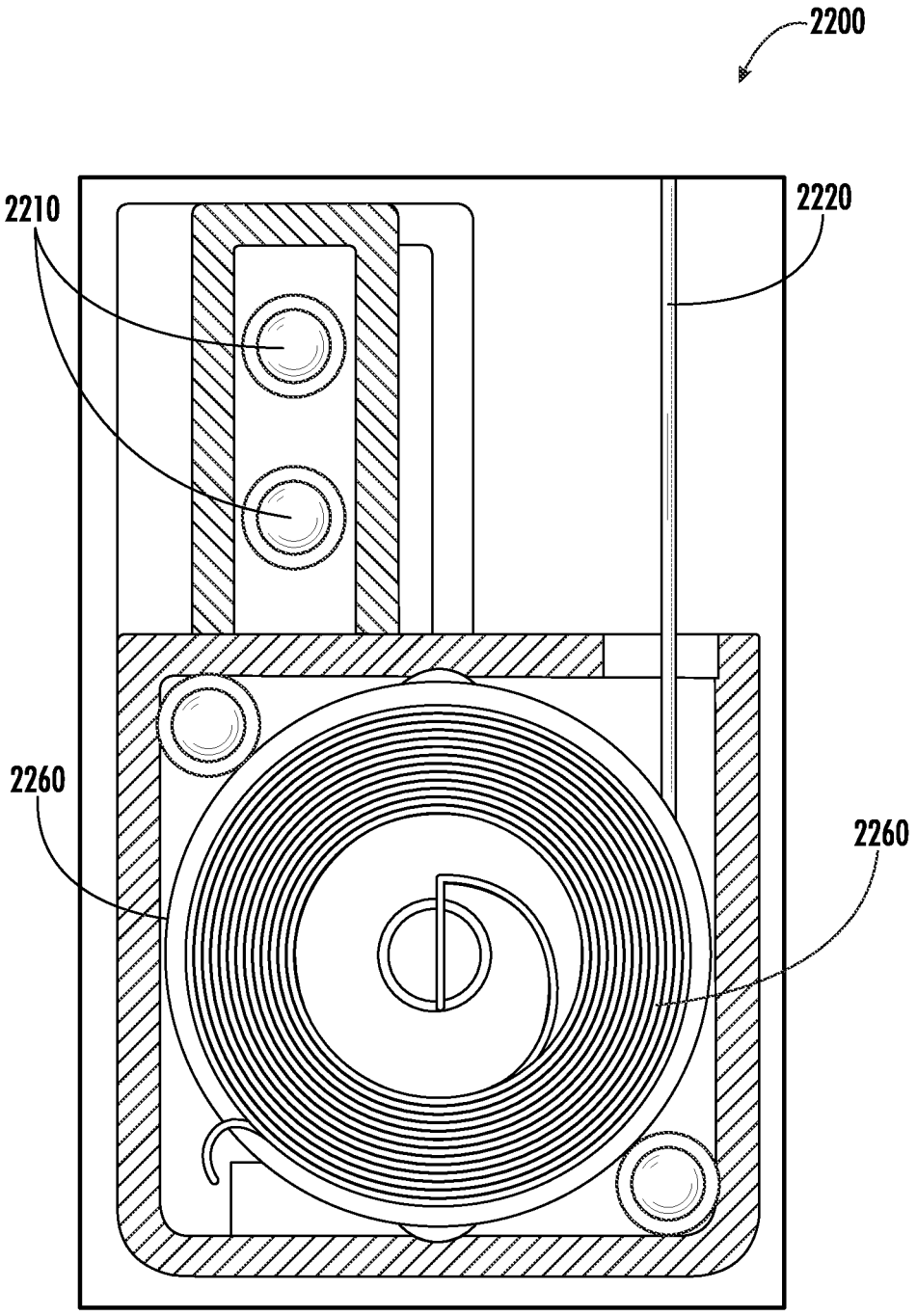
FIG. 47 is a detailed side view of the retraction device of FIG. 45, according to an example embodiment

Referring now to FIGS. 45-47, a retraction device 2200 may be coupled to the member 2020 at an end distal the bracket 2063. The retraction device 2200 may be substantially similar to the retraction device 2030 such that like components may be used to describe the retraction device 2200. The retraction device 2200 may be coupled to the member 2020 via one or more apertures 2210. The one or more apertures 2210 may be through holes configured to receive a fastener therethrough. The retraction device 2200 may be configured to retract a hose of the faucet once the user has pulled the nozzle out of a seated position. The retraction device 2200 may include a wire 2220, where the wire 2220 is coupled to the retraction device 2030 and the hose, nozzle, and/or faucet. The retraction device 2200 may further include a rotary damper 2230 positioned on one side of the retraction device 2200. The rotary damper 2230 may be a one-direction rotary damper configured to wind and unwind the wire 2220. In other embodiments, the rotary damper 2230 may be a dual-direction rotary damper configured to wind and unwind the wire 2220.

The retraction device 2030 may further include (i) a spool 2240, (ii) a coupling mechanism 2250, and (iii) a spring 2260. The spool 2240 may be an annular spool configured to receive the wire 2220 and hold the wire 2220 in an annular fashion. The spool 2240 may be coupled to the rotary damper 2230 via the coupling mechanism 2250. The coupling mechanism 2250 may be an inserted mechanism, where the spool 2240 receives the rotary damper 2230. The rotary damper 2230 may be coaxially aligned with the spool 2240, where the spool 2240 rotates about a central axis. By way of example, the rotary damper 2230 may maintain constant engagement with the spool 2240 via the coupling mechanism 2250 such to provide a slow retrieve of the wire 2220. The spring 2260 may be coupled to the spool 2240 and configured to bias the spool 2240 in a first direction. The spring 2260 may be positioned distal the rotary damper 2090, where the rotary damper 2230 and the spring 2260 may operate in a coordinated fashion such to provide a slow close/slow retrieve of the wire 2220.

Referring generally to FIGS. 48-56, a hose retraction assembly 2300 having a slow close assembly 2350 is disclosed, according to various embodiments. The hose retraction assembly 2300 is configured to facilitate the extension and retraction of a spray head (such as the spray head 106, which will be referred to herein in the interest of consistency). When the spray head 106 is in the retracted (e.g., docked) position, the user may pull on the spray head 106, which pulls on the hose 136, which pulls on a portion of the hose retraction assembly 2300. The hose retraction assembly 2300 may be positioned below the faucet 100. In some embodiments, such as when the faucet 100 is coupled with a first surface 170 (e.g., countertop or other substantially horizontal surface), the hose retraction assembly 2300 may be positioned underneath the first surface 170 (e.g., on the opposite side of the first surface 170 to the spray head 106). In some embodiments, the hose retraction assembly 2300 may be integrated, partially or entirely, into the spout 104 of the faucet 100.

The hose retraction assembly 2300 includes a rail 2302, a bracket assembly 2304, and a weight 2306 coupled with the bracket assembly 2304. The bracket assembly 2304 is slidably coupled with the rail 2302 such that the bracket assembly 2304 may be selectively positioned between a first rail end 2310 and a second rail end 2312 of the rail 2302. The weight 2306 is operatively coupled with the bracket assembly 2304 such that the weight 2306 applies a first force to the bracket assembly 2304 in a direction along the rail 2302 and toward the second rail end 2312. The bracket assembly 2304 is further coupled with the hose 136 such that movement of the hose 136 translates to movement of the bracket assembly 2304. When the user engages with the faucet 100 to extend the hose 136, the bracket assembly 2304 is slid along the rail 2302 toward the first rail end 2310. When the user engages with the faucet 100 to retract the hose 136, the bracket assembly 2304 slides toward the second rail end 2312. In some embodiments, the hose 136 may retract automatically if the spray head 106 is released from an external force (e.g., being held by a user). The weight 2306 applies the first force to the bracket assembly 2304 toward the second rail end 2312 which causes the bracket assembly 2304 to slide toward the second rail end 2312 and causes retraction of the hose 136. In some embodiments, limit stops are positioned proximate to the first rail end 2310 and the second rail end 2312 to engage with the bracket assembly 2304 and prevent the bracket assembly 2304 from sliding beyond the first rail end 2310 or the second rail end 2312 during regular use.

In some embodiments, a mounting bracket 2314 is coupled to the rail 2302 at the first rail end 2310 and is configured for coupling with at least one of the shank 130, the base 102, and the first surface 170. The mounting bracket 2314 may be coupled to the faucet 100 using adhesives, threaded couplings, fasteners, latches, and the like. In some embodiments, the rail 2302 is coupled to a surface under the faucet 100, such as a wall or cabinet, such that the rail 2302 is not directly coupled to the faucet 100. In some embodiments, the rail 2302 is positioned away from the faucet 100 such that the mounting bracket 2314 is not coupled with the faucet 100.

Figure 48:
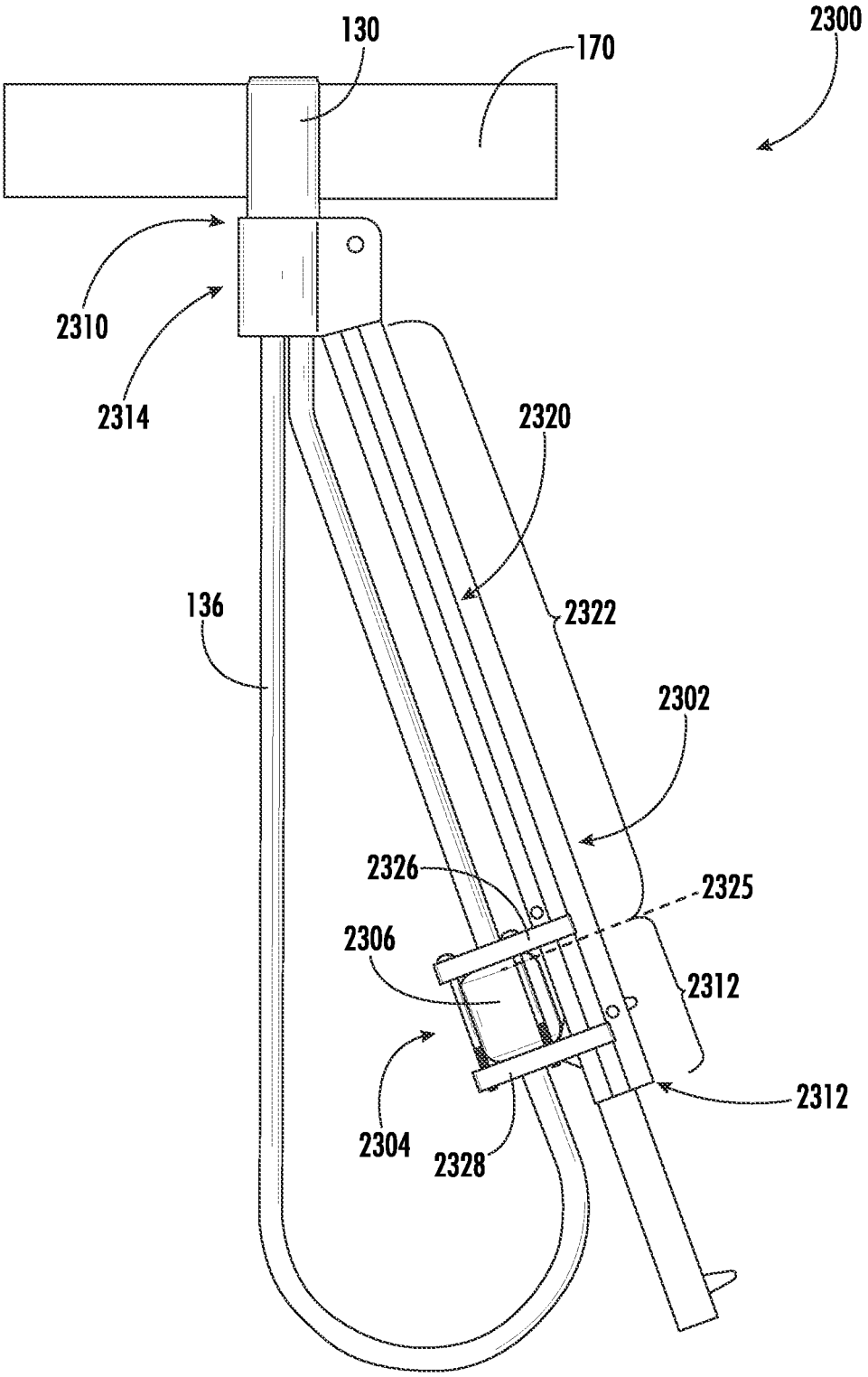
FIG. 48 is a front view of a spray head retraction assembly, according to an example embodiment.
Figure 49:
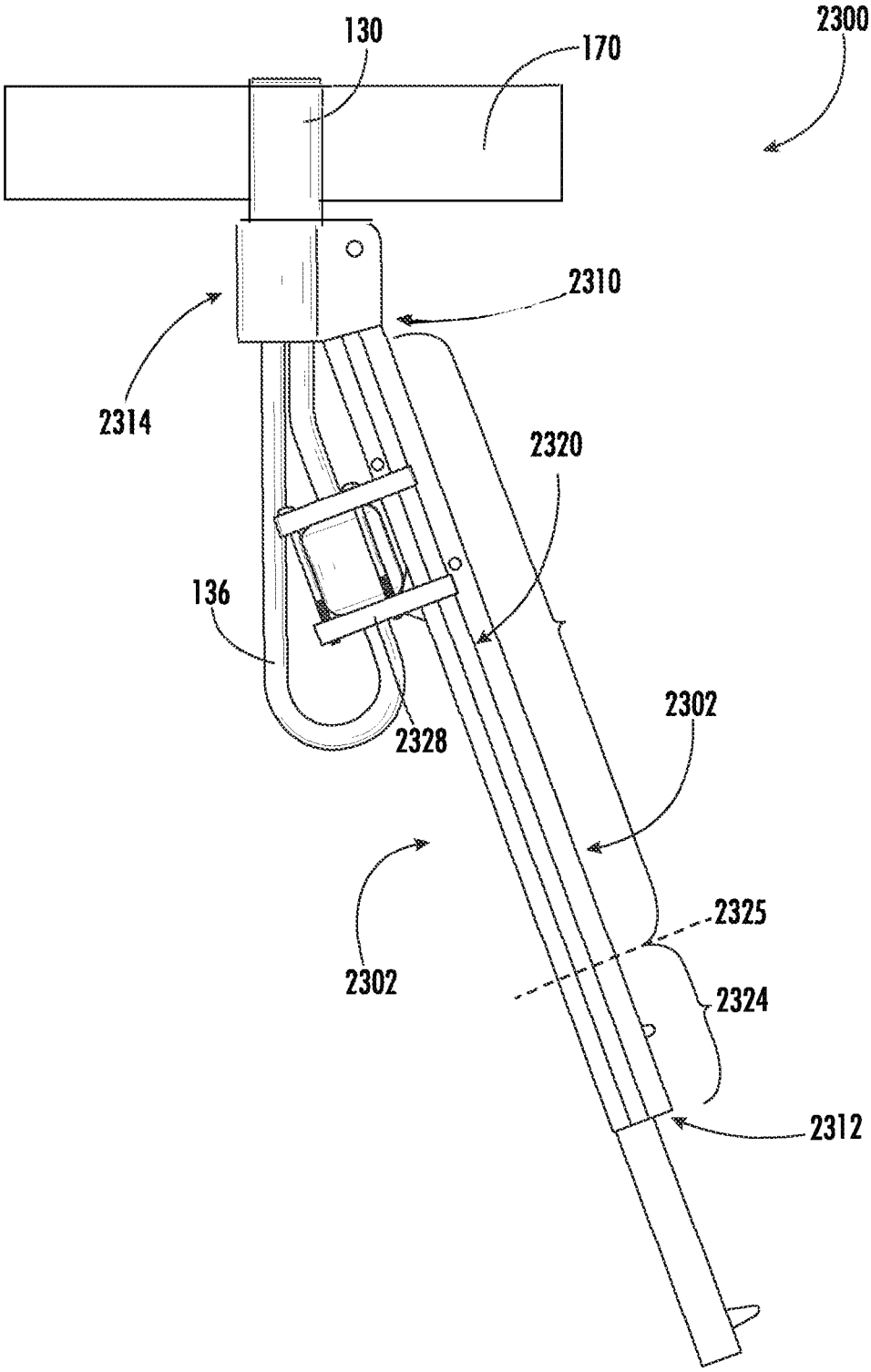
FIG. 49 is a front view of the spray head retraction assembly of FIG. 48, according to an example embodiment.

Extending into the rail 2302 is a channel 2320. The channel 2320 extends lengthwise along the rail 2302 between the first rail end 2310 and the second rail end 2312. In some embodiments, the channel 2320 is substantially linear, as shown in FIGS. 48 and 49. The channel 2320 engages with the bracket assembly 2304 and facilitates movement of the bracket assembly 2304 along the rail 2302. In some embodiments, a portion of the bracket assembly 2304 extends into the channel 2320. As the bracket assembly 2304 slides between the first rail end 2310 and the second rail end 2312, the bracket assembly 2304 remains engaged with the channel 2320.

The channel 2320 includes a first channel portion 2322 and a second channel portion 2324. The first channel portion 2322 is part of the channel 2320 and extends between the first rail end 2310 and the second channel portion 2324. The second channel portion 2324 is part of the channel 2320 and extends between the second rail end 2312 and the first channel portion 2322. A border 2325 demarcates a border between the first channel portion 2322 and the second channel portion 2324. The first channel portion 2322 and the second channel portion 2324 are continuous and contiguous with one another. The bracket assembly 2304 having the weight 2306 is positionable along both the first channel portion 2322 and the second channel portion 2324. When the bracket assembly 2304 is positioned within the first channel portion 2322, the weight 2306 applies the first force to the bracket assembly 2304 in a direction toward the second rail end 2312. When the hose retraction assembly 2300 is coupled below a countertop, as shown, gravity acts on the weight 2306 and biases the bracket assembly 2304 toward the second rail end 2312. In some embodiments, the weight 2306 may be replaced with another force applying member, such as a constant force spring, extension spring, compression spring, and the like such that the force of gravity acting upon the bracket assembly 2304 is negligible (e.g., of little consequence) when compared to the first force provided by the force applying member. Thus, the rail 2302 may extend in most any direction, including upwards, relative to the first surface 170 and the shank 130.

The weight 2306 (e.g., force body) applies the first force to the bracket assembly 2304 in a direction toward the second rail end 2312 when the bracket assembly 2304 is positioned at any position between the first rail end 2310 and the second rail end 2312. In other words, the weight 2306 applies the first force to the bracket assembly 2304 when the bracket assembly 2304 is positioned in either of the first channel portion 2322 and the second channel portion 2324.

The bracket assembly 2304 includes a first bracket flange 2326 and a second bracket flange 2328 having a first bracket aperture 2330 extending through both the first bracket flange 2326 and the second bracket flange 2328 and configured to receive the hose 136. In some embodiments, the first bracket flange 2326 and the second bracket flange 2328 are coupled to the hose 136 such that movement of the hose 136 translates to movement of the first bracket flange 2326 and the second bracket flange 2328. As used herein, when referring to whether the bracket assembly 2304 is positioned in one of the first channel portion 2322 and the second channel portion 2324, the positioning of the bracket assembly 2304 is determined by the positioning of the second bracket flange 2328. For example, if the first bracket flange 2326 is positioned in the first channel portion 2322 and the second bracket flange 2328 is positioned in the second channel portion 2324, then the bracket assembly 2304 is said to be disposed within the second channel portion 2324. As will be understood herein, the second bracket flange 2328 is configured for coupling with the slow close assembly 2350 to achieve a slow close (e.g., slow retraction) of the spray head 106 and the hose 136.

Figure 50:
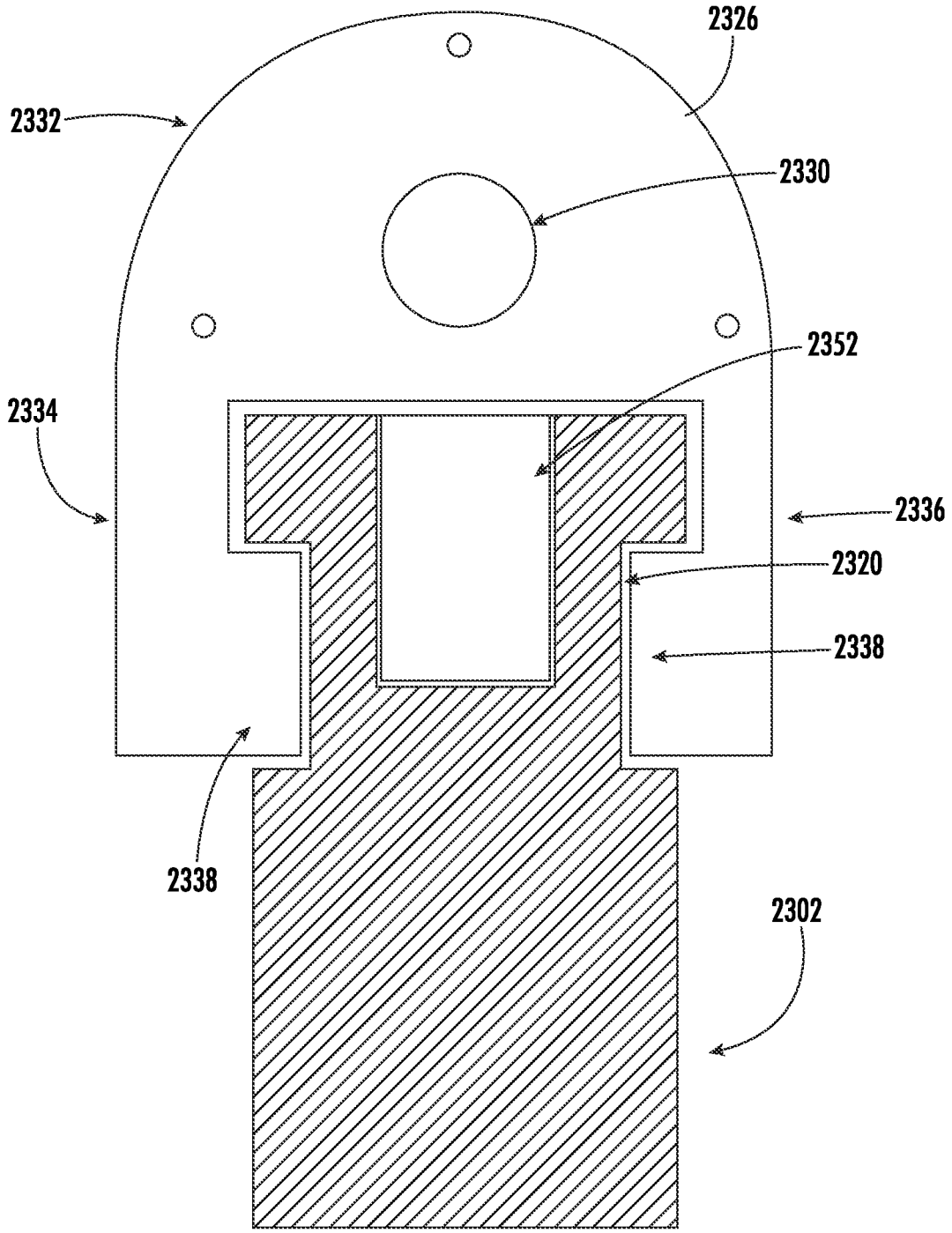
FIG. 50 is a detailed cross-sectional view of a portion of the spray head retraction assembly, according to an example embodiment.

Referring now to FIG. 50, a cross-sectional view of the second bracket flange 2328 slidably coupled with the rail 2302 is shown. The second bracket flange 2328 includes a bracket body 2332, a first arm 2334, and a second arm 2336. The first arm 2334 and the second arm 2336 extend away from the bracket body 2332 and along the rail 2302. Each of the first arm 2334 and the second arm 2336 include a slider 2338 extending into the channel 2320 and configured to engage the channel 2320 as the bracket assembly 2304 slides along the rail 2302. In some embodiments, the slider 2338 is a smooth material, such as metal or plastic, which frictionally slides within the channel 2320. A lubricant may be interposed between the slider 2338 and the channel 2320. In some embodiments, the slider 2338 is a bearing, such as ball bearing, roller bearing, linear bearing, and the like, such that a substantially frictionless interface is maintained between the bracket assembly 2304 and the rail 2302.

Figure 51:
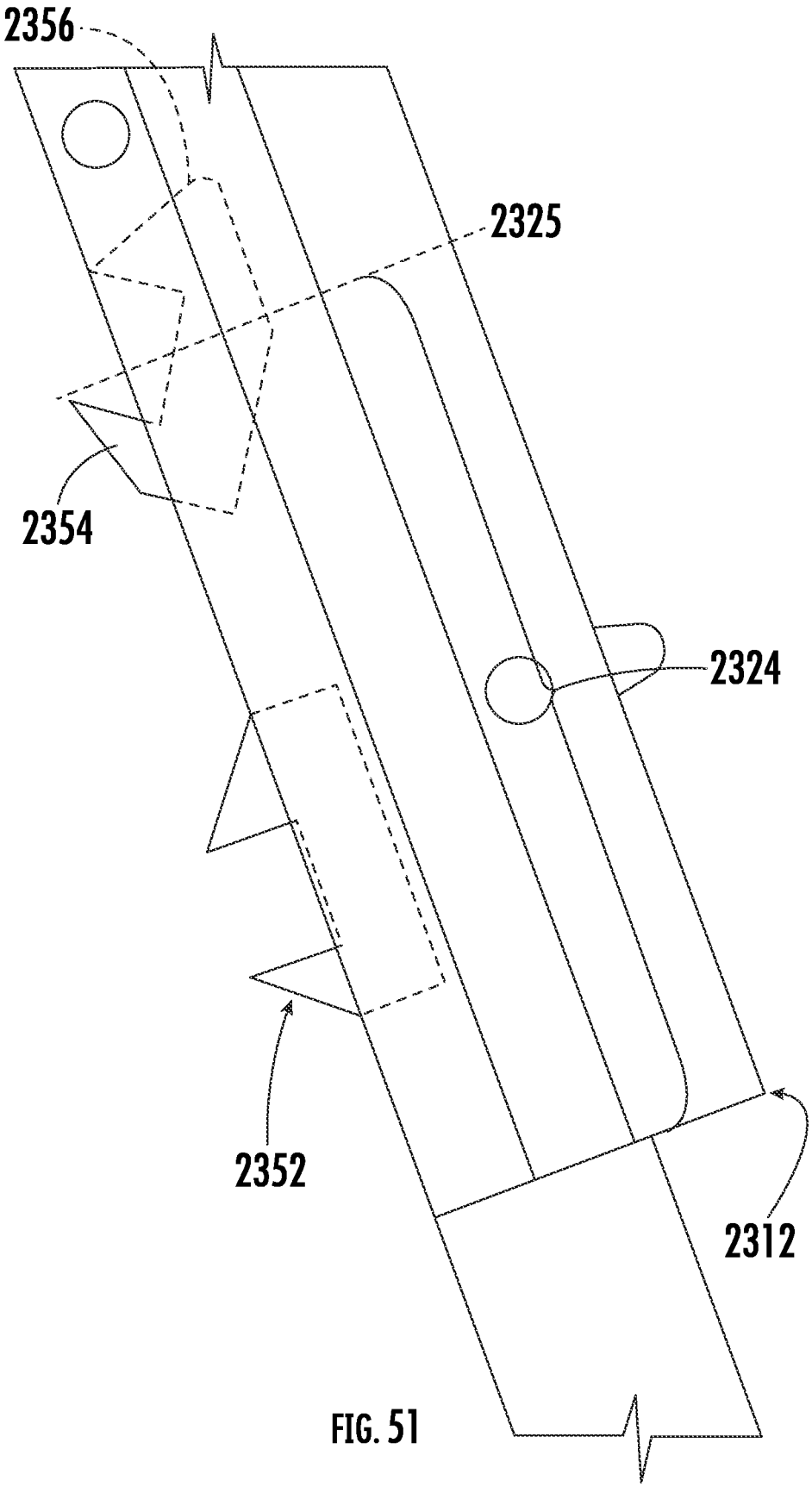
FIG. 51 is a detailed front view of the spray head retraction assembly of FIG. 48, according to an example embodiment.

Referring now to FIG. 51, the slow close assembly 2350 (e.g., damping assembly, etc.) is shown operably coupled with the rail 2302 and configured to slow down the retraction speed of the hose 136 and the bracket assembly 2304. The slow close assembly 2350 is configured to apply a second force to the bracket assembly 2304 in a direction toward the first rail end 2310 (e.g., in a direction opposite to the first force) when the bracket assembly 2304 (e.g., the second bracket flange 2328) is positioned within the second channel portion 2324. The slow close assembly 2350 does not apply the second force to the bracket assembly 2304 when the bracket assembly 2304 is positioned within the first channel portion 2322. As discussed herein, the second channel portion 2324 and the operable range of the slow close assembly 2350 entirely overlap one another. In other words, the slow close assembly 2350 operably engages, directly or indirectly, with the bracket assembly 2304 at all positions within the second channel portion 2324, and there are no positions within the second channel portion 2324 where the slow close assembly 2350 is not configured to be operably engaged with the bracket assembly 2304.

In some embodiments, such as shown in FIG. 49, the second channel portion 2324 extends along approximately 20% of the length of the rail 2302. In some embodiments, the second channel portion 2324 may extend along approximately 50% of the length of the rail 2302 such that the bracket assembly 2304 is operably engaged with the slow close assembly 2350 along approximately 50% of the length of the rail 2302. In some embodiments, the second channel portion 2324 extends along the entirely of the length of the rail 2302 such that the slow close assembly 2350 is operatively engaged with the bracket assembly 2304 at all positions between the first rail end 2310 and the second rail end 2312. In such an embodiment, the spray head 106 and the hose 136 may be configured to slow close at all times when retracting.

Figure 52:
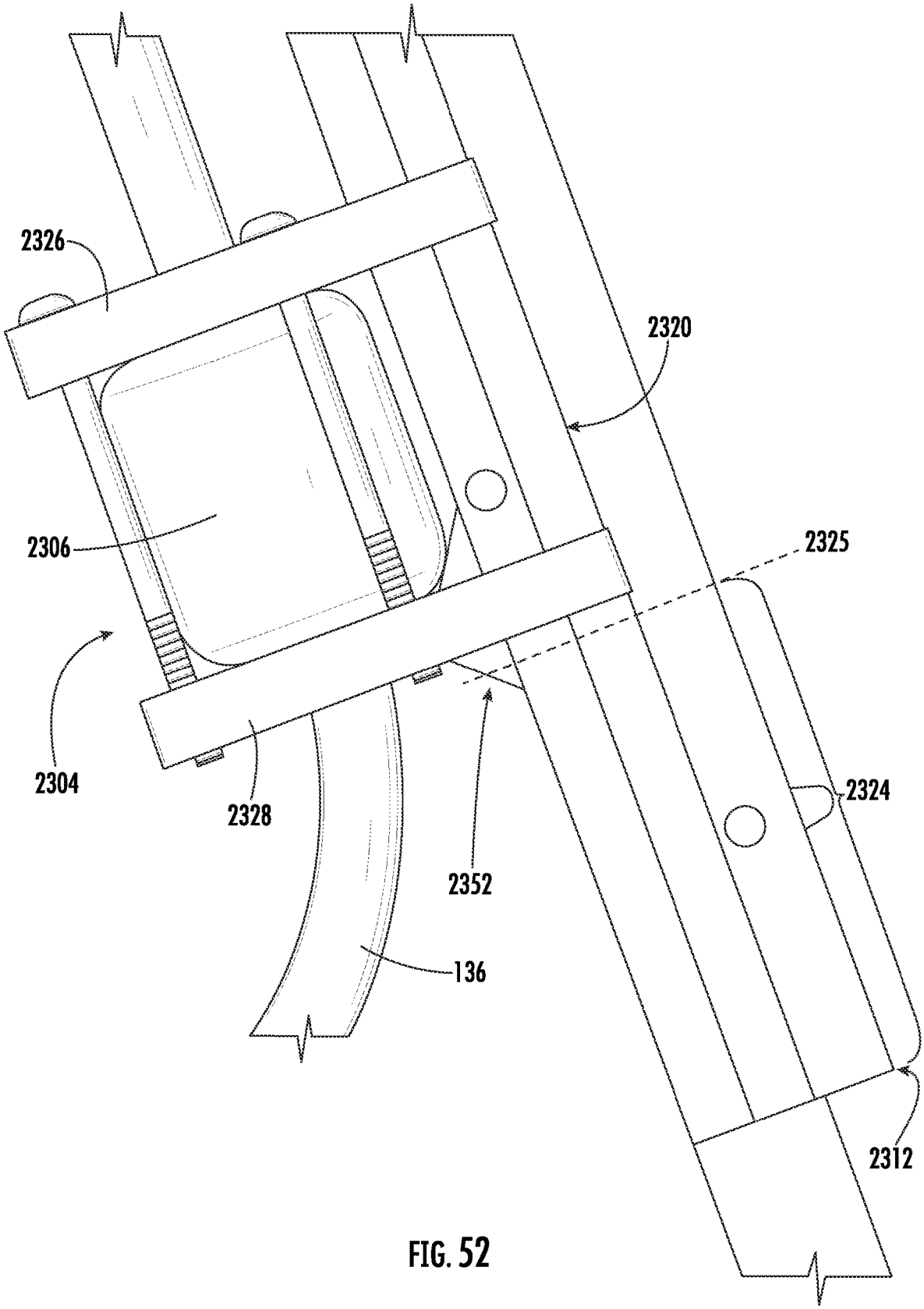
FIG. 52 is a detailed front view of the spray head retraction assembly of FIG. 48, according to an example embodiment.
Figure 53:
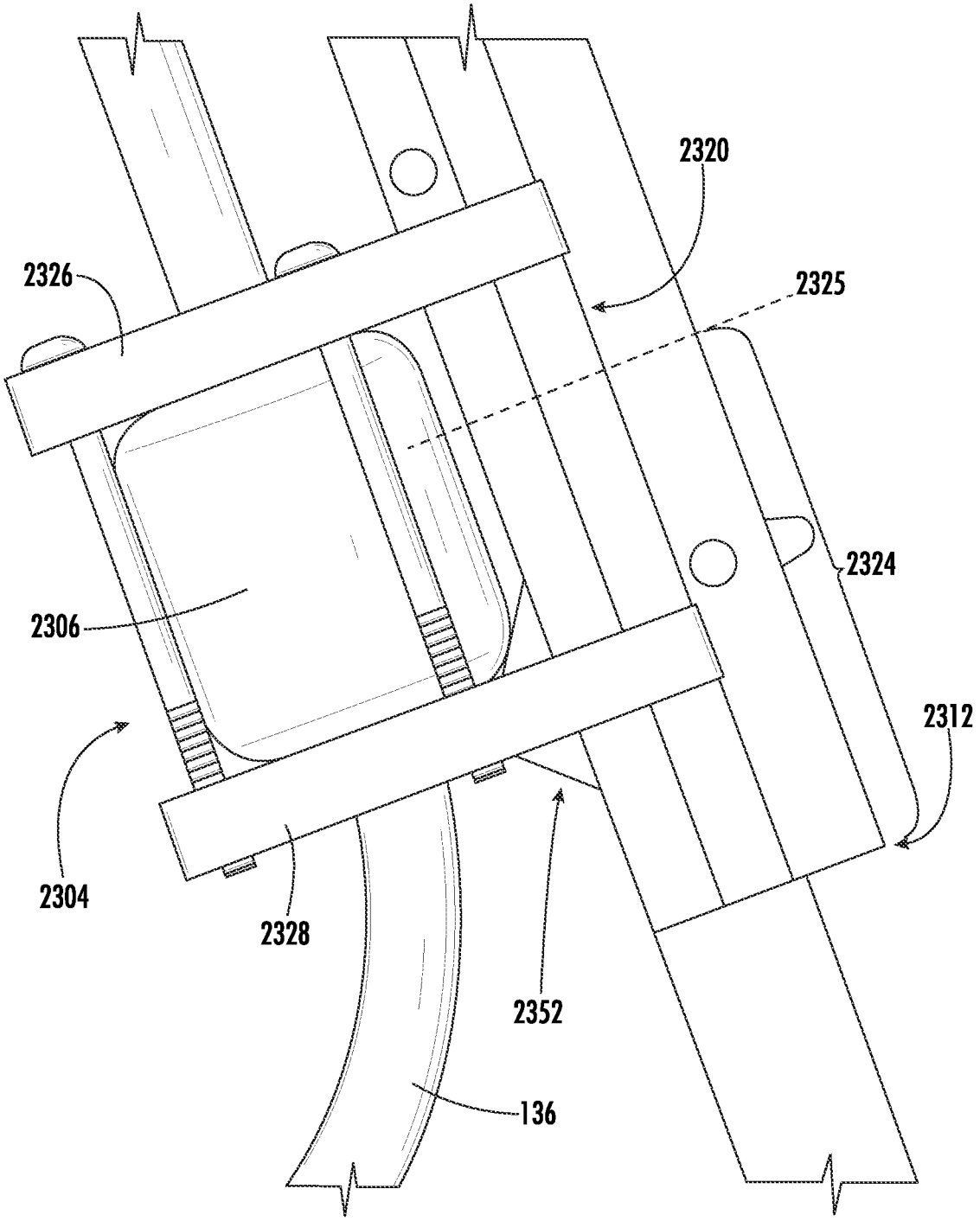
FIG. 53 is a detailed front view of the spray head retraction assembly of FIG. 48, according to an example embodiment.

The slow close assembly 2350 includes a retainer member 2352 configured to engage with the bracket assembly 2304 and operably couple the bracket assembly 2304 with the slow close assembly 2350. Specifically, the retainer member 2352 is configured for coupling with the second bracket flange 2328. Referring now to FIGS. 51-53, the retainer member 2352 is shown in a "use" position (FIG. 52) and a "rest" position (FIG. 53). When the retainer member 2352 is in the "use" position, the retainer member 2352 is not coupled with the bracket assembly 2304, the bracket assembly 2304 is positioned within the first channel portion 2322, and the faucet 100 is in an extended position. Further, when the retainer member is in the "use" position, the slow close assembly 2350 does not apply the second force to the bracket assembly 2304, as the bracket assembly 2304 is positioned within the first channel portion 2322. The retainer member 2352 includes jaws having a first jaw 2354 and a second jaw 2356. When the retainer member 2352 is in the "use" position, the second jaw 2356 is retracted into the rail 2302.

When the bracket assembly 2304 transitions from the first channel portion 2322 to the second channel portion 2324, such as when the spray head 106 is transitioning toward a retracted position, the bracket assembly 2304 engages with the first jaw 2354, which causes the second jaw 2356 to extend from the rail 2302. The first jaw 2354 and the second jaw 2356 cooperate to operatively couple the bracket assembly 2304 with the slow close assembly 2350. As the bracket assembly 2304 travels along the second channel portion 2324 toward the second rail end 2312, the slow close assembly 2350 applies the second force to the bracket assembly 2304 in a direction toward the first rail end 2310 to slow down the retraction speed of the bracket assembly 2304. In some embodiments, the first force is equal and opposite to the second force such that the hose retracts at a constant rate when the bracket assembly 2304 is coupled with the retainer member 2352. When the retainer member 2352 reaches the second rail end 2312, the retainer member 2352 is coupled with the bracket assembly 2304 and is in a "rest" position.

When a force is applied to the spray head 106 to extend the hose 136 from the spout 104, the bracket assembly 2304 applies a force to the second jaw 2356 and biases the retainer member 2352 along the second channel portion 2324 toward the first rail end 2310. When the bracket assembly 2304 crosses over the border 2325 to enter the first channel portion 2322, the second jaw 2356 retracts into the rail 2302 and the retainer member 2352 is decoupled from the slow close assembly 2350. In some embodiments, the second jaw 2356 applies a negligible counter-force (e.g., force to the bracket assembly 2304 in a direction toward the second rail end 2312) as the bracket assembly 2304 is being biased toward the first rail end 2310.

Figure 54:
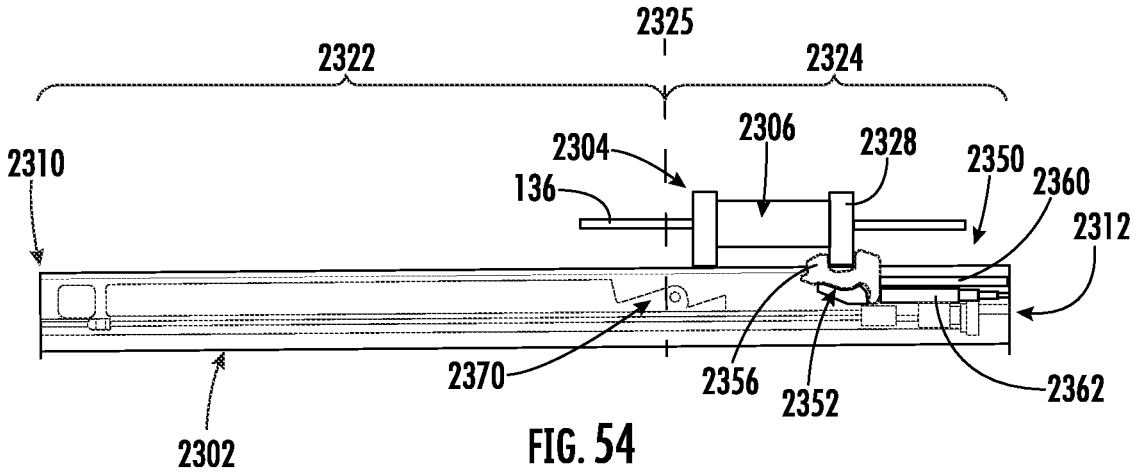
FIG. 54 is a cross-sectional view of the spray head retraction assembly of FIG. 48, according to an example embodiment.
Figure 55:
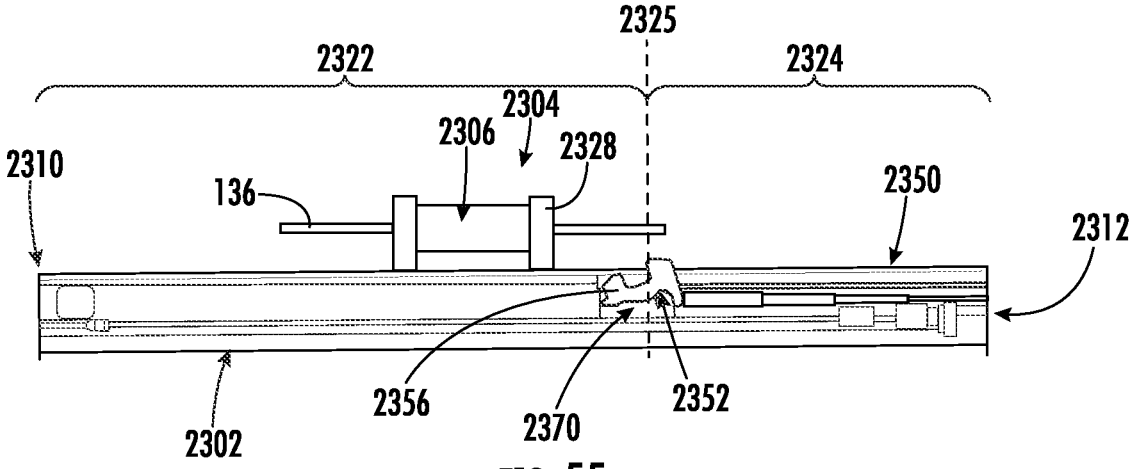
FIG. 55 is a cross-sectional view of the spray head retraction assembly of FIG. 48, according to an example embodiment.
Figure 56:
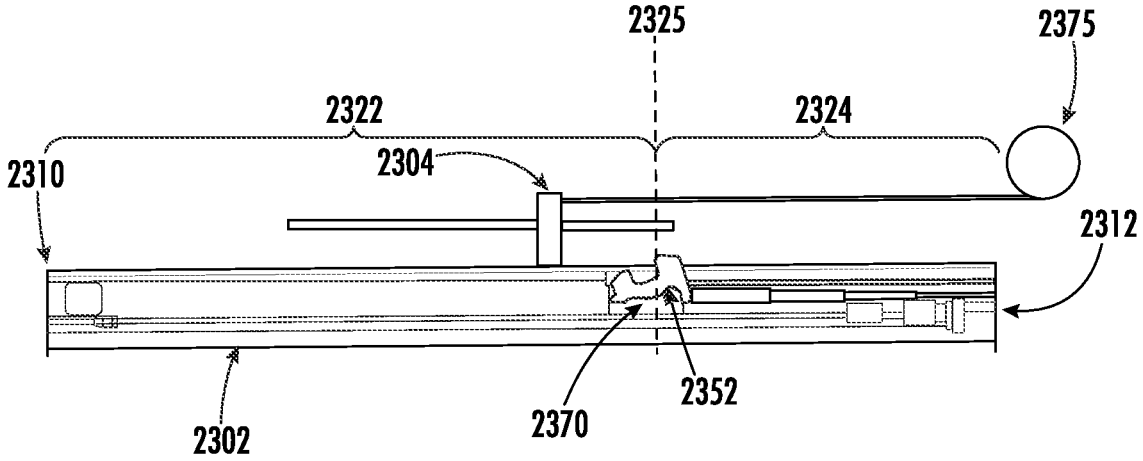
FIG. 56 is a cross-sectional view of a spray head retraction assembly, according to an example embodiment.

Referring now to FIGS. 54-56, a side, cross-sectional view of the rail 2302 is shown, according to an example embodiment. The slow close assembly 2350 may include a biasing member 2360 and a damping member 2362. The biasing member 2360 and the damping member 2362 are operatively coupled with the retainer member 2352 and the rail 2302 such that the biasing member 2360 and the damping member 2362 are operably coupled with the retainer member 2352 throughout the movement of the retainer member 2352 between the "use" position and the "rest" position. As shown in FIG. 54, the retainer member 2352 is in the "rest" position and the bracket assembly 2304 is operatively coupled with the slow close assembly 2350. When the retainer member 2352 is in the "rest" position, the biasing member 2360, shown as an extension spring, is in an unextended position, and the damping member 2362, shown as a linear damper, is in an unextended position. In some embodiments, the damping member 2362 is a unidirectional damper, configured to resist compression and substantially freely allow extension. When the spray head 106 is biased out of the retracted position, the hose 136 is extended from the spout 104, which causes movement of the bracket assembly 2304 along the rail 2302 toward the first rail end 2310. The bracket assembly 2304 engages with the second jaw 2356 of the retainer member 2352 and biases the retainer member 2352 along the second channel portion 2324 and toward the first rail end 2310. As the retainer member 2352 traverses toward the first rail end 2310, the biasing member 2360 and the damping member 2362 extend. In some embodiments, the damping member 2362 provides substantially no resistance when extending to a greater length. While the biasing member 2360 provides resistance to the movement of the retainer member 2352, the resistance is overcome by the user's engagement with the spray head 106.

As shown in the FIG. 55, when the retainer member 2352 reaches the border 2325 between the first channel portion 2322 and the second channel portion 2324, the second jaw 2356 retracts into the rail 2302, and the bracket assembly 2304 is decoupled from the slow close assembly 2350. When the second jaw 2356 retracts into the rail 2302, the retainer member 2352 engages a portion of the rail 2302, shown as a retainer projection 2370. The retainer projection 2370 is configured to maintain the retainer member 2352 in the "use" position and to prevent the retainer member 2352 from translational movement toward the second rail end 2312 without being operatively coupled with the bracket assembly 2304.

When the spray head 106 is released, the weight 2306 applies a force to the bracket assembly 2304 in a direction toward the second rail end 2312. When the bracket assembly 2304 engages with the first jaw 2354, the force applied by the weight 2306 causes the second jaw 2356 to extend from the rail 2302. The first jaw 2354 and the second jaw 2356 cooperate to operably couple the bracket assembly 2304 with the slow close assembly 2350. When the second jaw 2356 extends from the rail 2302, the retainer member 2352 decouples from the retainer projection 2370 and the retainer member 2352 starts to translate toward the second rail end 2312 while coupled with the bracket assembly 2304. The biasing member 2360 applies a force to the retainer member 2352 to bias the retainer member 2352 toward the second rail end 2312. At the same time, the damping member 2362 applies a force to the retainer member 2352 in a direction toward the first rail end 2310. Together, the biasing member 2360 and the damping member 2362 cooperate to slow the retraction speed of the hose 136.

The slow close assembly 2350 is further configured to seat the spray head 106 in the spout 104. As the retainer member 2352 gets nearer to the "rest" position, the spray head 106 gets nearer to the spout 104. In some embodiments, the force needed to properly seat the spray head 106 into the spout 104 such that the outer surfaces of both the spray head 106 and the spout 104 are contiguous is greater than the force applied by the weight 2306. Thus, the biasing member 2360 applies a force to the bracket assembly 2304 to pull the spray head 106 into the spout 104. Together, the biasing member 2360 and the weight 2306 cooperate to provide a sufficient force to seat the spray head 106 in the spout 104.

In some embodiments, the slow close assembly 2350 provides a constant speed of retraction for the bracket assembly 2304. The average rate of retraction of the hose 136 may be different when the bracket assembly 2304 is positioned in the first channel portion 2322 than when the bracket assembly 2304 is positioned in the second channel portion 2324. For example, the rate of retraction of the hose 136 may be greater (e.g., faster) when the bracket assembly 2304 is positioned within the first channel portion 2322 than when the bracket assembly 2304 is positioned within the second channel portion 2324.

As shown in FIG. 56, in some embodiments, the weight 2306 may be replaced with a different force body 2375, such as a constant force spring, extension spring, and the like. The force body 2375 may be configured to provide the first force to the bracket assembly 2304 in a direction toward the second rail end 2312 regardless of the orientation of the rail 2302. For example, the rail 2302 may be positioned horizontally relative to the first surface 170 (e.g., a countertop) and the force body 2375 may still apply the first force to the bracket assembly 2304. The force body 2375 may act upon the bracket assembly 2304 when the bracket assembly 2304 is in either of the first channel portion 2322 and the second channel portion 2324. The slow close assembly 2350 only provides the second force to the bracket assembly 2304 when the bracket assembly 2304 is coupled with the retainer member 2352.

In some embodiments, the hose retraction assembly 2300 is fully integrated into the rail 2302 such that the bracket assembly 2304, the weight 2306 (e.g., the force body 2375), and the slow close assembly 2350 are enclosed within the rail 2302. This may be advantageous to prevent the bracket assembly 2304 form snagging on equipment stored below the sink and to prevent the hose retraction assembly 2300 from getting damaged.

As utilized herein with respect to numerical ranges, the terms "approximately," "about," "substantially," and similar terms generally mean+/−10% of the disclosed values, unless specified otherwise. As utilized herein with respect to structural features (e.g., to describe shape, size, orientation, direction, relative position, etc.), the terms "approximately," "about," "substantially," and similar terms are meant to cover minor variations in structure that may result from, for example, the manufacturing or assembly process and are intended to have a broad meaning in harmony with the common and accepted usage by those of ordinary skill in the art to which the subject matter of this disclosure pertains. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above.

What is claimed is:

1. A faucet mounting assembly for a faucet having a faucet body and a nozzle configured to releasably attach to an end of the faucet body, the faucet mounting assembly comprising:

a conical nut coupled to the nozzle;

a receiving clip coupled to an inner surface of the end of the faucet body and configured to receive the conical nut within, the receiving clip comprising:

a substantially annular base;

a slot extending through a circumferential surface of the substantially annular base; and one or more tabs comprising fixed ends fixed to the substantially annular base and free ends opposite the fixed ends and bounded by the slot, the one or more tabs being configured to flex radially between a non-flexed position and flexed position;

wherein the slot comprises a circumferential segment extending circumferentially along the circumferential surface of the substantially annular base through at least a portion of the receiving clip, wherein the slot further comprises a longitudinal segment substantially perpendicular to the circumferential segment and intersecting the circumferential segment, and wherein the one or more tabs are bounded by the circumferential segment and the longitudinal segment on adjacent sides, and wherein the one or more tabs flex into the flexed position when the conical nut is repositioned in and out of engagement with the receiving clip and return to the non-flexed position when the conical nut is seated within the receiving clip.

2. The faucet mounting assembly of claim 1, wherein the receiving clip comprises one or more protrusions extending inward from the one or more tabs.

3. The faucet mounting assembly of claim 2, wherein the conical nut comprises a first engagement surface and a second engagement surface, and wherein the one or more protrusions engage the first engagement surface as the conical nut is moved into engagement with the receiving clip, causing the one or more tabs to flex radially outward, and abut the second engagement surface when the conical nut is engaged with the receiving clip.

4. The faucet mounting assembly of claim 1, wherein the receiving clip comprises two sets of tabs positioned opposite one another, the two sets of tabs configured to engage the conical nut when the conical nut is received within the receiving clip.

5. The faucet mounting assembly of claim 1, wherein the conical nut comprises a ridge configured to bias the one or more tabs into the flexed position when the conical nut is repositioned out of engagement with the receiving clip.

6. The faucet mounting assembly of claim 1, wherein the one or more tabs are in the non-flexed position when the conical nut is disengaged from the receiving clip.

7. The faucet mounting assembly of claim 1, wherein the conical nut comprises a passage wholly extending through the conical nut, and wherein the nozzle is coupled to the conical nut within the passage.

* * * * *